US009989911B2

(12) United States Patent
Nakama et al.

(10) Patent No.: US 9,989,911 B2
(45) Date of Patent: Jun. 5, 2018

(54) IMAGE FORMING APPARATUS, IMAGE FORMING SYSTEM AND FIXING DEVICE

(71) Applicant: CANON KABUSHIKI KAISHA, Tokyo (JP)

(72) Inventors: Katsuya Nakama, Nagareyama (JP); Satoru Yamamoto, Noda (JP); Masahiro Tsujibayashi, Nagareyama (JP); Yasuharu Chiyoda, Nagareyama (JP); Nobuhiro Kikuchi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/196,404

(22) Filed: Jun. 29, 2016

(65) Prior Publication Data

US 2017/0003637 A1 Jan. 5, 2017

(30) Foreign Application Priority Data

Jun. 30, 2015 (JP) ..... 2015-132170
Jun. 30, 2015 (JP) ..... 2015-132171
Jun. 30, 2015 (JP) ..... 2015-132173

(51) Int. Cl.
*G03G 15/20* (2006.01)
*G03G 21/00* (2006.01)
*G03G 15/00* (2006.01)

(52) U.S. Cl.
CPC ..... *G03G 15/70* (2013.01); *G03G 15/2017* (2013.01); *G03G 15/2025* (2013.01); *G03G 15/2035* (2013.01); *G03G 15/502* (2013.01)

(58) Field of Classification Search
CPC .... G03G 15/00; G03G 15/20; G03G 15/2035; G03G 15/2025; G03G 15/2017; G03G 15/502; G03G 15/70; G03G 21/00
(Continued)

(56) References Cited

U.S. PATENT DOCUMENTS 6,016,409 A * 1/2000 Beard et al. ..... G03G 15/2064 399/110
7,756,435 B2 7/2010 Nakano
(Continued)

FOREIGN PATENT DOCUMENTS

EP 2293151 A2 3/2011
EP 2479618 A2 7/2012
(Continued)

OTHER PUBLICATIONS

Search Report issued in corresponding European Patent Application No. 16176927.8 dated Nov. 30, 2016.
(Continued)

*Primary Examiner* — Nguyen Ha
(74) *Attorney, Agent, or Firm* — Fitzpatrick, Cella, Harper & Scinto

(57) ABSTRACT

An image forming apparatus includes an image forming station for forming an unfixed toner image on a sheet; a fixing portion detachably mountable to the apparatus, said fixing portion including a rotatable member for being contacted by an image carrying surface of the sheet; a jam detector for detecting jamming in said fixing portion; an executing portion for executing a cleaning process for said rotatable member after clearance of the jamming; a storing portion, provided on said fixing portion, for storing information as to whether or not the cleaning process is executed; and a display for displaying a state of capability of image forming operation. The executing portion executes the cleaning process before said display displays the state, when the information stored in said storing portion of said fixing portion mounted in said main assembly indicates non-execution of said cleaning process.

47 Claims, 42 Drawing Sheets

(58) Field of Classification Search
USPC ..... 399/22, 34, 71, 327
See application file for complete search history.

(56) References Cited

U.S. PATENT DOCUMENTS

| | | | | |
|---|---|---|---|---|
| 9,392,642 | B2 | 7/2016 | Tanaka et al. | |
| 2007/0122166 | A1* | 5/2007 | Takahashi et al. | C07D 519/00 399/24 |
| 2008/0044189 | A1 | 2/2008 | Fukui | |
| 2008/0175614 | A1* | 7/2008 | Miyazaki | G03G 15/2025 399/68 |
| 2009/0072468 | A1* | 3/2009 | Ueda | G03G 15/2025 271/9.05 |
| 2011/0058201 | A1 | 3/2011 | Mueller | |
| 2012/0076510 | A1 | 3/2012 | Mizuno et al. | |
| 2012/0300240 | A1 | 11/2012 | Morita | |

FOREIGN PATENT DOCUMENTS

| | | | | | |
|---|---|---|---|---|---|
| JP | 0895438 | A | | 4/1996 | |
| JP | 2001-324848 | A | | 11/2001 | |
| JP | 2004029592 | A | | 1/2004 | |
| JP | 2005-338195 | A | | 12/2005 | |
| JP | 2007-105879 | A | | 4/2007 | |
| JP | 2007-133168 | A | | 5/2007 | |
| JP | 2007155758 | A | * | 6/2007 | C07D 519/00 |
| JP | 2007-333845 | A | | 12/2007 | |
| JP | 2008-145695 | A | | 6/2008 | |
| JP | 2008203569 | A | | 9/2008 | |
| JP | 2010-175831 | A | | 8/2010 | |
| JP | 2011-056945 | A | | 3/2011 | |
| JP | 2011-227451 | A | | 11/2011 | |
| JP | 2012-068560 | A | | 4/2012 | |
| JP | 2012-189696 | A | | 10/2012 | |
| JP | 2012-249075 | A | | 12/2012 | |
| JP | 2013-167663 | A | | 8/2013 | |
| JP | 2013-228648 | A | | 11/2013 | |
| JP | 2013-242425 | A | | 12/2013 | |
| JP | 2014-010393 | A | | 1/2014 | |
| JP | 2014-215598 | A | | 11/2014 | |
| JP | 2015-001572 | A | | 1/2015 | |

OTHER PUBLICATIONS

Office Action dated Nov. 29, 2016, in Japanese Patent Application No. 2015-132170.
Office Action dated Nov. 29, 2016, in Japanese Patent Application No. 2015-132171.
Office Action dated Apr. 4, 2017, in corresponding Japanese Application No. 2015-132171.

* cited by examiner (a)

| | STORED |
|---|---|
| JAM HYS. | YES |
| FX. ID | ENVELOPE 0001 |

(b)

| | STORED |
|---|---|
| JAM HYS. | NO |
| FX. ID | ENVELOPE 0001 |

Fig. 8

| FIXING DEVICE ID | JAM HYSTRESIS |
|---|---|
| RESISTANCE R1 (DEVICE A) | YES |
| RESISTANCE R2 (DEVICE B) | NO |

Fig. 19

(a)

| | STORED (1) | STORED (2) |
|---|---|---|
| FIXING DEVICE ID | DEVICE A | DEVICE B |
| JAM HYS. | NO | NO |
| TIME | 2014/12/31 12:00:00 | 2014/12/01 10:00:00 |

(b)

| | STORED |
|---|---|
| FIXING DEVICE ID | DEVICE A |
| JAM HYS. | NO |
| TIME | 2014/12/31 12:00:00 |

(c)

| | STORED |
|---|---|
| FIXING DEVICE ID | DEVICE A |
| JAM HYS. | YES |
| TIME | 2015/01/01 13:30:00 |

Fig. 30

(a)

| | STORED (1) | STORED (2) |
|---|---|---|
| FIXING DEVICE ID | DEVICE A | DEVICE B |
| JAM HYS. | YES | NO |
| TIME | 2015/01/01 12:00:00 | 2014/12/01 10:00:00 |

(b)

| | STORED |
|---|---|
| FIXING DEVICE ID | DEVICE A |
| JAM HYS. | YES |
| TIME | 2015/01/01 12:00:00 |

Fig. 31

IMAGE FORMING APPARATUS, IMAGE FORMING SYSTEM AND FIXING DEVICE

FIELD OF THE INVENTION AND RELATED ART

The present invention relates to an electrophotographic type image forming apparatus, an electrophotographic type image forming system and a fixing device usable with the electrophotographic type image forming apparatus.

The electrophotographic type image forming apparatus comprises a fixing device (fixing portion) for fixing the toner image on a recording material. It is known to replace the fixing device depending on the size and/or kind of the recording material for the purpose of high quality prints. Japanese Laid-open Patent Application 2011-56945, for example, proposes that identifying information of the fixing device is detected, and when the fixing device is not proper for the requirements of the printing job to be performed.

On the other hand, if sheet jamming occurs in the fixing device, unfixed toner is likely to deposit on a fixing member (rotatable member) of the fixing device. Therefore, after the jam clearance operation by the user to remove the jammed sheet, a cleaning operation for the fixing member is carried out.

Under the circumstances, when a plurality of fixing devices are selectively usable, there is a liability that before the fixing device is cleaned, the fixing device is replaced with another fixing device. If the uncleaned fixing device is reinstalled in the image forming apparatus, the printing operation may be carried out without the cleaning of the fixing member. This may result in contamination of the print with the unremoved toner.

SUMMARY OF THE INVENTION

It is a object of the present invention to provide an image forming apparatus, an image forming system and a fixing device, with which the image quality is maintained even in the case that the fixing device is replaceable.

According to an aspect of the present invention, there is provided an image forming apparatus comprising a main assembly; an image forming station configured to form an unfixed toner image on a recording material; a fixing portion detachably mountable to said main assembly, said fixing portion including a rotatable member for being contacted by such a surface of the recording material as carries the unfixed toner image formed by said image forming station to fix the unfixed toner image on the recording material; a jam detecting portion configured to detect jamming in said fixing portion; an executing portion configured to execute a cleaning process for cleaning said rotatable member after clearance of the jamming detected by said jam detecting portion; a storing portion provided on said fixing portion and configured to store information indicative of whether or not the cleaning process is executed by said executing portion; and a notifying portion configured to notify an operator of a state of capability of image forming operation on the recording material of said image forming apparatus, wherein said executing portion executes the cleaning process before said notifying portion executes the notification, when the information stored in said storing portion of said fixing portion mounted in said main assembly indicates non-execution of said cleaning process.

According to another aspect of the present invention, there is provided an image forming system comprising a image forming apparatus including a main assembly; an image forming station configured to form an unfixed toner image on a recording material; a fixing portion exchangeable with another fixing portion, said fixing portion including a rotatable member contactable to such a surface of the recording material as carries the unfixed toner image, and a discrimination portion configured to provide identifying information for discriminating from said another fixing portion; a jam detecting portion configured to detect jamming in said fixing portion; an executing portion configured to execute a cleaning process for cleaning said rotatable member after clearance of the jamming detected by said jam detecting portion; and a notifying portion configured to notify an operator of a state of capability of image forming operation on the recording material of said image forming apparatus; and a storing device communicatably connected with said image forming apparatus and configured to store cleaning information indicative of whether or not the cleaning process is executed by said executing portion in correlation with the identifying information of said fixing portion mounted in said main assembly of said main assembly of the image forming apparatus, wherein said executing portion executes the cleaning process before said notifying portion executes the notification, when the cleaning information stored in said storing device in correlation with the identifying information indicated by said discrimination portion of said fixing portion mounted in said image forming apparatus indicates non-execution of the cleaning process.

According to a further aspect of the present invention, there is provided a fixing device detachably mountable to an image forming apparatus, said fixing device comprising a rotatable member for being contacted by such a surface of the recording material as carries the unfixed toner image formed by said image forming station to fix the unfixed toner image on the recording material; a cleaning portion configured to clean said rotatable member; and a storing portion configured to store information indicative of whether or not a cleaning process of said cleaning portion is executed upon a clearance operation for jamming in said fixing device.

Further features of the present invention will become apparent from the following description of exemplary embodiments with reference to the attached drawings.

Part (a) of FIG. 8 shows an example of information stored in a memory of the fixing device before the execution of the cleaning operation, and part (b) shows an example of information stored in the memory after the execution of the cleaning of the fixing device.

Figure 9:
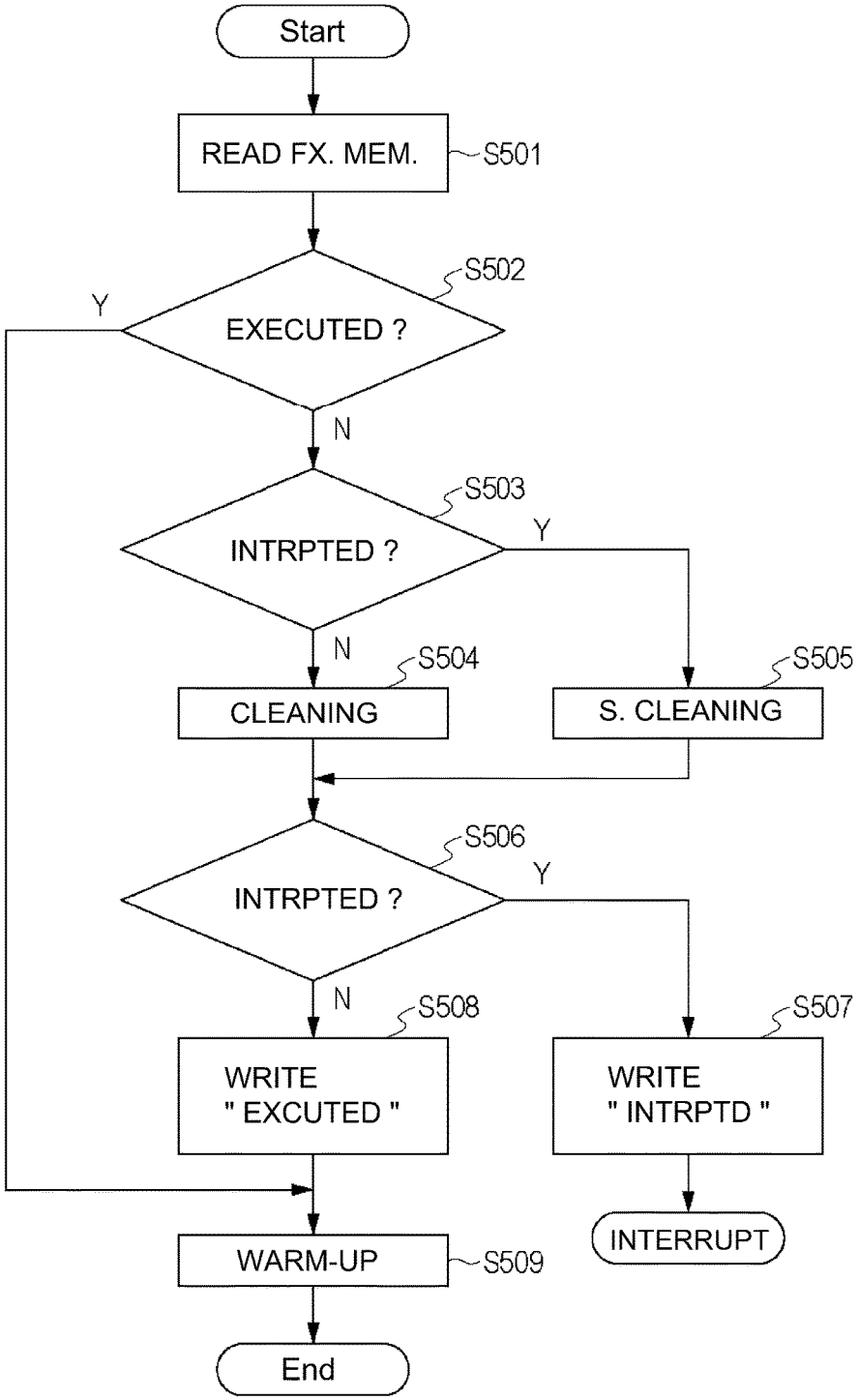

FIG. 9 is a flow chart of the start-up sequential operations 2.

Figure 10:
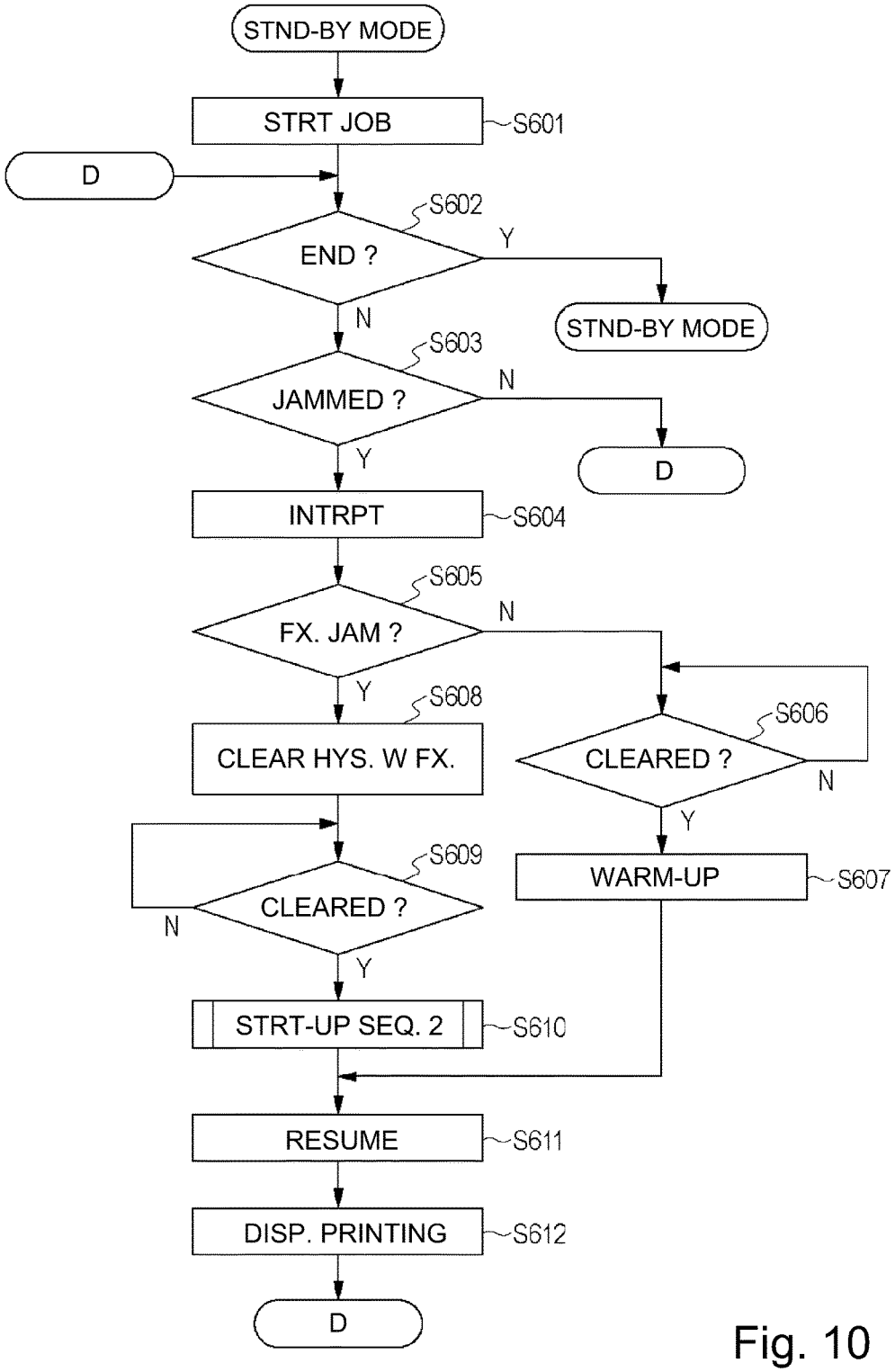

FIG. 10 is a flow chart of the operations at the time when sheet jamming occurs in the fixing device.

Figure 11:
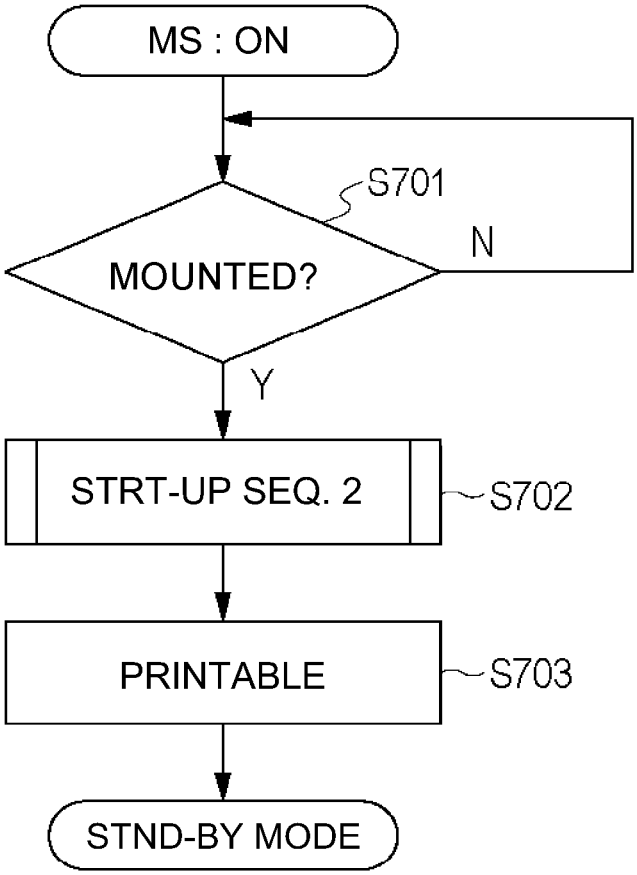

FIG. 11 is a flow chart showing the operations from the actuation of a main switch to a stand-by mode.

Figure 12:
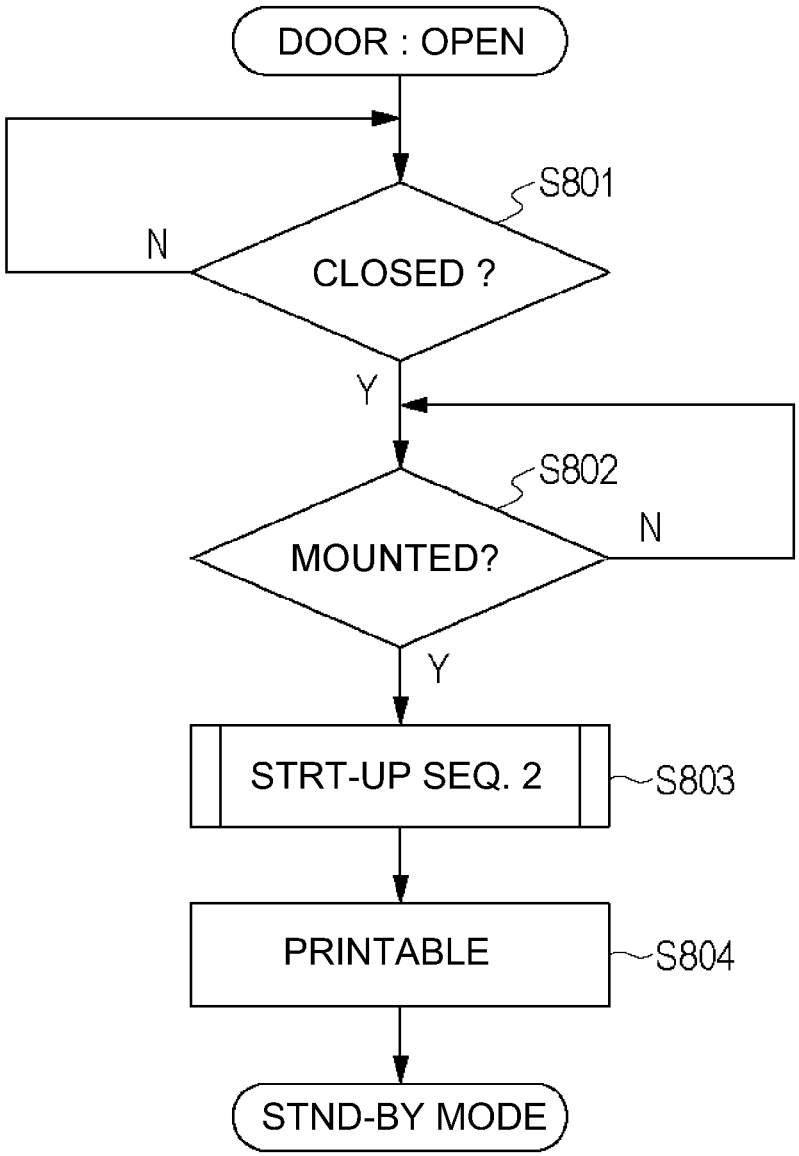

FIG. 12 is a flow chart showing the operations from the state in which a front door is open to the stand-by mode.

Figure 13:
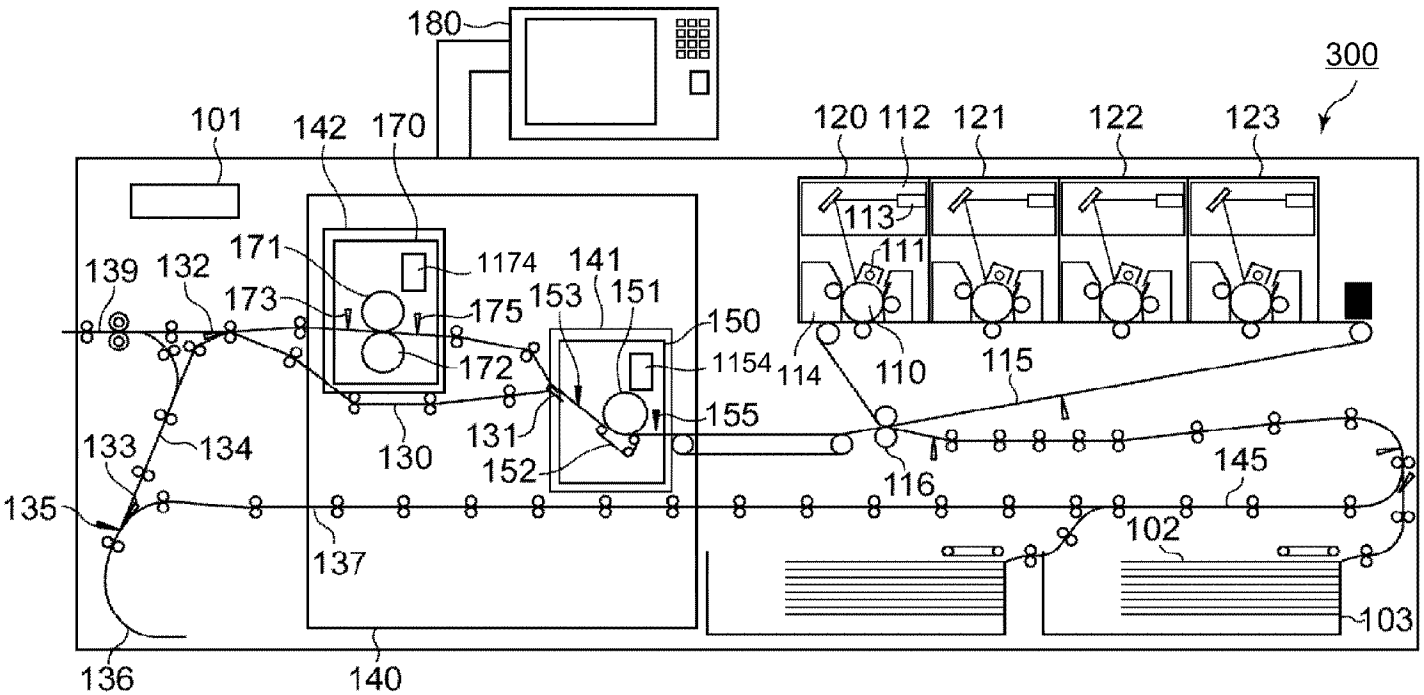

FIG. 13 is a sectional view of an example of an image forming apparatus.

Figure 14:
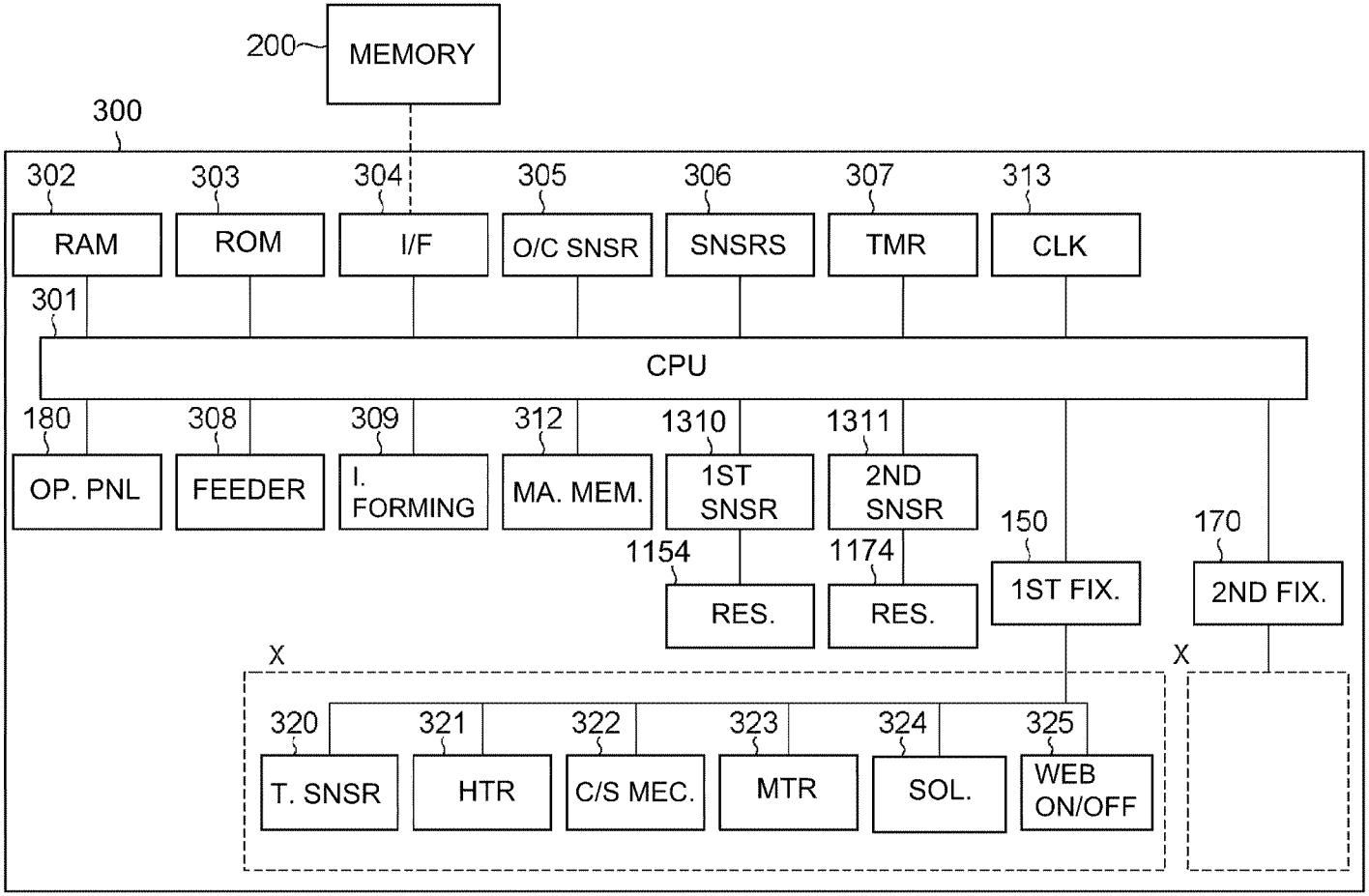

FIG. 14 is a block diagram of a control system.

Figure 15:
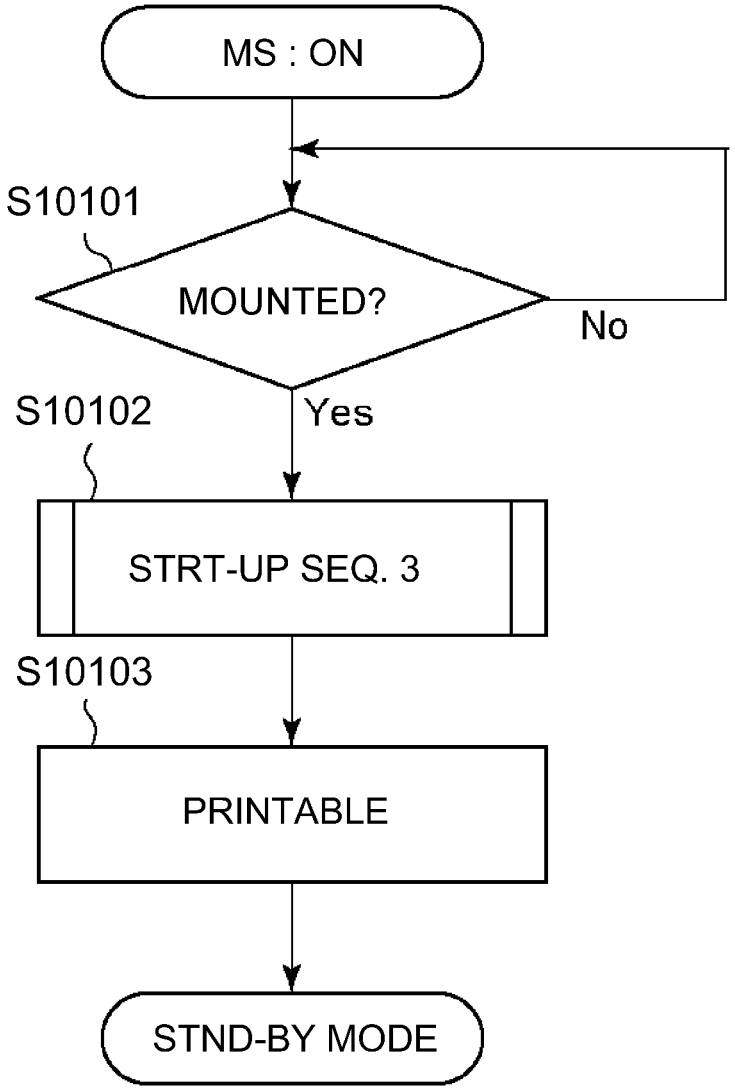

FIG. 15 is a flow chart showing the operations from the actuation of a main switch to a stand-by mode.

Figure 16:
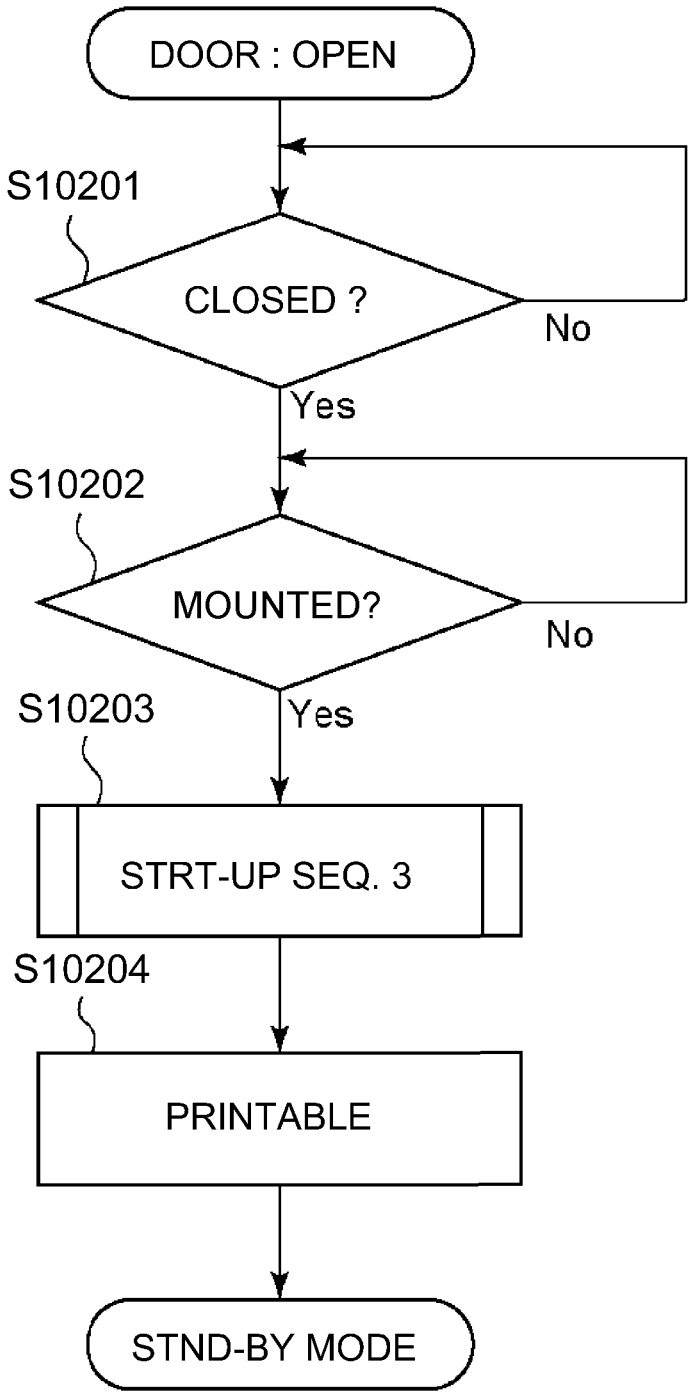

FIG. 16 is a flow chart showing the operations from the state in which a front door is open to the stand-by mode.

Figure 17:
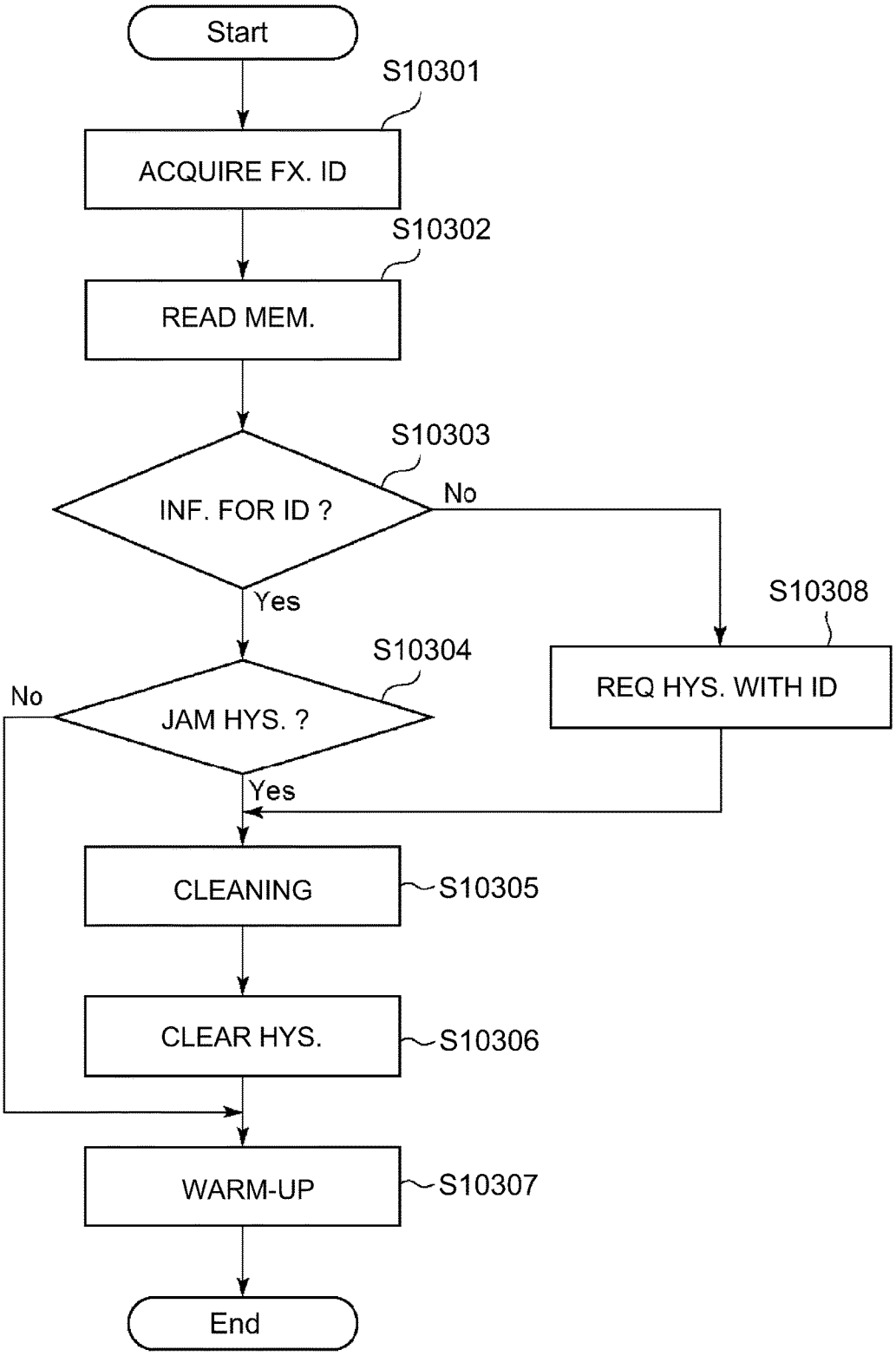

FIG. 17 is a flow chart of the start-up sequential operations 3.

Figure 18:
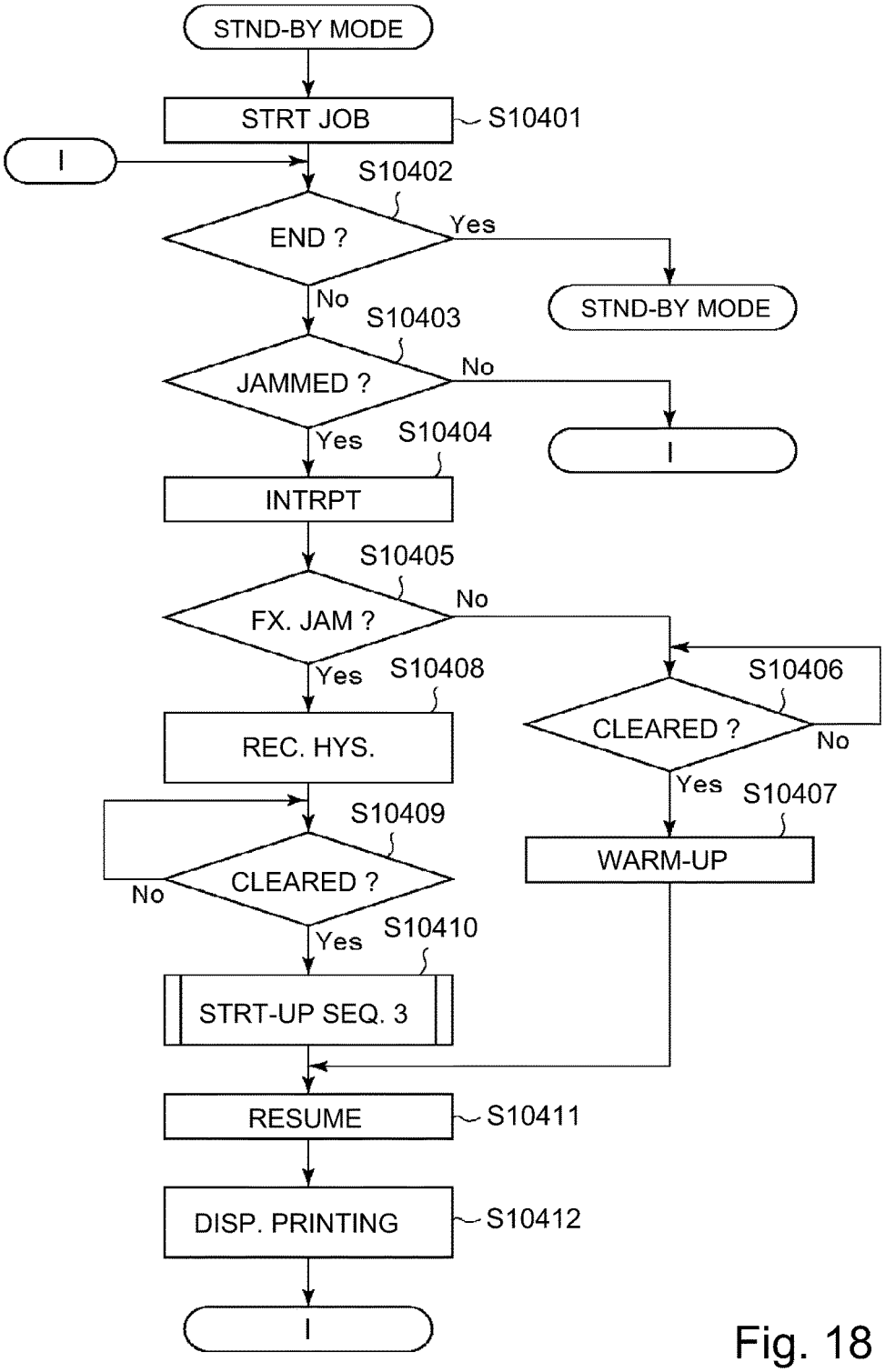

FIG. 18 is a flow chart of the operations at the time when sheet jamming occurs in the fixing device.

FIG. 19 shows an example of information stored in a memory.

Figure 20:
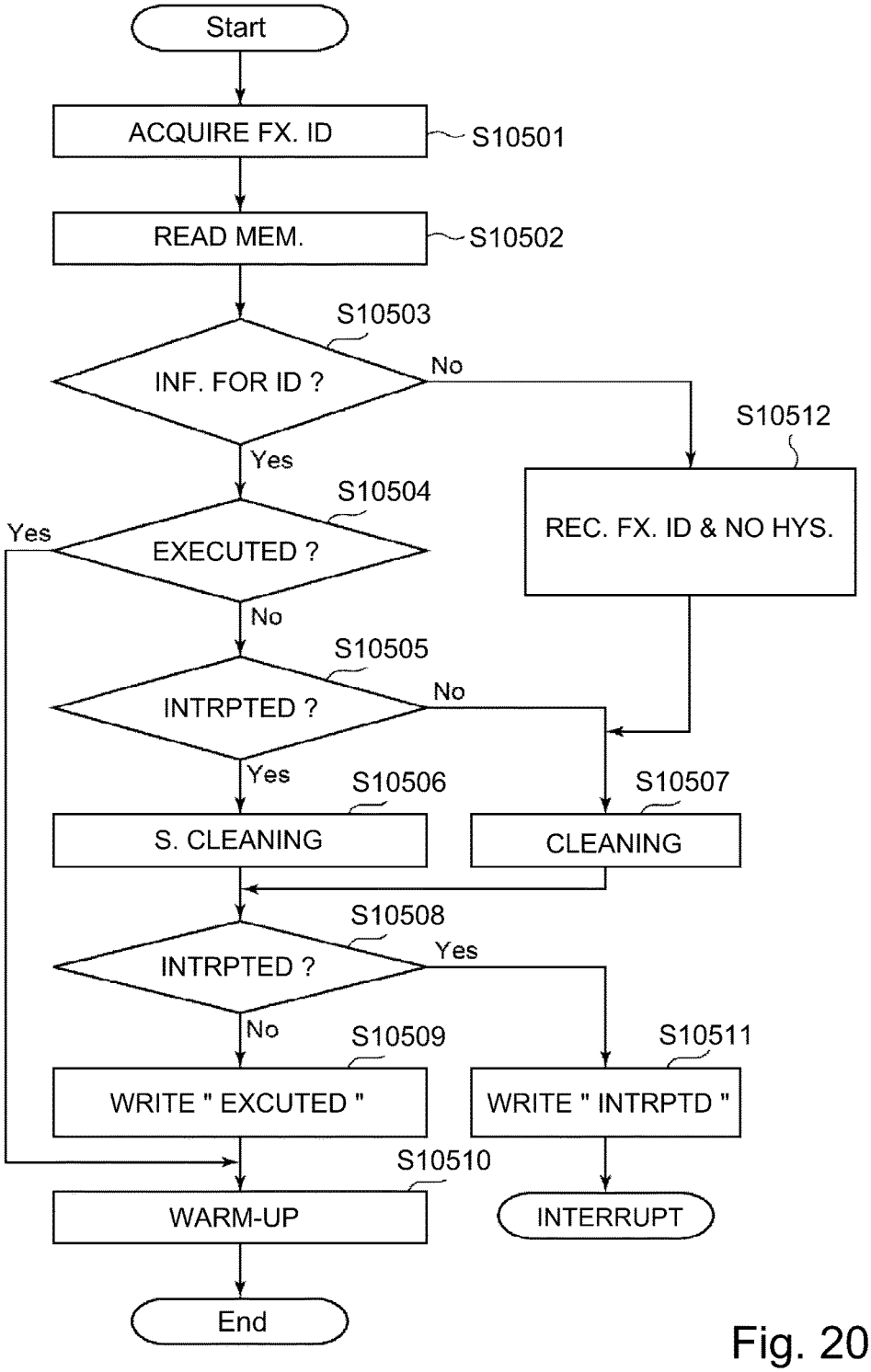

FIG. 20 is a flow chart of the start-up sequential operations 3.

Figure 21:
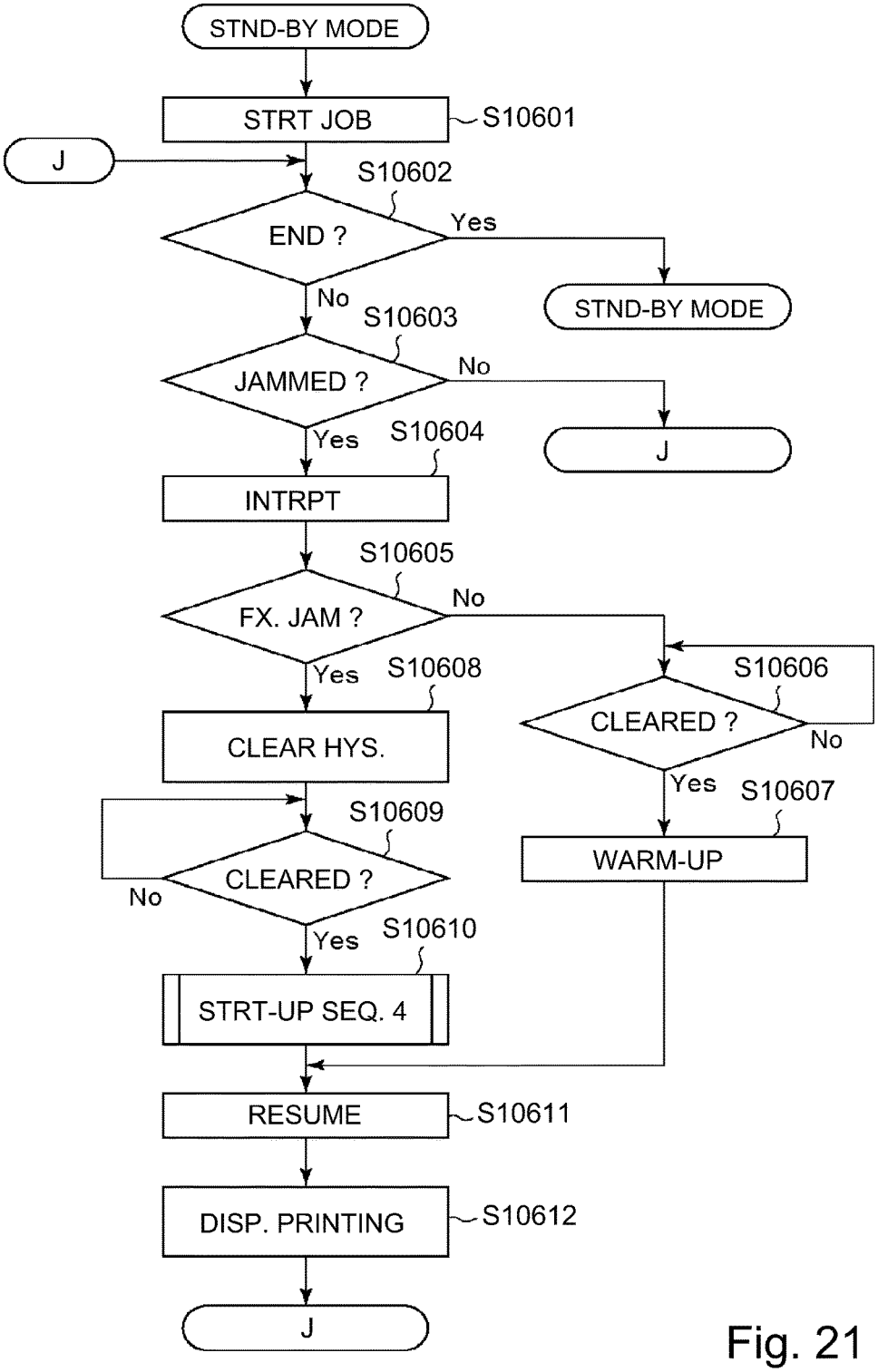

FIG. 21 is a flow chart of the operations at the time when sheet jamming occurs in the fixing device.

Figure 22:
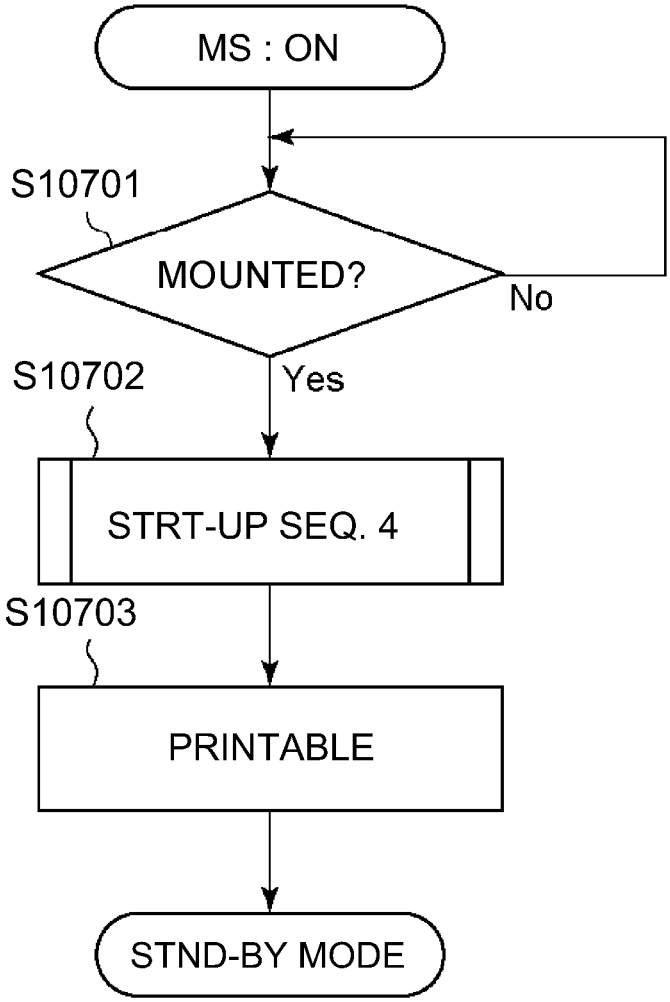

FIG. 22 is a flow chart showing the operations from the actuation of a main switch to a stand-by mode.

Figure 23:
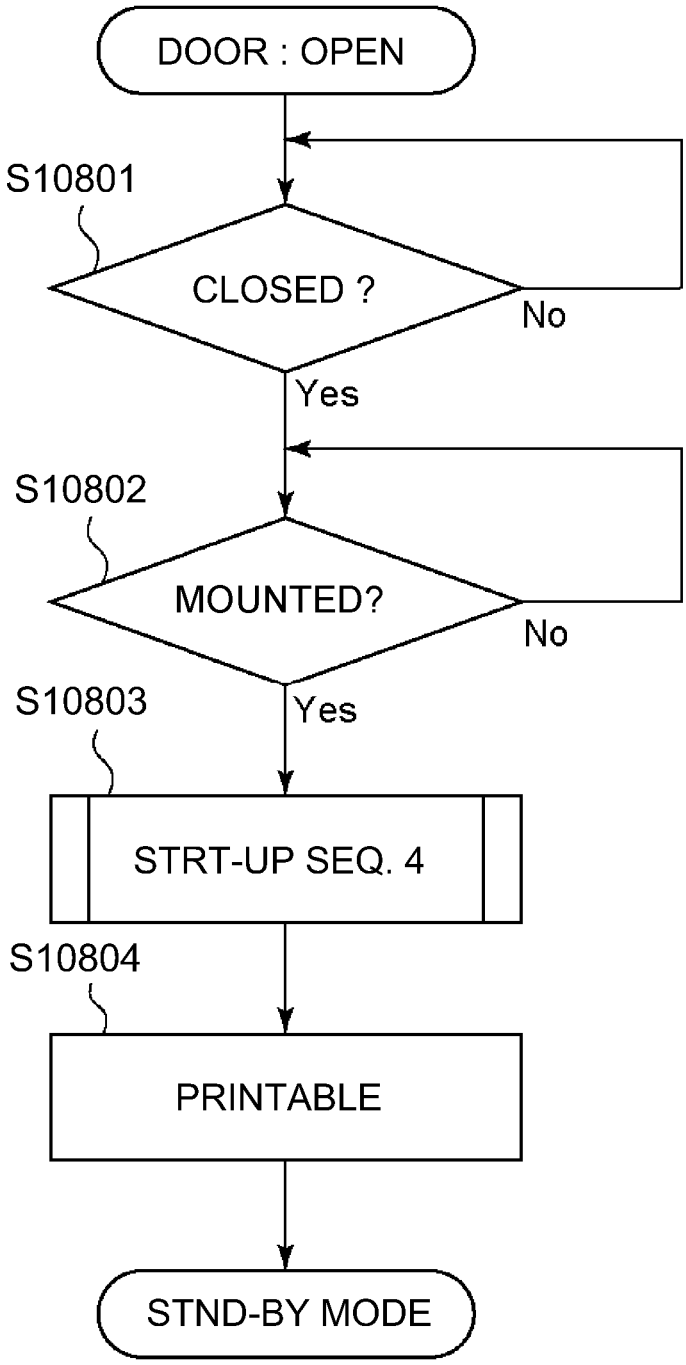

FIG. 23 is a flow chart showing the operations from the state in which a front door is open to the stand-by mode.

Figure 24:
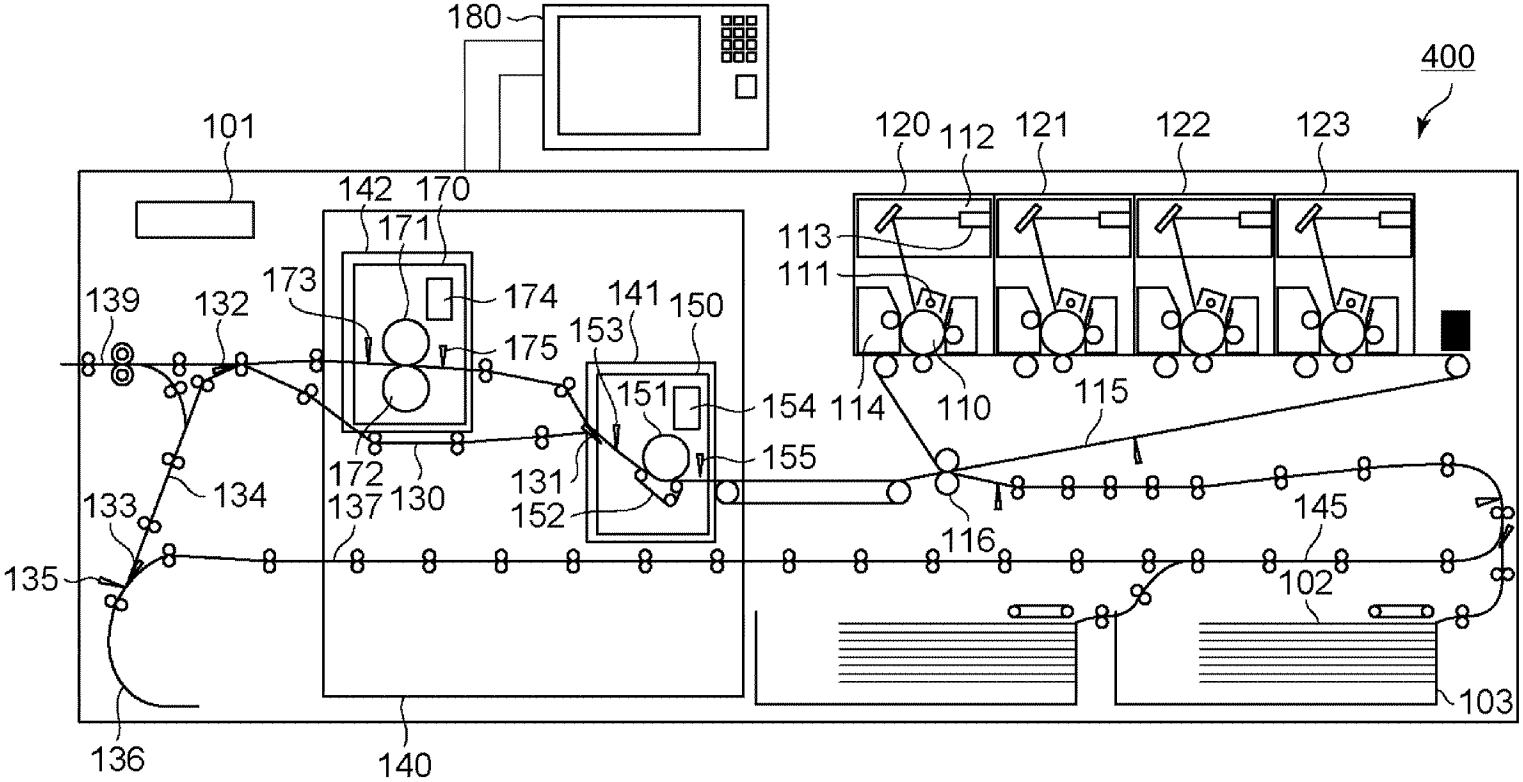

FIG. 24 is a sectional view of an example of an image forming apparatus.

Figure 25:
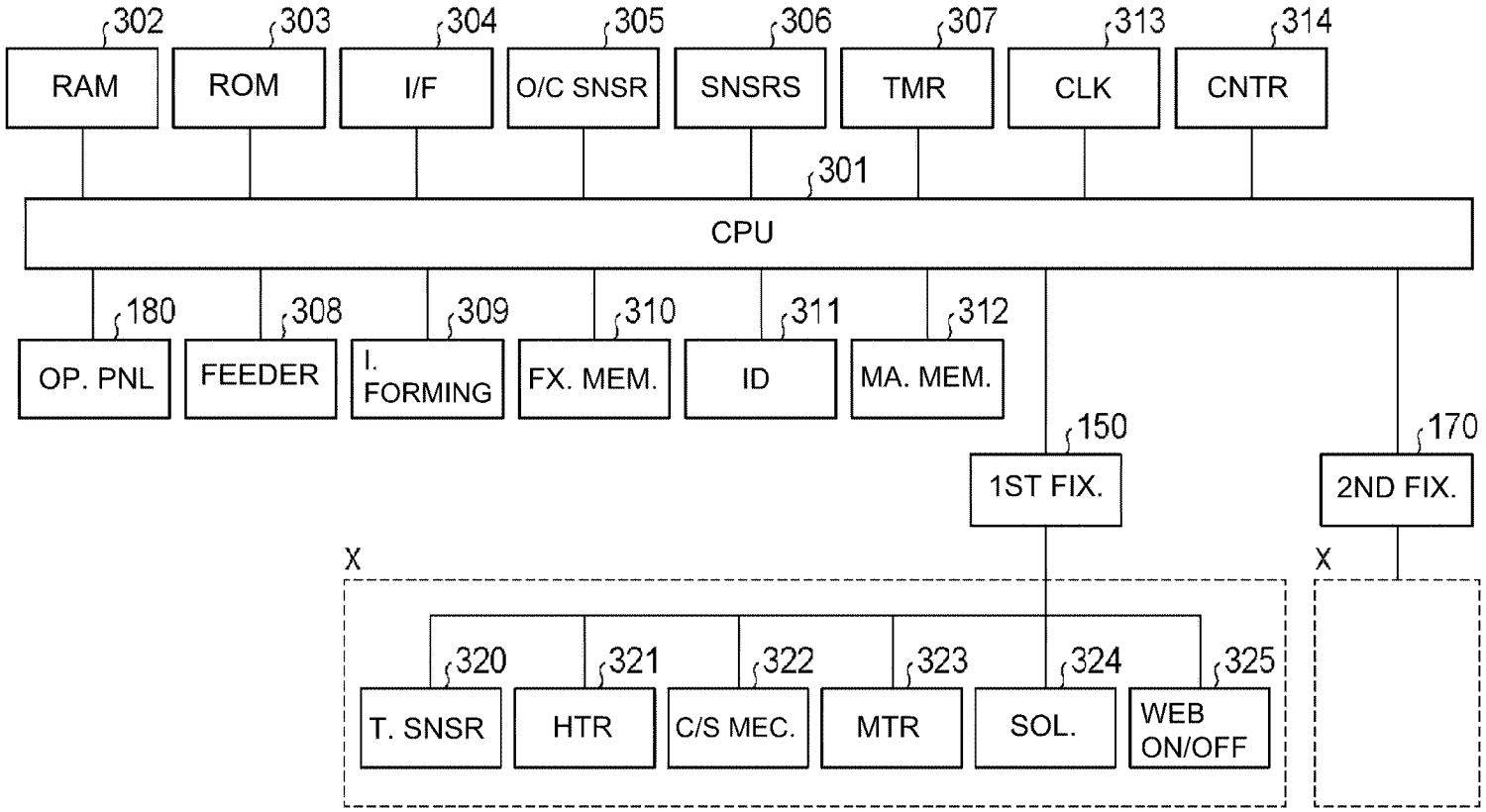

FIG. 25 is a block diagram of a control system.

Figure 26:
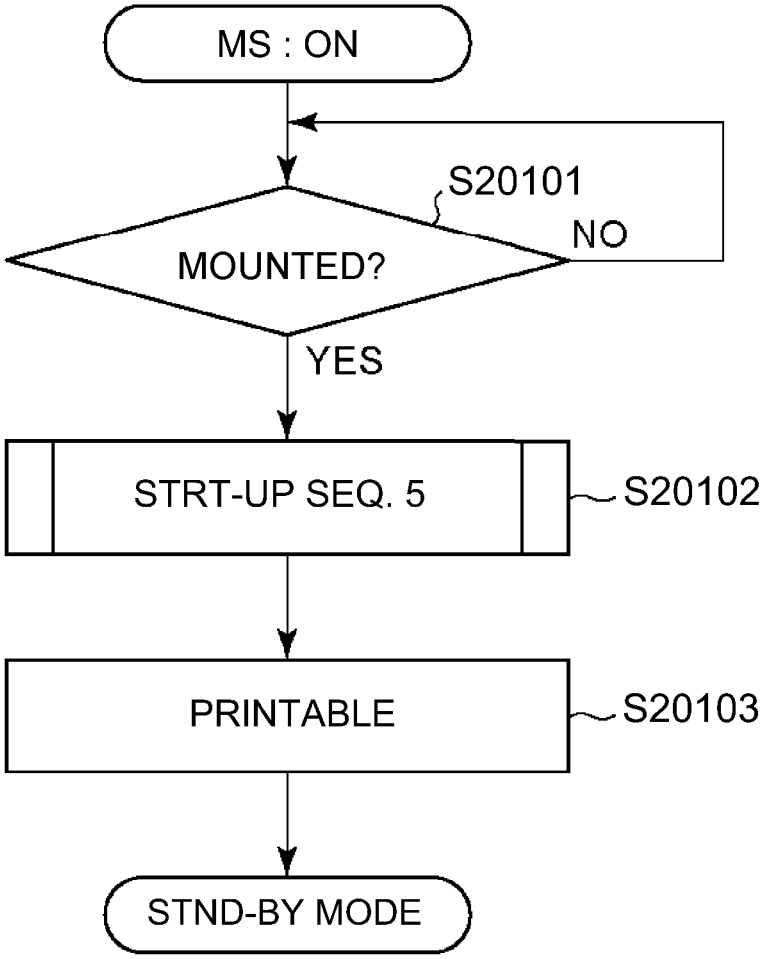

FIG. 26 is a flow chart showing the operations from the actuation of a main switch to a stand-by mode.

Figure 27:
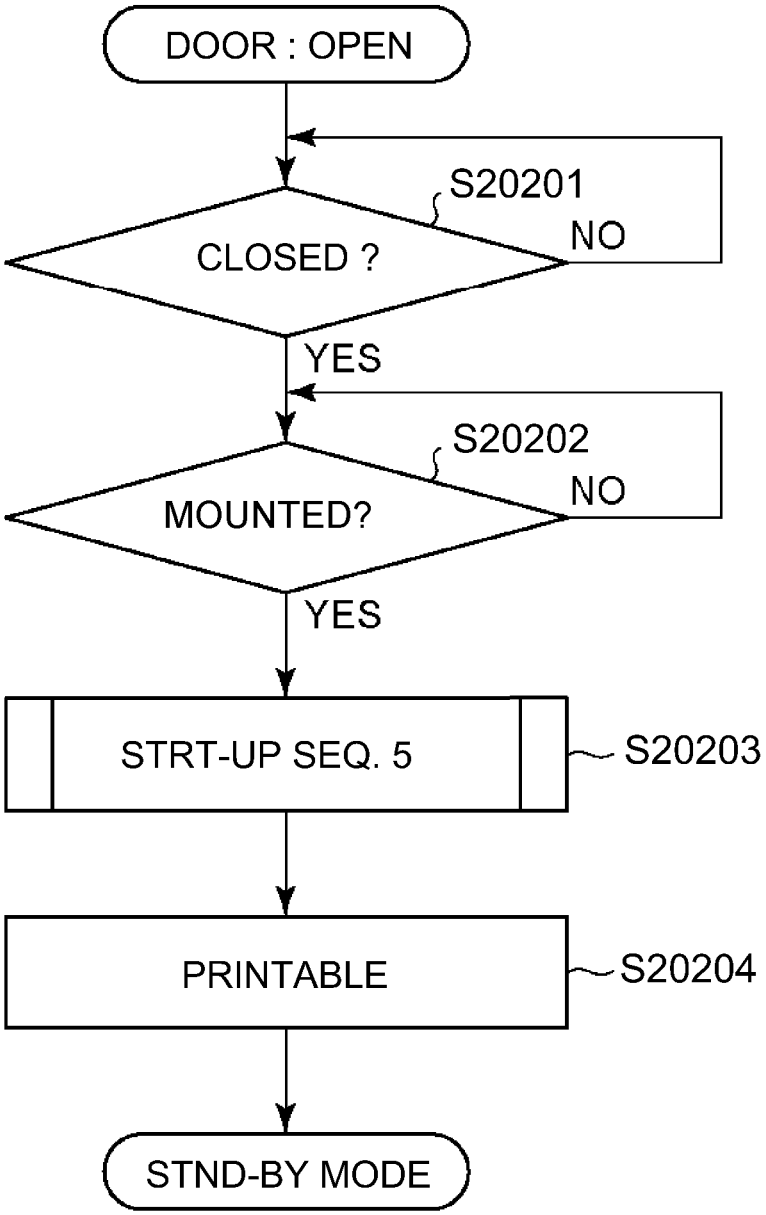

FIG. 27 is a flow chart showing the operations from the state in which a front door is open to the stand-by mode.

Figure 28:
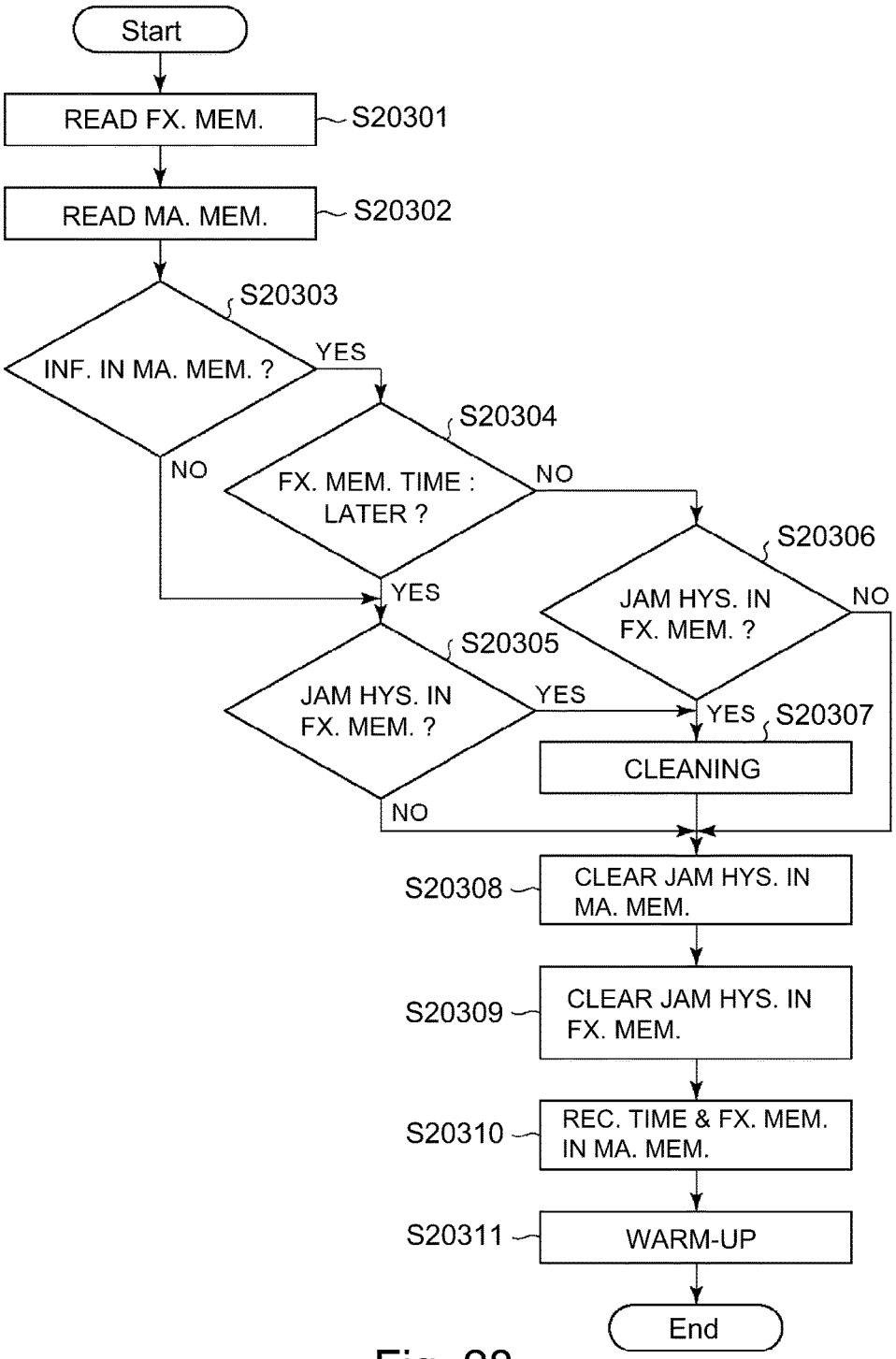

FIG. 28 is a flow chart of the start-up sequential operations 5.

Figure 29:
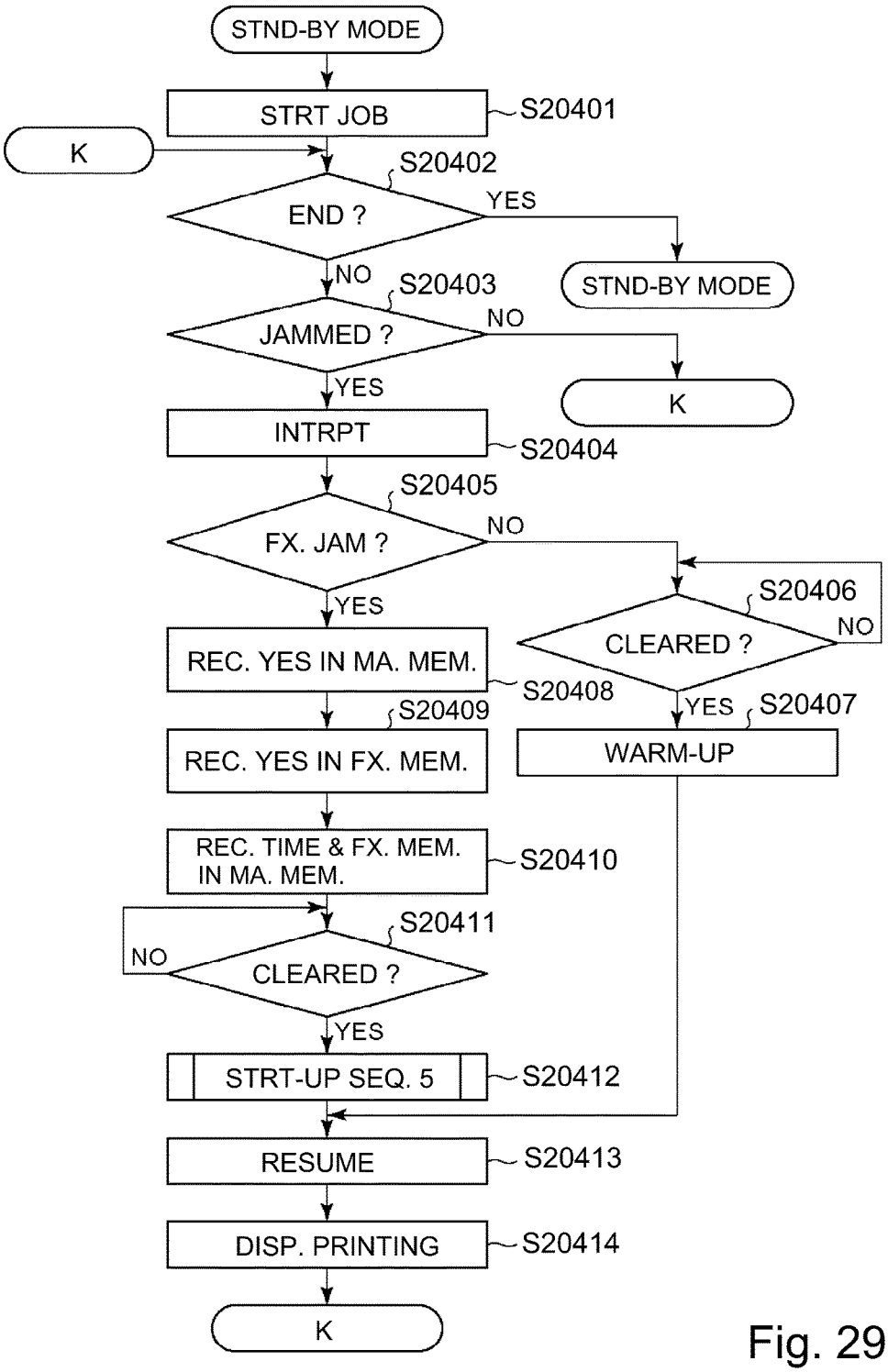

FIG. 29 is a flow chart of the operations at the time when sheet jamming occurs in the fixing device.

Part (a) of FIG. 30 shows an example of the information stored in the main assembly memory, part (b) shows an example of the information stored in the memory of the fixing device, and part (c) shows an example of the information stored in the memory of the fixing device.

Part (a) of FIG. 31 shows an example of the information stored in the main assembly memory, and part (b) shows an example of the information stored in the memory of the fixing device.

Figure 32:
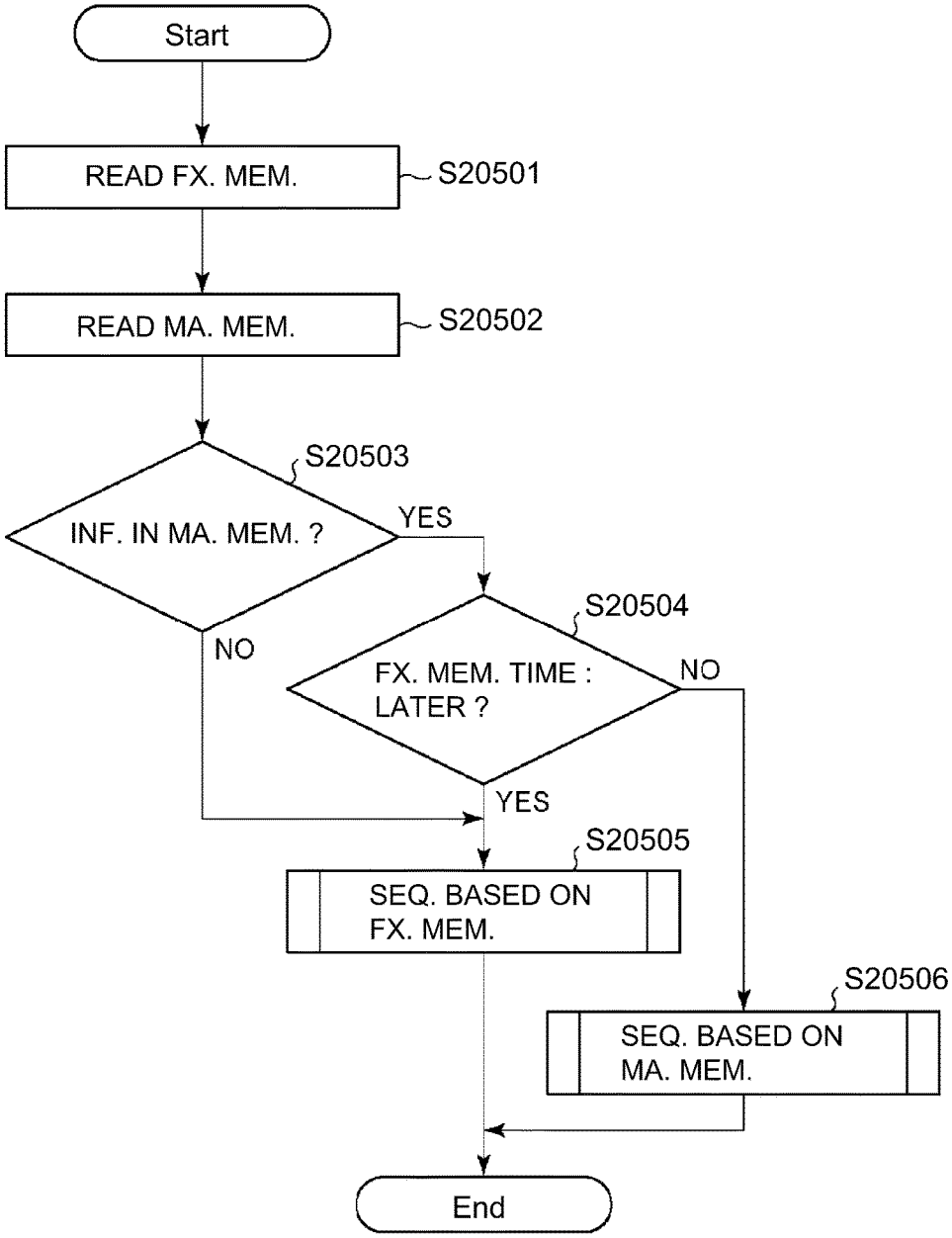

FIG. 32 is a flow chart of the start-up sequential operations.

Figure 33:
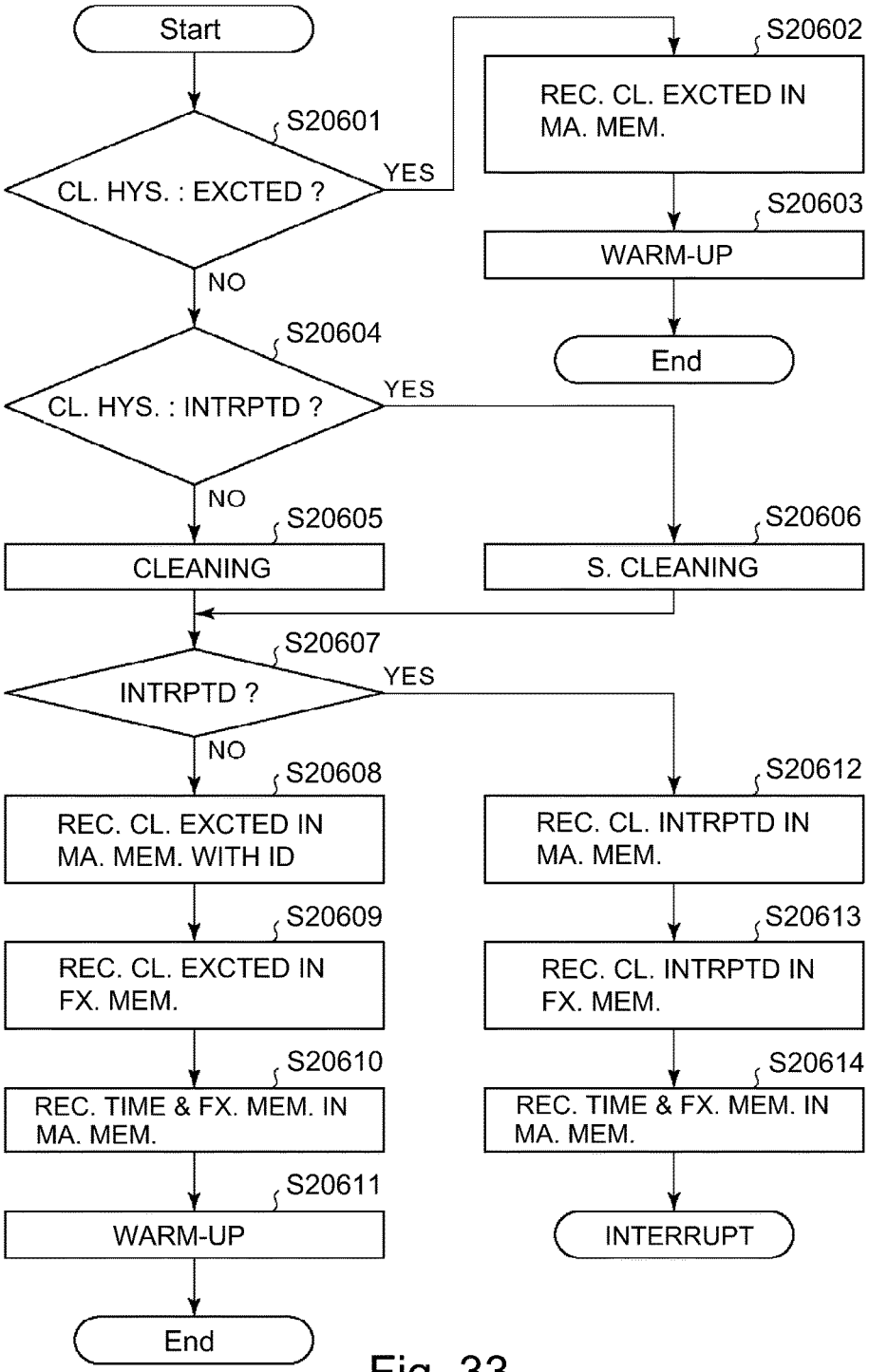

FIG. 33 is a flow chart of the sequential operations based on the information stored in the memory of the fixing device.

Figure 34:
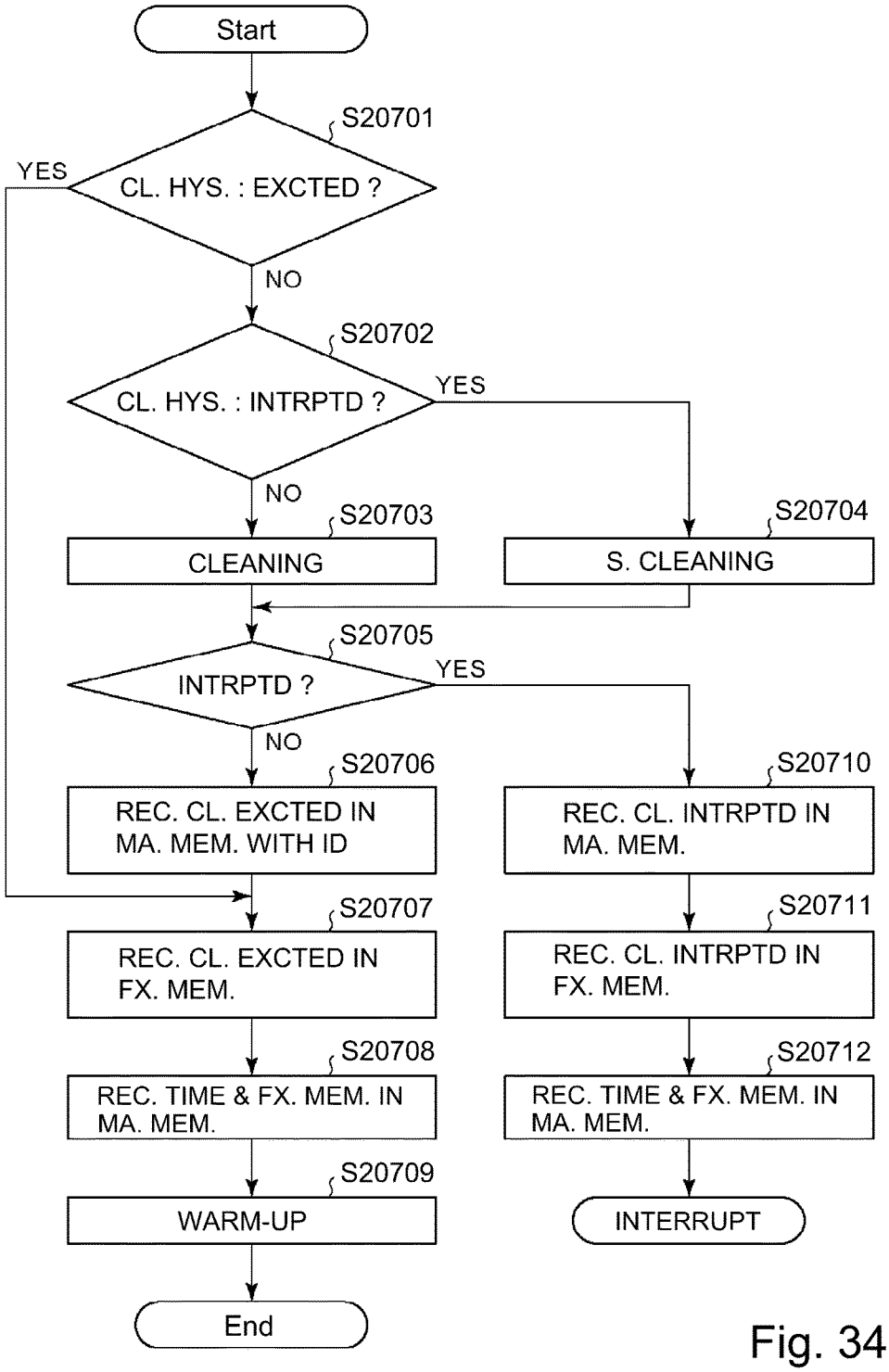

FIG. 34 is a flow chart of the sequential operations based on the information stored in the main assembly memory.

Figure 35:
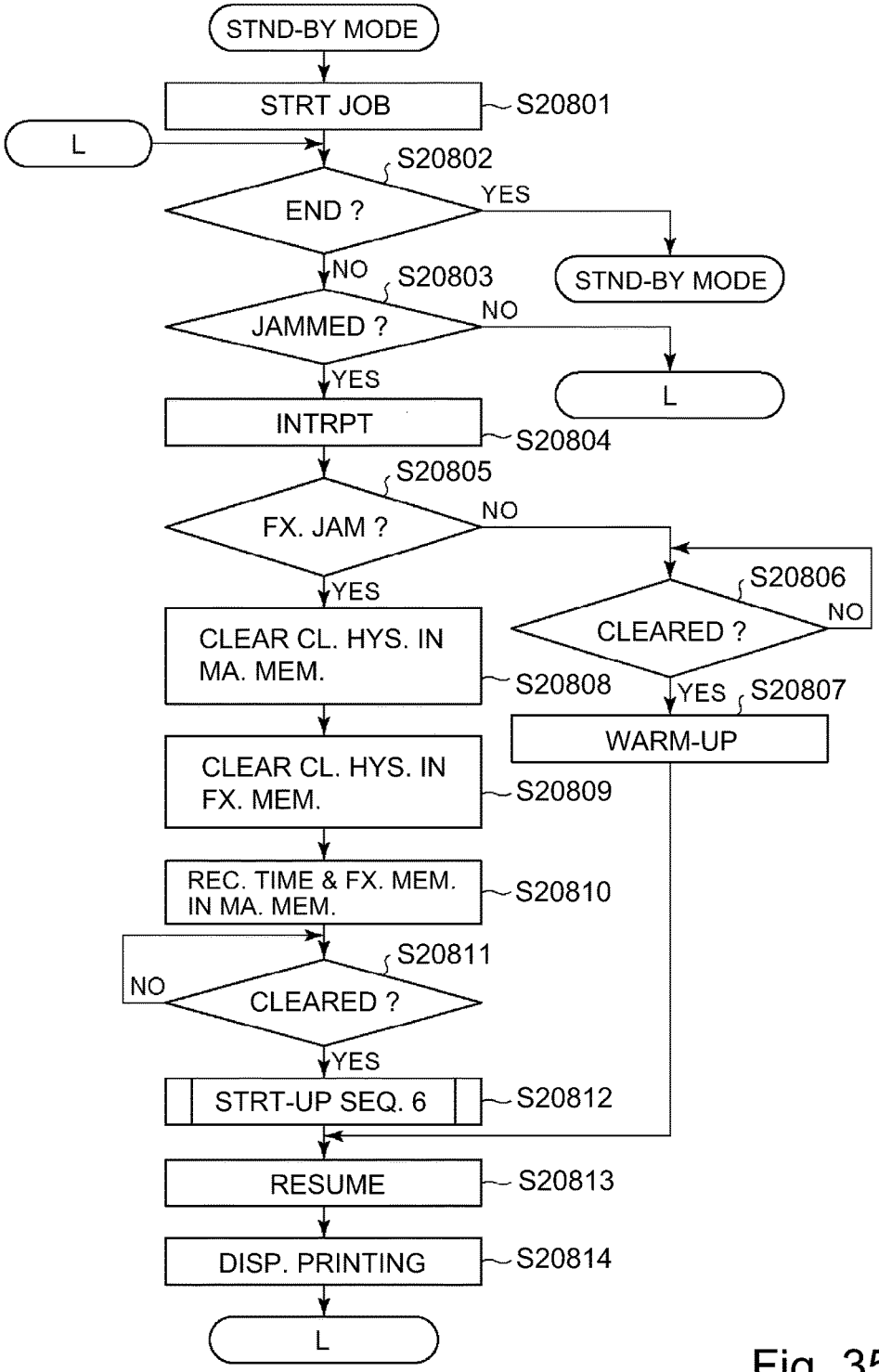

FIG. 35 is a flow chart of the operations at the time when sheet jamming occurs in the fixing device.

Figure 36:
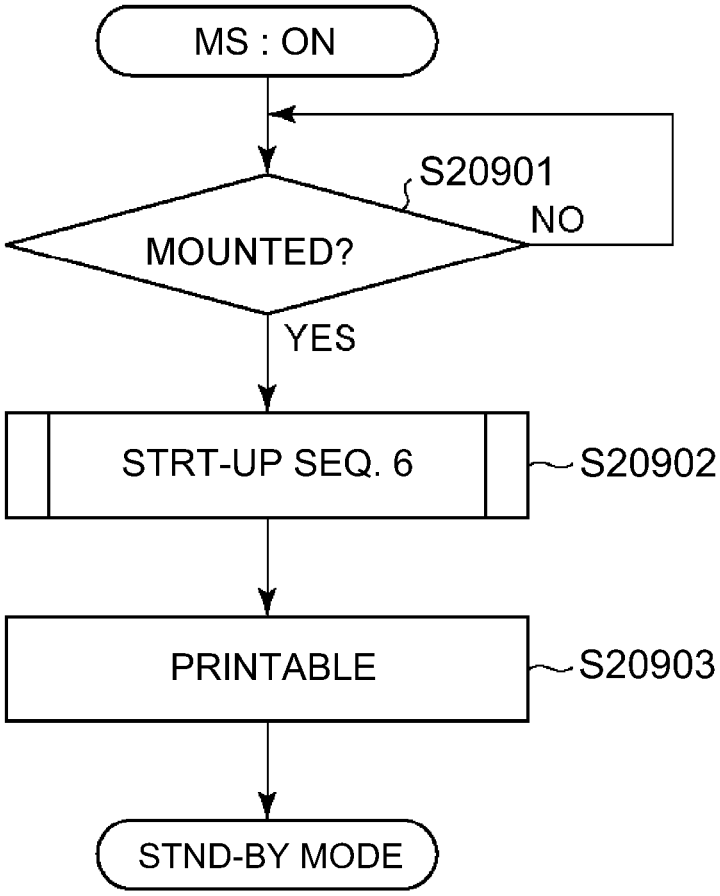

FIG. 36 is a flow chart showing the operations from the actuation of a main switch to a stand-by mode.

Figure 37:
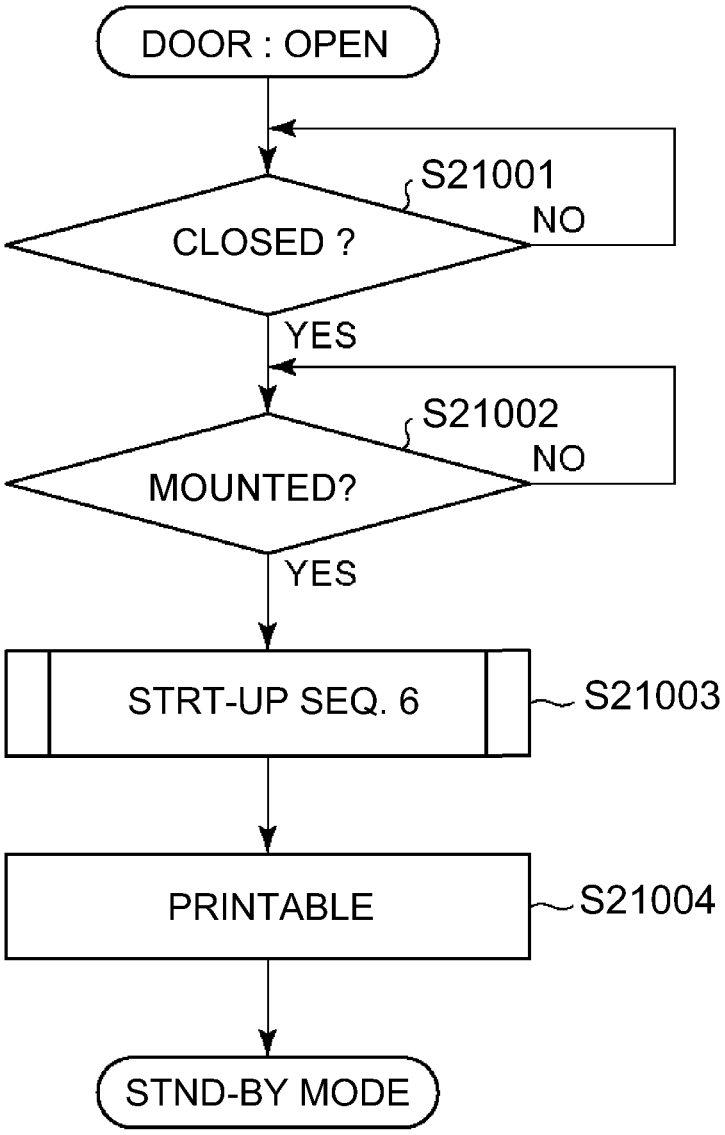

FIG. 37 is a flow chart showing the operations from the state in which a front door is open to the stand-by mode.

Figure 38:
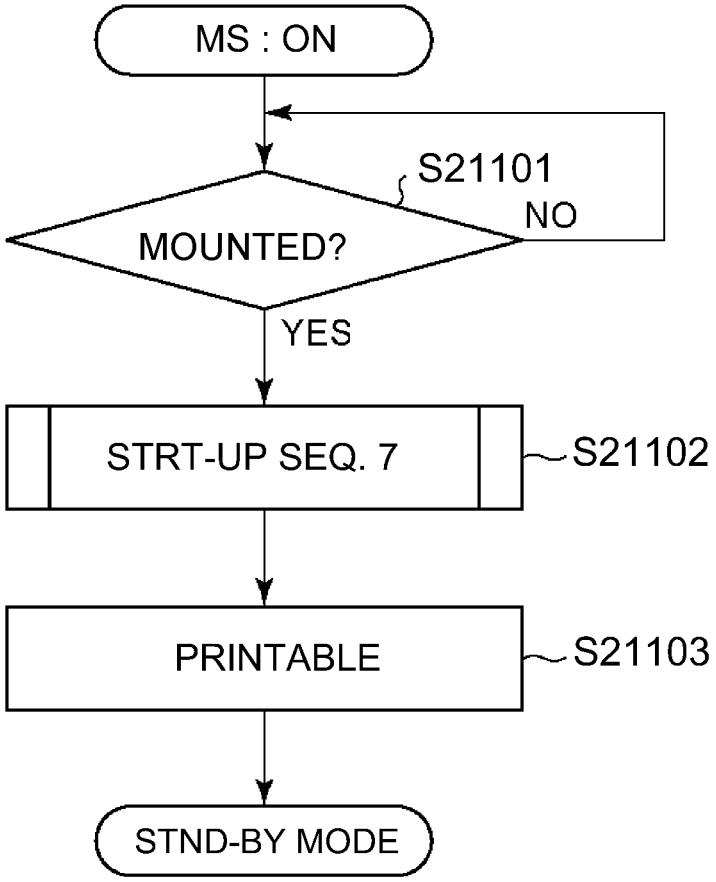

FIG. 38 is a flow chart showing the operations from the actuation of a main switch to a stand-by mode.

Figure 39:
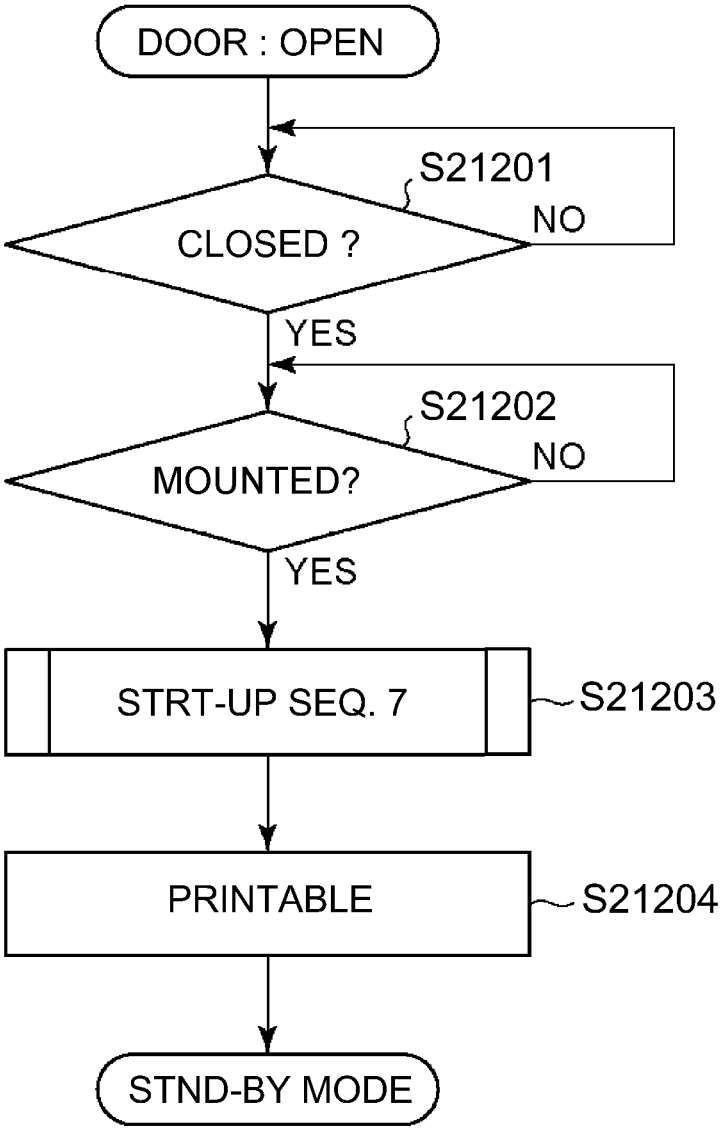

FIG. 39 is a flow chart showing the operations from the state in which a front door is open to the stand-by mode.

Figure 40:
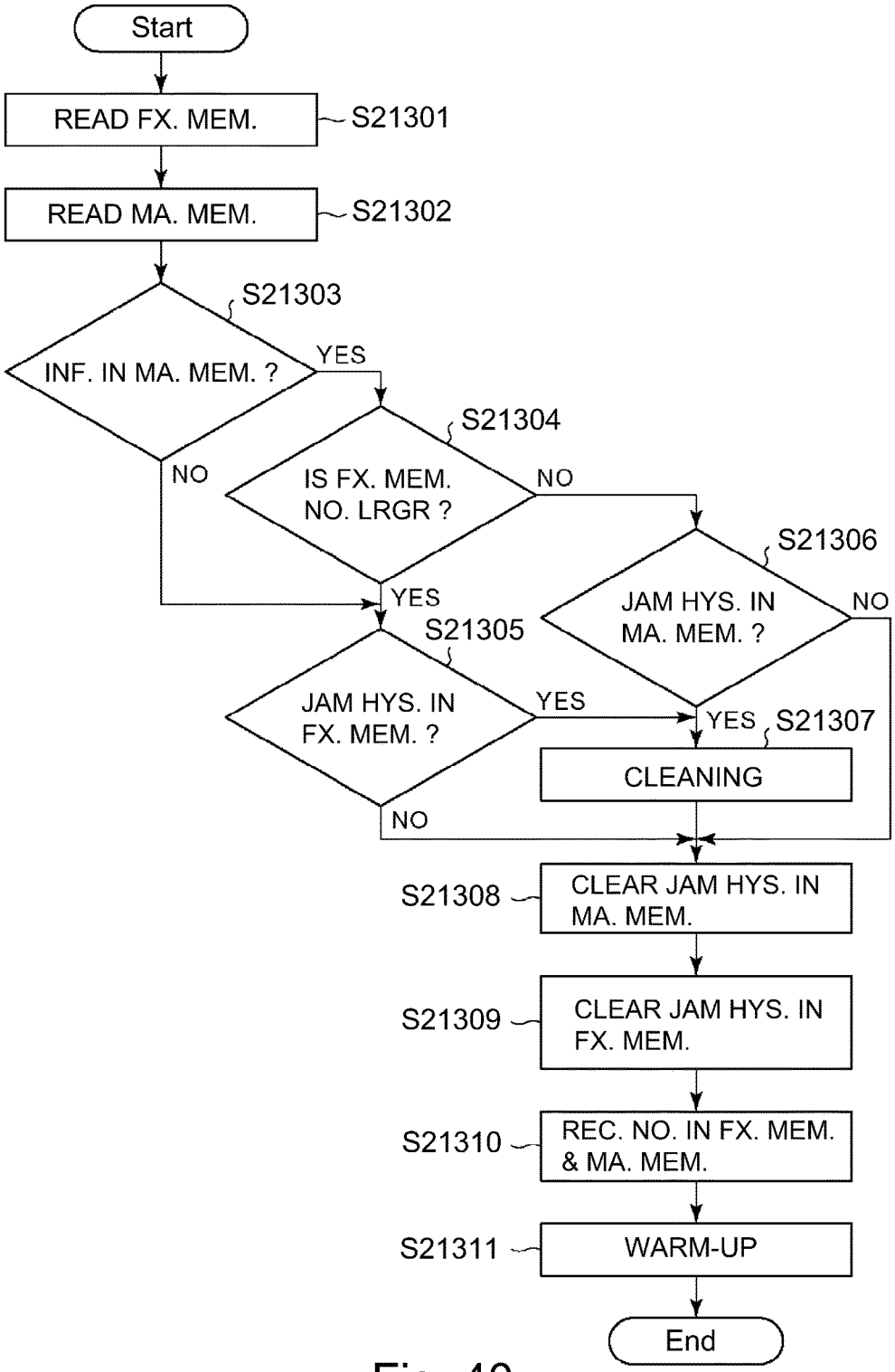

FIG. 40 is a flow chart of the start-up sequential operations.

Figure 41:
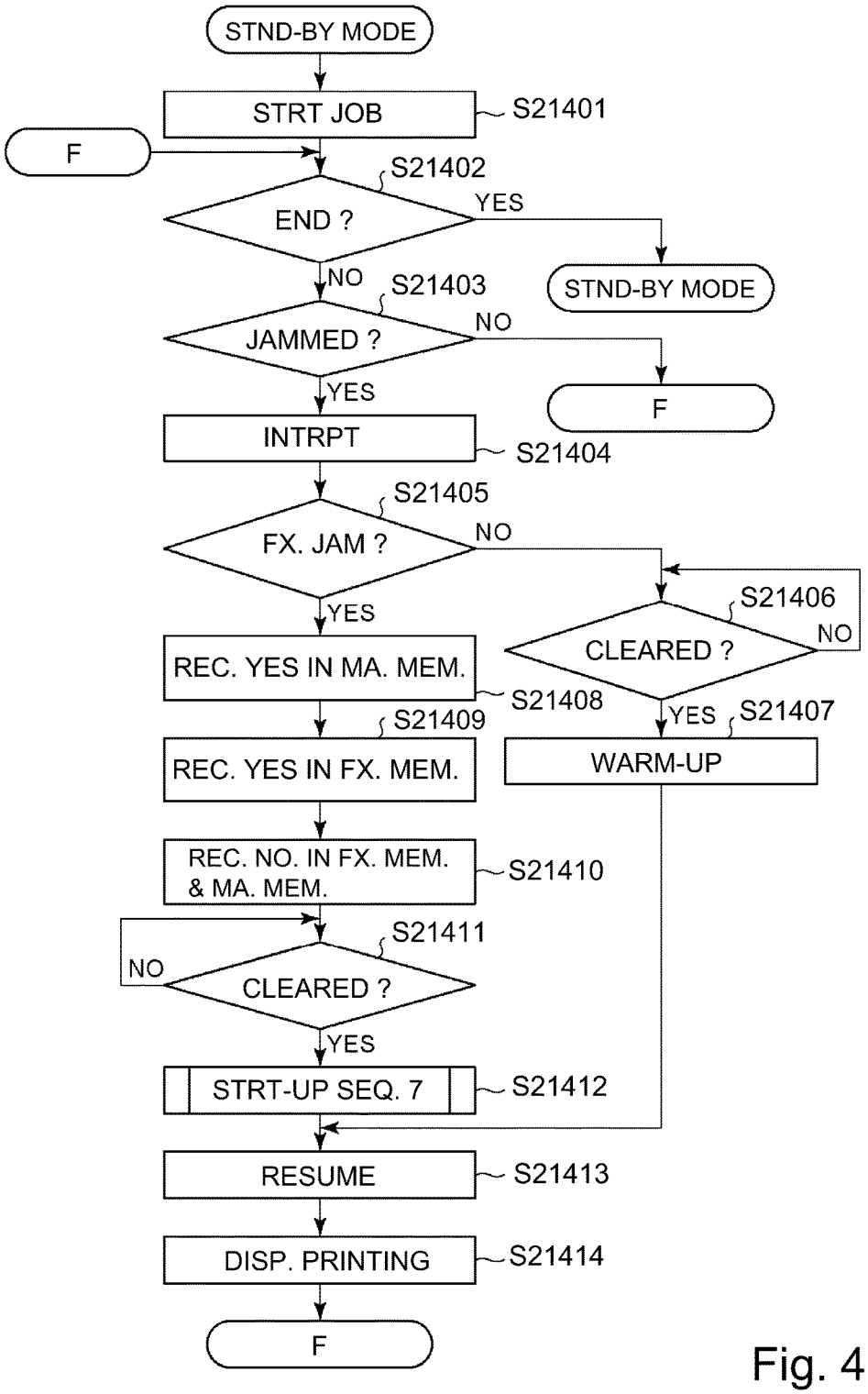

FIG. 41 is a flow chart of the operations at the time when sheet jamming occurs in the fixing device.

Figure 42:
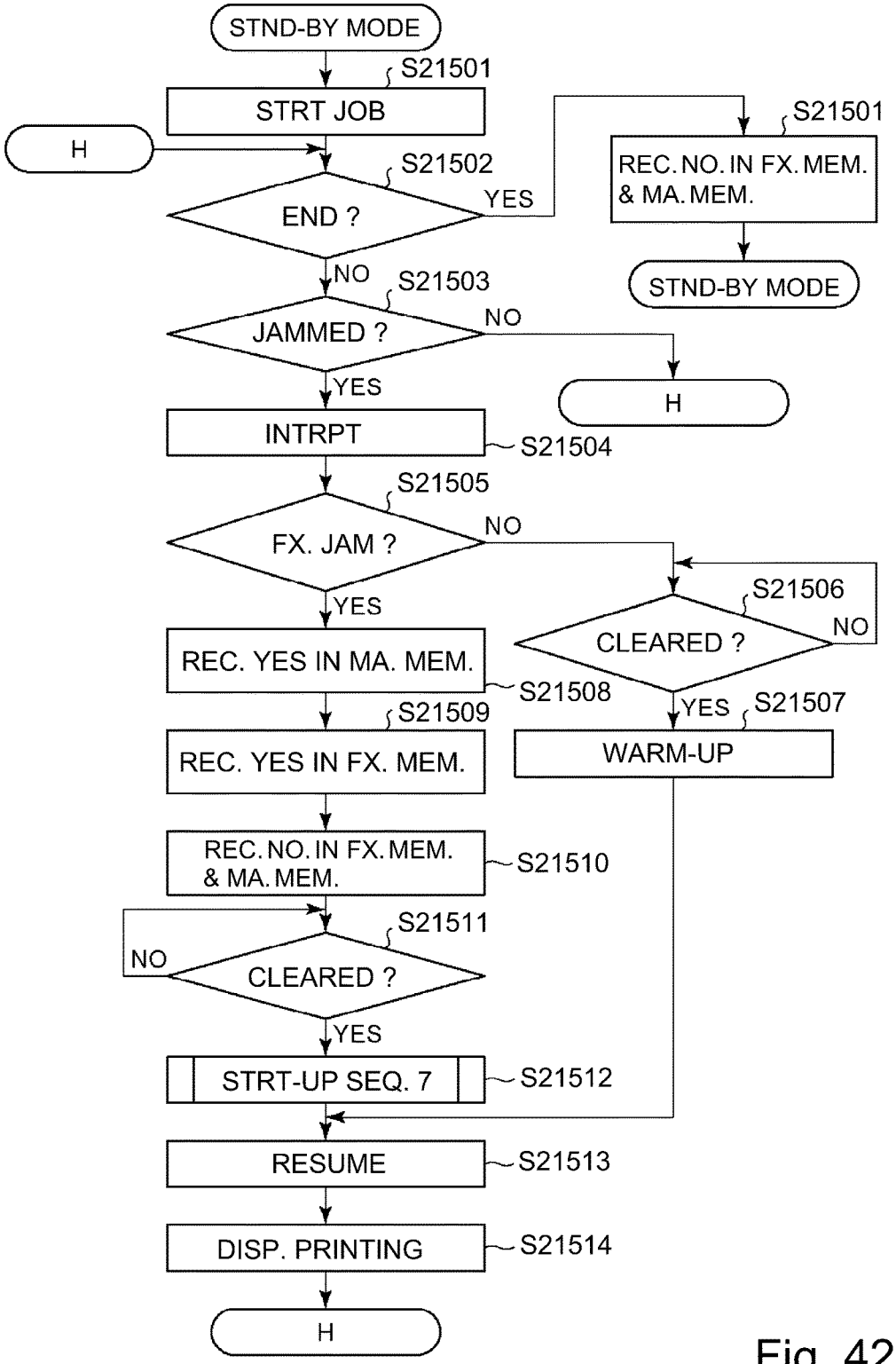

FIG. 42 is a flow chart of the operations at the time when sheet jamming occurs in the fixing device.

DESCRIPTION OF THE EMBODIMENTS

The preferred embodiments of the present invention will be described in conjunction with the accompanying drawings. The structures of the embodiments are examples, to which the present invention is not limited.

[Embodiment 1]

(General Arrangement of Image Forming Apparatus)

Figure 1:
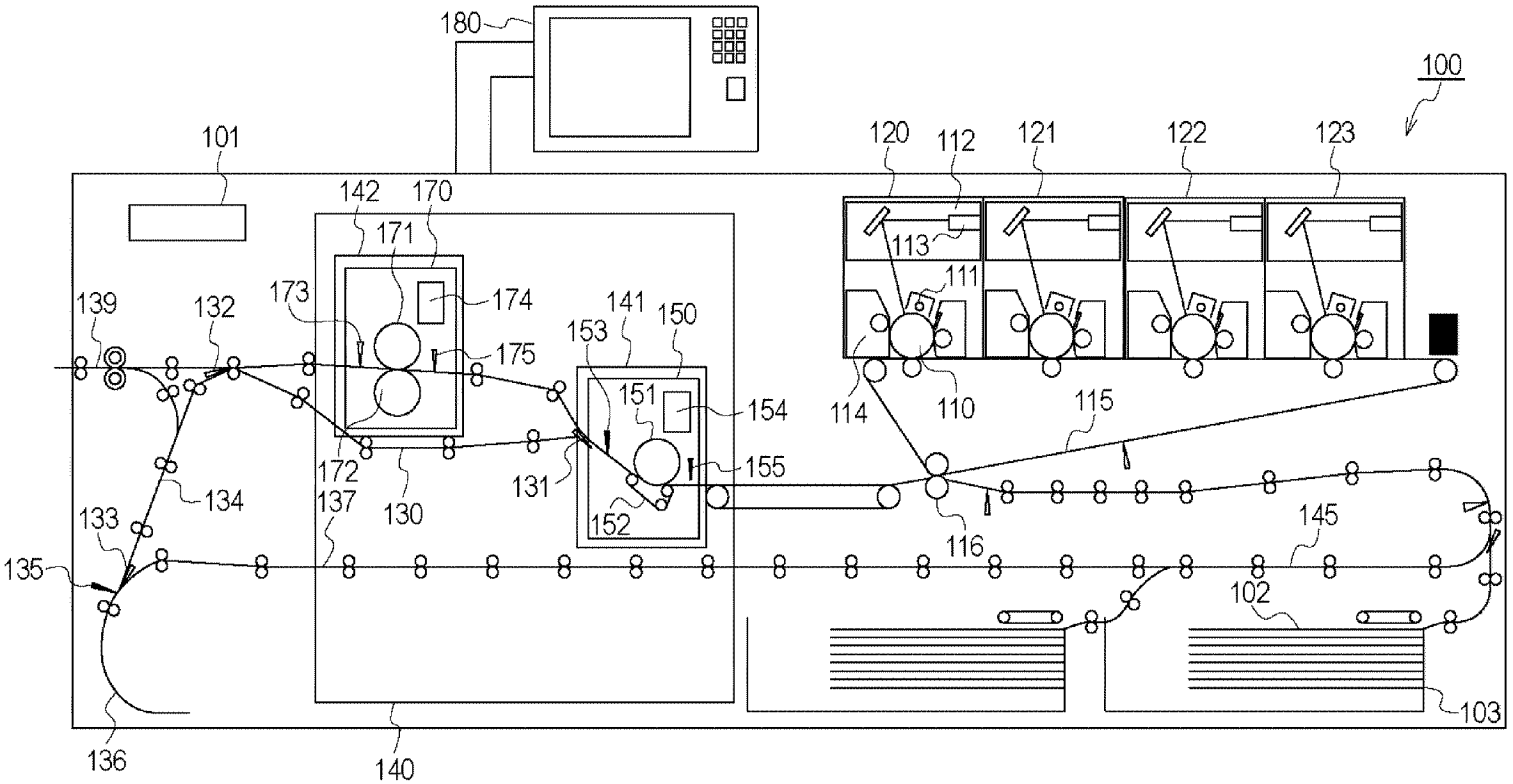
FIG. 1 is a sectional view of an example of an image forming apparatus.

FIG. 1 is a sectional view of an example of an image forming apparatus.

The general arrangement of the image forming apparatus 100 will be described.

The image forming apparatus 100 feeds a recording material 102 from a recording material accommodating portion 103 into an image forming station 309 (FIG. 2) to form a toner image on the recording material 102. The details of the image forming station 309 will be described hereinafter.

Thereafter, the image forming apparatus 100 feeds the recording material 102 carrying the formed toner image to a fixing portion (first fixing device 150 and second fixing device 170), where the toner image is fixed on the recording material 102 by heat and pressure. The details of the fixing portion will be described hereinafter.

In the case of a one-side printing operation, the recording material 102 having the fixed image is guided into the discharging path 139 by a flapper 132 and is discharged to an outside of the image forming apparatus 100.

On the other hand, in the case of the both side printing operation, the image forming apparatus 100 reverses the recording material 102 already having the image on one side and refeeds it into the image forming station 309. More particularly, the flapper 132 guides the recording material 102 having departed the fixing device into a feeding path 134 and then into a reversing portion 136. When a reversion sensor 135 detects a trailing edge of the recording material 102, a flapper 133 switch is the recording material feeding direction to a feeding path 137. The image forming apparatus 100 refeeds the reversed recording material 102 into the image forming station 309 and the fixing portion through the feeding path 137.

The recording material 102 having been subjected to the image forming operations and the respective sides is fed by the flapper 132 into the discharging path 139, and then is discharged to the outside of the image forming apparatus 100.

The flapper 132 is a switching member for switching the feeding of the recording material 102 having passed through the image forming station 309 and the fixing portion between the feeding path 134 and the outside of the image forming apparatus 100.

The recording material 102 may be paper, OHP sheet or the like and which the image is to be formed by the image forming apparatus 100.

An operating portion 180 functioning as a notifying portion and/or a selector is provided with a display screen and a selection key. The operating portion 180 displays the status of the image forming apparatus 100 on the display screen, and receives the instructions from the operator by the selection keys.

The main switch 101 is a starting switch for actuating the image forming apparatus 100.

The front door 140 as an opening and closing portion is provided for the opening of the main assembly of the image forming apparatus 100 for mounting a fixing device (first fixing device 150, second fixing device 170) to a mounting portion (first mounting portion 141, second mounting portion 142).

The image forming apparatus 100 is provided with an opening and closing sensor (optical sensor) 305 (FIG. 2) as a sensor for sensing a closed state of the front door 140. The opening and closing sensor 305 and the CPU301 (FIG. 2) function as an opening and closing detecting portion. The front door 140 is provided with a projection (unshown), which is inserted into a receiving portion (unshown) of the main assembly of the image forming apparatus 100 by the closing of the front door 140. The CPU301 detects the closing of the front door 140 on the basis of a signal produced by the opening and closing sensor 305 upon the insertion of the projection into the receiving portion. On the other hand, when no output signal is produced by the opening and closing sensor 305, the CPU301 detects that the front door 140 is open. In an alternative structure, the CPU301 detects the opening of the front door 140 on the basis of the signal produced by the opening and closing sensor 305 upon the opening of the front door 140, and the CPU301 the fixed that the front door 140 is closed when the signal from the sensor 305 is not detected.

(Structure of Control System)

Figure 2:
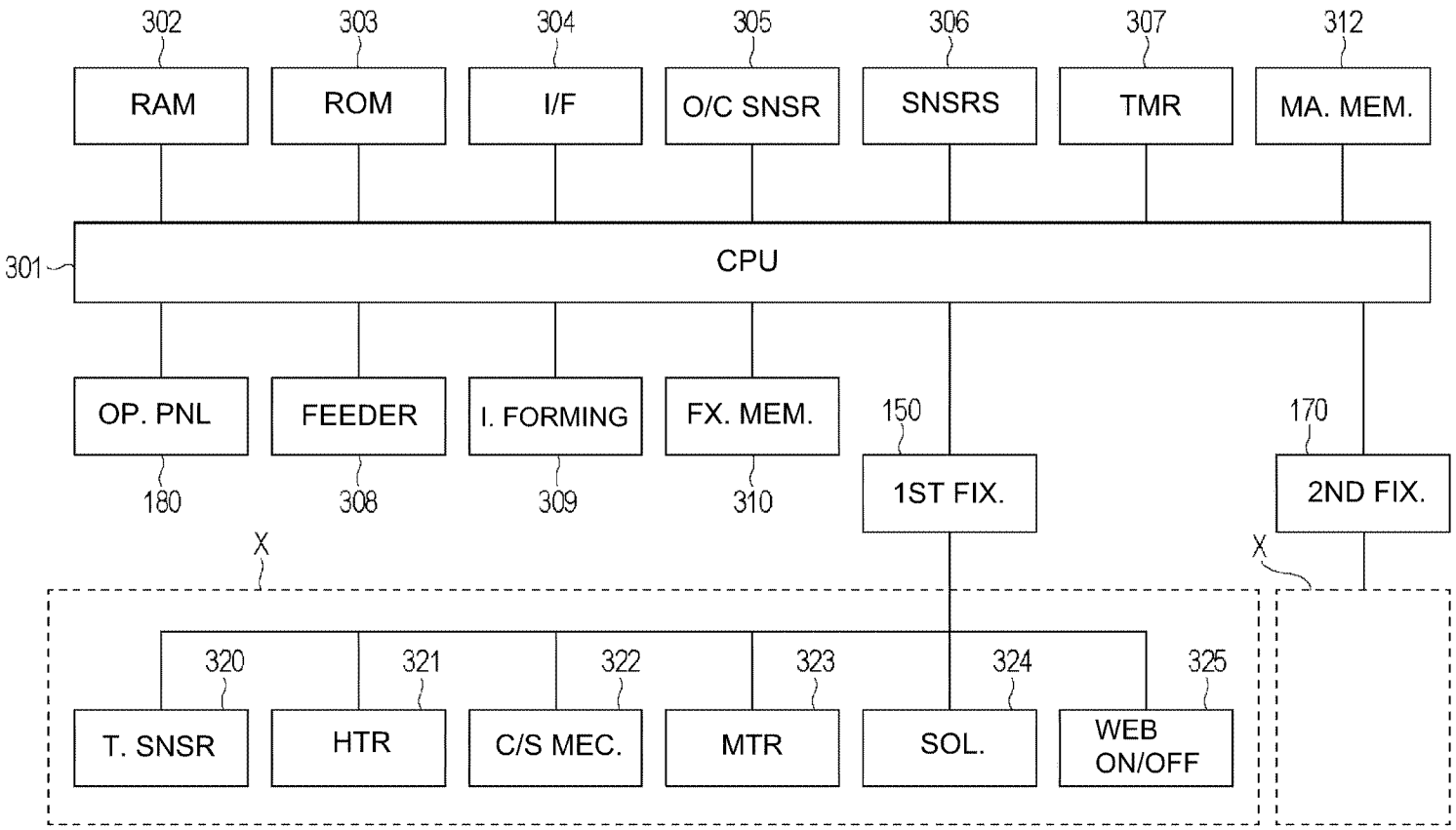
FIG. 2 is a block diagram of a control system.

FIG. 2 is a block diagram of a control system.

The image forming apparatus 100 (FIG. 1) is provided with CPU301, RAM 302, ROM 303 for controlling the operation of the image forming apparatus 100.

The CPU301 functioning as a controller carries out a basic control of the image forming apparatus 100 by executing control programs stored in the ROM 303. The operation of the flow chart which will be described hereinafter is carried out by the CPU301 using the control programs stored in the ROM 303. The CPU301 uses the RAM 302 as a work area for executing the processing of the control program.

The CPU301 is electrically connected with the RAM 302 and the ROM 303, and various mechanisms to be controlled.

An external I/F portion 304 is a communication circuit for communication with an external device connected through network (LAN and/or WAN). The external device may include a PC or another image forming apparatus or the like.

The CPU301 is connected with the opening and closing sensor 305 to detect whether or not the front door 140 is closed.

The sensor group 306 including sensors 153, 155, 173 and 175 shown in FIG. 1 is disposed along the feeding path, by which the CPU301 detects the presence, absence and passing of the recording material.

In addition, the CPU301 is connected with the operating portion 180. The CPU301 receives the instructions of switching of the display content on the display screen and other operations, given by the operator at the selection keys of the operating portion 180. The CPU301 displays, on the display screen of the operating portion 180, the status of operation of the image forming apparatus 100, an operation mode selected by the selection key, and so on.

The CPU301 is connected with a timer 307. The timer 307 counts the time. As will be described hereinafter, this is used for the measurement of the time for detection of jamming or for measuring the cleaning time.

The CPU301 is connected with a main assembly memory 312. The main assembly memory 312 is rewritable non-volatile memory and may be integral with the RAM 302.

The CPU301 is connected with a feeding portion 308 to control feeding of the recording material 102. The feeding portion 308 includes a supply portion for supplying the recording material 102 from the recording material accommodating portion 103 to the feeding path, and flappers (flappers 131, 132, 133 shown in FIG. 1) for the feeding paths.

The CPU301 is connected with the image forming station 309 which will be described hereinafter to control the image forming station 309.

The fixing device memory 310 includes the memory 154 provided on the first fixing device 150 mounted in the image forming apparatus 100 and the memory 174 provided on the second fixing device 170 mounted in the image forming apparatus 100. The CPU301 is connected with the memories 154, 174 of the first fixing device 150 and the second fixing device 170 mounted in the image forming apparatus 100 to write in and read out of the memories 154, 174.

The CPU301 is connected with a mechanism group X of the first fixing device 150 mounted in the image forming apparatus 100 to effect a temperature adjustment control and cleaning control for the first fixing device 150. The mechanism group X includes a temperature sensor 320, a heater 321, a moving mechanism 322, a motor 323, a solenoid 324 and a web mounting and demounting mechanism 325.

The temperature sensor 320 includes a plurality of temperature sensors provided in the first fixing device 150, including a thermister 162 (FIG. 3), a thermister (unshown) for the pressing belt 152.

The heater 321 includes a plurality of heater provided in the first fixing device 150, including a halogen heater 161 (FIG. 3), a halogen heater (unshown) provided in the heating roller 163.

The CPU301 is connected with a mechanism group X of the second fixing device 170 mounted in the image forming apparatus 100 to effect temperature adjustment control and cleaning control for the second fixing device 170. The mechanism group X for the second fixing device 170 is substantially the same as the mechanism group X of the first fixing device 150, and therefore, the detailed description thereof is omitted by applying the same reference numerals to the corresponding elements. (in the description of the mechanism group X for the first fixing device 150, the first fixing device 150, the pressing belt 152, the heating roller 163 corresponds to the second fixing device 170, the pressing roller 172, the pressing roller 172, respectively).

In this embodiment, the mechanisms are controlled by the CPU301. Alternatively, however, the use can be made with the CPU circuit portions for controlling the respective mechanisms and a main CPU circuit portion connected with the respective CPU circuit portions to effect the overall control.

(Image Forming Station)

The image forming apparatus 100 comprises stations 120, 121, 122 and 123 as the image forming station 309 (FIG. 2), an intermediary transfer belt 115 as an intermediary transfer member, and a transfer roller 116 as a transfer portion.

The stations 120, 121, 122, 123 form yellow, magenta, cyan and black toner images, respectively, and transfer the toner images onto the intermediary transfer belt 115.

The structure of the station 120 will be described. A photosensitive drum 110 as the image bearing member is rotatable in the counterclockwise the direction in FIG. 1. A primary charger 111 as a charge portion uniformly charges the surface of the photosensitive drum 110. A laser unit 112 as an exposed portion includes a light source 113 for producing a laser beam to form an electrostatic latent image on the photosensitive drum 110 in accordance with an original image. A developing device 114 as a developing portion develops the electrostatic latent image formed on the photosensitive drum 110 using toner into a toner image. The structures of the stations 121, 122, 123 are the same as that of the station 120, and therefore, the description is omitted for the sake of simplicity.

The toner images formed by the stations 120, 121, 122, 123 are transferred onto the intermediary transfer belt 115. The transfer roller 116 transfers the toner images superimposed on the intermediary transfer belt 115 onto the recording material 102 fed from the recording material accommodating portion 103.

(Fixing Portion)

(Tandem Fixing)

The first fixing device 150 and the second fixing device 170 as the fixing portion fix the toner image transferred onto the recording material 102 By applying heat and pressure to the recording material 102.

The second fixing device 170 is disposed downstream of the first fixing device 150 with respect to the feeding direction of the recording material 102. The second fixing device 170 functions to provide the toner image fixed on the recording material 102 by the first fixing device 150 with glossiness and/or to supplement the heat quantity for a large basis weight recording material (thick sheet, for example) which requires a large amount of heat for the fixing operation.

On the other hand, in the case that the heat by the first fixing device 150 is enough to fix the image, it is unnecessary to use the second fixing device 170, and therefore, the recording material 102 is fed into the feeding path 130 bypassing the second fixing device 170, for the purpose of saving the energy consumption. For example, this occurs in the case that the recording material 102 is plain paper or thin sheet, and high glossiness is not desired. As to whether to feed the recording material 102 into the second fixing device 170 or to feed the recording material 102 bypassing the second fixing device 170 (bypass route), the CPU301 controls it by switching the flapper 131.

(Structure of Fixing Device)

The first fixing device 150 and the second fixing device 170 are detachably mountable to the first mounting portion 141 and the second mounting portion 142 (mounting portion) of the image forming apparatus 100, respectively. The first fixing device 150 and a second fixing device 170 can be replaced with the fixing devices having the following structures, respectively.

The first fixing device 150 is provided with a memory 154 as a storing portion. The second fixing device 170 is provided with a memory 174 as a storing portion. The details will be described hereinafter.

The first fixing device 150 is provided with sensors 153, 155 as a jam detecting portion, and the second fixing device 170 is provided with sensors 173, 175 as a jam detecting portion. The details will be described hereinafter.

Figure 3:
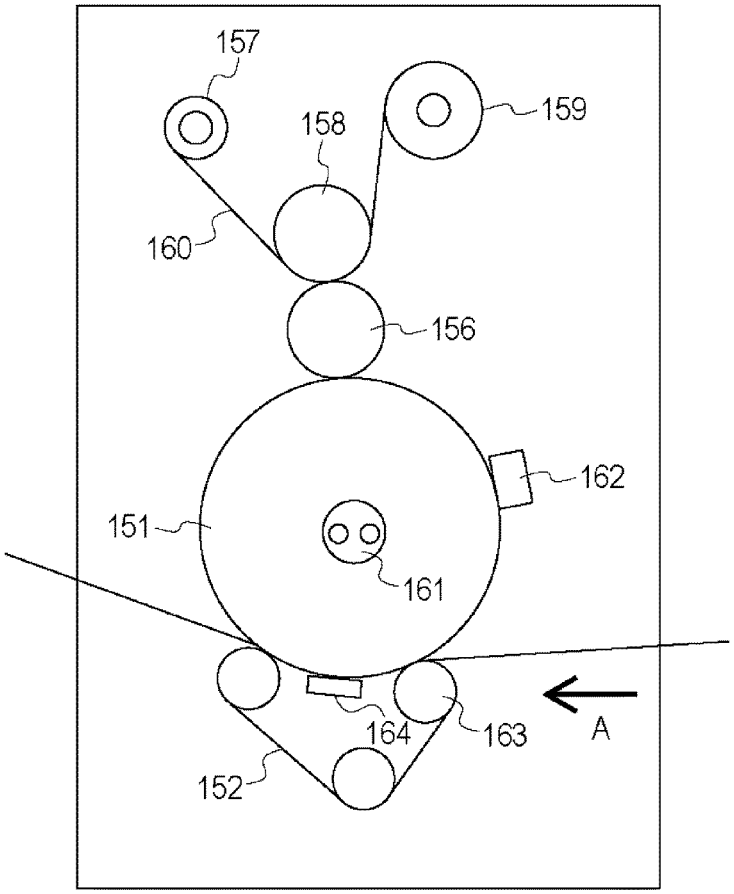
FIG. 3 is a sectional view of an example of a fixing portion.

FIG. 3 is a sectional view of an example of a fixing portion. Referring to FIG. 3, the first fixing device 150 will be described in detail.

The first fixing device 150 comprises a fixing roller 151 (fixing member) and a pressing belt 152 (pressing member), which are cooperative with each other to form a nip for fixing the toner image on the recording material 102.

The fixing roller 151 is a hollow roller containing therein a halogen heater 161 as a heating source. The thermister 162 as a temperature detecting portion is a sensor for sensing a temperature of the fixing roller 151. The CPU301 ON/OFF-controls the halogen heater 161 on the basis of the information of the temperature detected by the thermister 162. This is done to adjust and maintain the temperature of the fixing roller 151 at a predetermined temperature. The predetermined temperature includes a tolerance.

The pressing belt 152 is an endless belt stretched around the three rollers. To the inner surface of the pressing belt 152, a pressing pad 164 is contacted to urge the pressing belt 152 toward the fixing roller 151. The heating roller 163 which is one of the three rollers is a hollow roller, and contains therein a halogen heater (unshown) as the heating source. Similarly to the fixing roller 151, for the pressing belt 152, CPU301 controls the halogen heater (unshown) in the heating roller 163 on the basis of detected temperature information by the thermister (unshown) for sensing the temperature. As a result, the temperature of the pressing belt 152 is maintained as to a predetermined temperature.

The fixing roller 151 is rotated by a motor 323 (FIG. 2) as a driving source to feed the recording material 102 in the direction indicated by a arrow A in FIG. 3. The pressing belt 152 is rotated by the fixing roller 151.

The first fixing device 150 is provided with a moving mechanism 322 (FIG. 2) for moving the pressing belt 152 to provide a contact state in which the fixing roller 151 and the pressing belt 152 contact with each other to form the nip and a spaced state in which they are spaced In this embodiment, the moving mechanism 322 moves, the pressing belt 152, but the fixing roller 151 in place of the pressing belt 152 may be moved, or both of them may be moved.

On the other hand, the second fixing device 170 includes the pressing roller 172, not a pressing belt, as the pressing member, and the fixing roller 171 (fixing member) and the pressing roller 172 (pressing member) form a nip for fixing the toner image on the recording material 102. The pressing roller 172 is a hollow roller, and contains therein a halogen heater (unshown) as a heating source. The pressing roller 172 is provided with a thermister (unshown) as a temperature sensor. The CPU301 controls the thermister and the halogen heater (unshown), so that the temperature of the pressing roller 172 is maintained at a predetermined temperature.

The above-described structures of the second fixing device 170 are similar to those of the first fixing device 150, and therefore, the description of the 20 structures of the second fixing device 170 will be omitted for the sake of simplicity.

In the following description, the first fixing device 150 will be taken, and the description also applies to the second fixing device 170 unless otherwise stated. (the structures of the first fixing device 150 apply to the structures of the second fixing device 170).

In this embodiment, the structures of the pressing sides of the first fixing device 150 and the second fixing device 170 are different, but they may be the same. More particularly, the pressing side structures of the first fixing device 150 and the second fixing device 170 may use pressing belts or pressing rollers. In addition, the pressing side structure of the first fixing device 150 may use a pressing roller, and the structure of the pressing side of the second fixing device 170 may use a pressing belt.

(Structure of Web Cleaner)

A web cleaner for cleaning the fixing member will be described, taking the first fixing device 150 as an example. The description applies also to the second fixing device 170, and therefore, the description about the second fixing device 170 will be omitted for the sake of simplicity.

The web cleaner comprises a winding-up roller 157, an urging roller 158, a supplying roller 159, a web 160 and a collection roller 156, and the functions as a cleaning portion for cleaning the fixing roller 151.

The collection roller 156 (made of SUS, for example) as the collection rotatable member is rotated by the fixing roller 151 to collect the toner deposited on the surface of the fixing roller 151.

The web 160 is a cleaning web of nonwoven fabric. The supplying roller 159 stacking unused part of the web 160 is driven by the winding-up roller 157 to supply the web 160 out. The urging roller 158 is rotatable and urges the web 160 to the collection roller 156 in a predetermined nip width. The web mounting and demounting mechanism 325 (FIG. 2) moves the urging roller 158 to provide a contact state (on-state) in which the web 160 contacts the collection roller 156 and a spaced state (off-state) in which they are spaced from each other.

The winding-up roller 157 includes a solenoid 324 (FIG. 2) as a driving source to intermittently wind up the web 160 supplied from the supplying roller 159 so that the web rubs the collection roller 156. The operation is controlled by the CPU301. For example, two winding operations each winding 0.1 mm of the web 160 are carried out per 1 sec. By this, the toner collected by the collection roller 156 from the fixing roller 151 is removed by the web 160. Using the collection roller driven by the fixing roller 151, the possible damage to the fixing roller 151 by direct sliding contact of the web 160 can be avoided. As a result, the reduction of the glossiness property of the print due to the surface roughness of the fixing roller 151 can be suppressed.

In this embodiment, the collection rotatable member is used, but the web 160 may directly rub the surface of the fixing roller 151 to clean the fixing roller 151.

(Jam Clearance Operation)

The operation upon the occurrence of sheet jamming in the image forming apparatus 100 will be described.

The jamming in the fixing portion means the state in which the recording material 102 stagnates in the first fixing device 150 and/or the second fixing device 170 as a result of the occurrence of jammed sheet or sheets in the image forming apparatus 100.

For example, it is the case in which the jamming occurs in the first fixing device 150, or the case in which the recording material 102 stagnates in the first fixing device 150 because of jamming of another sheet in a part of the image forming apparatus 100 other than the first fixing device 150. In addition, for example, it is the case in which the recording material 102 stagnates in the first fixing device 150 because of the operator opening the door (front door 140, for example) of the main assembly of the image forming apparatus 100 during the fixing operation of the first fixing device 150, resulting in the operation stop of the image forming apparatus 100. The same applies to the second fixing device 170.

The description will be made in detail, taking the first fixing device 150 as an example.

The description applies also to the second fixing device 170, and therefore, the description about the second fixing device 170 will be omitted for the sake of simplicity. (the structures of the first fixing device 150 apply to the structures of the second fixing device 170).

When the CPU301 detects the occurrence of the sheet jamming in image forming apparatus 100 on the basis of the signals from the sensor group 306 including sensors 153, 155 in the image forming apparatus 100, it stops the image forming operation of the image forming apparatus 100. If, at this time, the recording material 102 is in the first fixing device 150, the jamming is that in the fixing portion. Thus, the jamming in the fixing portion occurs as a result of the jamming in the part other than the first fixing device 150. Thereafter, the CPU301 displays the position where the recording material 102 stagnates on the operating portion 180 to prompt the operator to remove the jammed sheet. The jamming in the fixing portion of the first fixing device 150 is simply called as the jamming in the first fixing device 150 (or jamming in the fixing device).

The sensors 153, 155 as the jam detecting portion detect presence or absence of the recording material 102 in the first fixing device 150. They are optical sensors, for example. The CPU301 receives the signals from the sensors 153 and/or 155 to detect that a recording material 102 stagnates in the first fixing device 150 (jamming in the fixing portion). For example, the CPU301 discriminates the stagnation of a recording material 102 between the sensors 155 and 153 in the case that the downstream side sensor 153 does not detect the passage of the recording material 102 after elapse of a predetermined time period after the upstream side sensor 155 detects the passage of the recording material 102. The elapse of the time is counted by the timer 307.

When the recording material 102 stagnates in the first fixing device 150, the operator opens the front door 140 and draw the first fixing device 150 out of the image forming apparatus 100, and then remove the recording material 102. After removing the stagnating recording material 102, the operator returns the first fixing device 150 into the image forming apparatus 100 and closes the operator.

The CPU301 detects the closing of the front door 140 on the basis of the signal from the opening and closing sensor 305. After the detection of the closing of the front door 140, the CPU301 accesses the memory 154 of the first fixing device 150. By this, it confirms the mounting of the first fixing device 150. If the CPU301 is unable to access the memory 154, it discriminates that the first fixing device 150 is not mounted. The method for discriminating or confirming the mounting of the first fixing device 150 is not limited to the method described above, but the mounting may be checked on the basis of a conduction state or non-conduction state between the image forming apparatus 100 and the first fixing device 150.

Then, the CPU301 checks the presence or absence of the recording material 102 stagnating in the first fixing device 150 on the basis of the signals from the sensors 153, 155. At this time, the CPU301 discriminates that the jam clearance operation has been completed if the recording material 102 does not stagnate in the first fixing device 150.

Thus, if the jamming in the first fixing device 150 occurs, that is, a recording material 102 stagnates in the first fixing device 150, the fixing roller 151 is likely to be contaminated with the unfixed toner on the stagnating recording material 102. More particularly, this occurs when the recording material 102 stagnates while being wound around the fixing roller 151, or when the recording material 102 rubs the fixing roller 151 when the operator removes the stagnating recording material 102.

Therefore, the CPU301 executes a cleaning process, which will be described hereinafter, for the first fixing device 150, after confirming the completion of the jam clearance operation for the first fixing device 150.

(Cleaning Process after the Jam Clearance)

The cleaning process for the fixing portion executed by the CPU301 as the executing portion after the removal of the jammed sheet from the fixing portion will be described, taking the first fixing device 150 as an example.

The description applies also to the second fixing device 170, and therefore, the description about the second fixing device 170 will be omitted for the sake of simplicity. (the structures of the first fixing device 150 apply to the structures of the second fixing device 170).

Before the start of the cleaning process, the temperature of the fixing roller 151 is raised up to approx. 165° C. with the rotation of the fixing roller 151 at rest. That is, the CPU301 controls the electric power supply to the halogen heater 161 on the basis of the detected temperature information provided by the thermister 162. At this time, the pressing belt 152 is kept in a non-rotated state, and is spaced from the fixing roller 151. That is, the CPU301 controls on the operation of the moving mechanism 322 so as to maintain the spaced state of the pressing belt 152 from the fixing roller 151. The target temperature (approx. 165° C. in this embodiment) of the fixing roller 151 at this time is selected so that the toner is not solidified and is preset and stored in the ROM 303. This temperature is properly selected by one skilled in the art depending on the structures of the device and the toner.

When the fixing roller 151 is heated up to approx. 165° C., the cleaning process is started. The CPU301 actuates the motor 323 in response to the detected temperature by the thermister 162 reaching approx. 165° C. Then, the fixing roller 151 starts to rotate, so that the collection roller 156 rotates. By this, the collection roller 156 collects the toner on the fixing roller 151. In addition, the CPU301 actuates the solenoid 324 to carry out the intermittent winding-up of the winding-up roller 157 for 100 sec. For example, two winding-up operations, each winding 0.1 mm of the web 160, are excused per 1 sec. At this time, the CPU301 controls the web mounting and demounting mechanism 325 so as to maintain the contact state between the web 160 and the collection roller 156. By this, the web 160 removes, from the collection roller 156, the toner collected from the fixing roller 151. The time period is counted by the timer 307 provided in the image forming apparatus 100. Furthermore, at this time, the CPU301 controls the electric power supply to the halogen heater 161 on the basis of the detected temperature information by the thermister 162 so as to maintain the temperature of the fixing roller 151 at approx. 165° C. In order to prevent the transfer of the toner from the fixing roller 151 to the pressing belt 152, the CPU301 controls the operation of the moving mechanism 322 so as to maintain the spaced state between the fixing roller 151 and the pressing belt 152.

The web winding-up time (100 sec in this embodiment) is counted by the timer 307 provided in the image forming apparatus 100.

The web winding-up time (100 sec in this embodiment) proper for removing the toner from the fixing roller 151 is preset and stored in the ROM 303. The specific time is not limited to 100 sec but may be properly determined by one skilled in the art depending on the structure of the apparatus.

(Warming-up Process)

After the completion of the cleaning process for the fixing portion, the CPU301 executes the warming-up process in preparation for the start of the fixing process. The warming-up process is executed also when the main switch 101 of the image forming apparatus 100 is actuated, not limited to the state after the cleaning process.

The description will be further made, taking the first fixing device 150 as an example.

The description applies also to the second fixing device 170, and therefore, the description about the second fixing device 170 will be omitted for the sake of simplicity. (the structures of the first fixing device 150 apply to the structures of the second fixing device 170).

Upon the completion of the above-described cleaning process, the CPU301 first controls the halogen heater 161 to raise the temperature of the fixing roller 151 up to approx. 165 degree C. At this time, the fixing roller 151 is not rotated. That is, the CPU301 does not actuate the motor 323. The CPU301 does not operate the inside heater of the heating roller 163. The CPU301 controls the operation of the moving mechanism 322 so as to maintain the contact state between the pressing belt 152 and the fixing roller 151. This is intended to heat the pressing pad 164 using the heat of the fixing roller 151.

When the fixing roller 151 is heated up to approx. 165 degree C., the CPU301 rotates the fixing roller 151 and controls the inside heater of the heating roller 163 to heat the pressing belt 152 up to approx. 100 degree C. That is, the CPU301 operates the motor 323 and the inside heater of the heating roller 163 in response to the reaching of the detected temperature by the thermister 162 to approx. 165 degree C. At this time, the CPU301 controls the operation of the moving mechanism 322 so as to maintain the contact state between the fixing roller 151 and the pressing belt 152, and therefore, the pressing belt 152 is rotated At this time, in order to remove a slight amount of the toner deposited on the fixing roller 151 during the printing operation, the web 160 may be contacted to the collection roller 156, and the intermittent winding-up by the winding-up roller 157 may be carried out.

When the pressing belt 152 is heated up to approx. 100 degree C., the CPU301 controls the moving mechanism 322 to space the fixing roller 151 and the pressing belt 152 The CPU301 controls the electric power supply to the halogen heater 161 on the basis of the detected temperature information by the thermister 162 so as to heat the fixing roller 151 up to approx. 170 degree C. At this time, the CPU301 controls the electric power supply to the halogen heater 161 on the basis of the detected temperature information by the thermister for sensing the temperature of the pressing belt 152 so as to maintain the pressing belt 152 at approx. 100 degree C. In the case that the kind of the recording material 102 to be printed after the warming-up operation has been selected by the input by the operator into the operating portion 180 (when the printing job is reserved), the target temperature of the fixing roller 151 may be the temperature required for the fixing process for the reserved recording material 102.

The target temperatures of the fixing roller 151 and/or the pressing belt 152 in the warming-up process is preset and stored in the ROM 303 (approx. 165 degree C., approx. 100 degree C., approx. 170 degree C. in this embodiment). The temperatures are properly selected by one skilled in the art depending on the structures of the devices.

When the warming-up process for the first fixing device 150 is completed, the image forming apparatus 100 is placed in the condition capable of starting the image forming operation. In order to provide the states with which the image forming operation can be started, the starting-up processes are concurrently carried out for the image forming stations 309 and so on, and these starting-up processes are completed before the completion of the warming-up process operation for the first fixing device 150. The warming-up process operation for the first fixing device 150 takes about 7 minutes in the longer case. The same applies to the warming-up process for the second fixing device 170, and the warming-up process operation is completed substantially simultaneously with the completion of the warming-up process for the first fixing device 150.

(Resumption of Job)

After the image forming apparatus 100 is enabled to start the image forming operation after the completion of the warming-up process for the first fixing device 150, the CPU301 resumes the printing operation interrupted due to the occurrence of the jamming. The CPU301 displays "printing" in the operating portion (notifying portion) 180.

If the part or parts other than the first fixing device 150, the image forming stations 309, for example are not completed for the resumption even if the warming-up process operation of the first fixing device 150 has been completed, the CPU301 waits for the completion of the part or parts, and then resumes the printing operation.

The same applies to the second fixing device 170.

(Stand-by Mode)

The stand-by mode means the state in which the image forming apparatus 100 is in the state capable of starting of the image forming operation and waits for the printing instructions (printing job) by the operator. If there is no job to be resumed after the completion of the above-described warming-up process, or after the completion of the printing operation, the apparatus becomes in the stand-by mode.

When the image forming apparatus 100 is enabled to start the image forming operation, the CPU301 displays "printable" on the operating portion (notifying portion) 180.

In this embodiment, in the stand-by mode, the temperature control for the first fixing device 150 and the second fixing device 170 (the fixing roller 151 and pressing belt 152, for example) is continued so that the printing operation can be started as soon as the printing job is received.

If a printing operation is reserved during the warming-up process operation, the reserved printing job is executed without entering the stand-by mode. That is, in such a case, when the state of the image forming apparatus 100 becomes capable of starting the image forming operation after the completion of the warming-up process operations for the first fixing device 150 and the second fixing device 170, the printing job is immediately started without entering the stand-by mode.

If the part or parts other than the first fixing device 150 or the second fixing device 170, the image forming stations 309, for example are not completed for the resumption even if the warming-up process operation of the first fixing device 150 and the second fixing device 170 have been completed, the CPU301 waits for the completion of the part or parts, and then resumes the printing operation.

(Exchange of Fixing Device)

The exchanging system of the fixing device will be described.

The image forming apparatus 100 is capable of printing on various kinds and sizes of the recording material 102. In order to provide high quality prints, in the image forming apparatus 100 of this embodiment, the fixing device can be exchanged depending on the kinds of the recording material 102 or the preference of the operator.

For example, when the recording material 102 is an envelope, the fixing device exclusively for the envelope is used. The envelope is easily creased by the pressure applied during the fixing process. Therefore, it is desirable to use a fixing device adjusted in the pressure between the fixing roller 151 and the pressing belt 152 (nip pressure) particularly for envelopes.

As another example, there is a fixing device particularly for a specific width size. When the same width recording materials 102 continuously pass the nip, the surface of the fixing roller 151 is damaged at the widthwise edge portions of the recording materials 102. If the damage of the fixing roller 151 becomes intolerable level, the glossiness of the image becomes uneven due to the damage when a larger with the recording material 102 is processed. In order to prevent this, the same structure fixing devices may be used exclusively for respective sizes of the recording materials 102. (here, the width is the dimension measured in the direction perpendicular to the feeding direction of the recording material 102 (longitudinal direction of the fixing roller 151).

The same applies to the second fixing device 170.

Thus, according to the image forming apparatus 100 of this embodiment, the operator can exchange the fixing device depending on the kinds of the recording materials 102 or preferences of the operator.

When the fixing device is exchanged, the operator opens the front door 140 to take the mounted fixing device out of the image forming apparatus 100. Then, the operator mounts another fixing device into the image forming apparatus 100, and closes the front door 140. In this embodiment, the first fixing device 150 and the second fixing device 170 are exchangeable, respectively.

(Memory of the Fixing Device)

In this embodiment, the fixing device is exchangeable, and therefore, the first fixing device 150 is provided with a memory 154 as a storing portion, and the second fixing device 170 is provided with a memory 174 as a storing portion. The memories 154, 174 are rewritable non-volatile memory (storing portion), typically such as an EEPROM, a flash memory or the like. A memory is also provided on a fixing device (not the first fixing device 150 or the second fixing device 170 already mounted in the image forming apparatus 100) kept outside of the image forming apparatus 100.

The fixing device group including the first fixing device 150 and the second fixing device 170 is provided with the memory in order to solve the problem described below. The problem arises when fixing device is once taken out of the apparatus without executing the cleaning process after the jam clearance in the fixing portion, and then the fixing device is remounted in the image forming apparatus 100. The following description will be made taking the first fixing device 150 as an example, but the same applies to the second fixing device 170.

More particularly, the following situation may occur. That is, the fixing device to be replaced is the first fixing device 150.

For example, it is assumed that the first fixing device 150 currently mounted in the apparatus is not the one exclusively for the envelope, and a printing job (on the plain paper sheets, for example) which requires more than one hour to complete starts. It is further assumed that 15 minutes after the start of the printing job (initial stage), sheet jamming occurs in the fixing device A. The operator then executes jam clearance operation in accordance with the display of the operating portion 180. However, if an urgent printing job on the envelopes came across, the operator interrupts the previous printing job by the fixing device A, and may start the new printing on the envelopes. The operator may omit the cleaning process and replace the fixing device A with the fixing device B exclusively for the envelopes.

Conventionally, the CPU stores the occurrence of the jam in the fixing portion in the memory provided in the main assembly of the image forming apparatus, so that the cleaning process is carried out after the jam clearance operation. In this case, if the fixing device A is replaced with the fixing device B after the jam clearance operation, the CPU executes the cleaning process operation only for the new fixing device B. Thus, the CPU discriminates the completion of the cleaning process to be executed after the jam clearance operation for the fixing portion.

When the operator prints on the recording material (plain paper sheets, for example) other than the envelopes some days later, the operator remounts the fixing device A. The fixing roller of the fixing device A not having been subjected to the cleaning process remains contaminated with the toner.

If the printing operation is carried out in the state, the image quality is significantly deteriorated.

Under the circumstances, the first fixing device 150 is provided with the memory 154 in this embodiment. By this, the information indicative of whether the cleaning process operation after the jam clearance operation in the fixing portion has been executed or not can be stored in the memory. The information is kept in the memory 154.

As shown in FIG. 8, in this embodiment, jam hysteresis information (yes or no) is kept stored. More particularly, with the occurrence of the jam in the first fixing device 150, and the CPU301 stores the jam hysteresis (yes) in the memory 154. After the cleaning process is executed after the jamming in the fixing portion, the CPU301 resets the jam hysteresis of the memory 154 (no). The jam hysteresis "yes" is indicative that the cleaning process operation has not been executed, and "no" is indicative that the cleaning process operation has been executed.

Upon the remounting of the first fixing device 150 by the operator, the CPU301 acquires the information indicating the completion or non-completion of the cleaning process, from the memory 154. If the acquired information is indicative of non-completion of the cleaning process operation, the CPU301 executes the cleaning process operation that should have been executed after the jam clearance operation.

If the jam hysteresis information is reset in the memory 154, the CPU301 discriminates no jam hysteresis.

The method for writing the information in the memory 154 is not limited to the above-described specific example, and, for example, when the cleaning process is not executed, date may be stored, and when the cleaning process has been executed, no data is stored. Further alternatively, the data indicative of non-completion of the cleaning process or the data indicative of completion of the cleaning process may be stored.

The memory 154 may store information other than the jam hysteresis. For example, the information includes usage or kind of the first fixing device 150 (envelope, A4 size, for example).

(Control Flow)

The description will be made in conjunction with the flow charts of FIGS. 4-7. The operations of the flow charts are carried out by the CPU301 functioning as the executing portion (recording portion, writing portion) controlling the related mechanisms of the image forming apparatus 100 in accordance with the control program stored in the ROM 303. The description will be made as to the first fixing device 150, but the same applies to the second fixing device 170.

(Sequence Upon Actuation Of The Main Switch And Upon Closing The Front Door)

Figure 4:
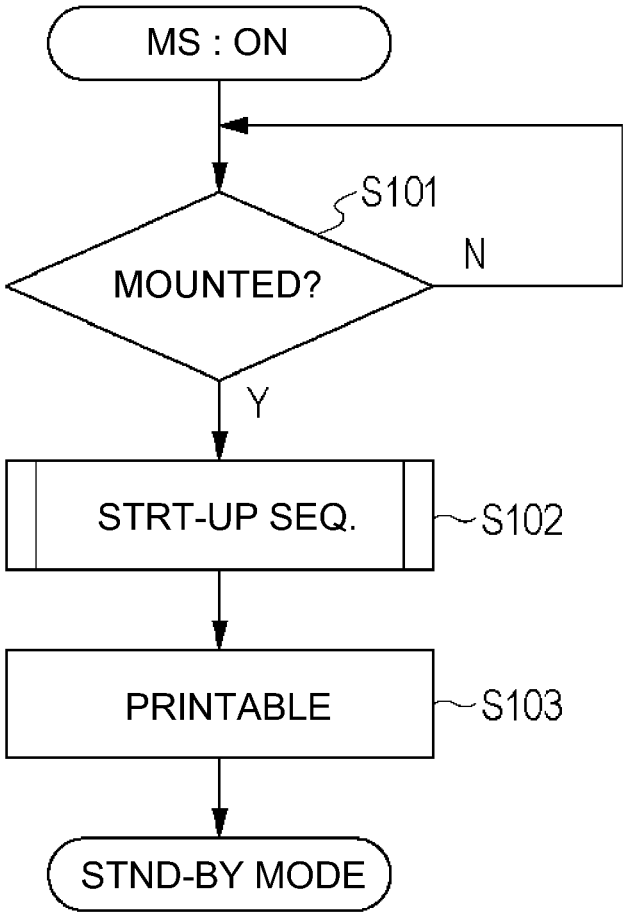
FIG. 4 is a flow chart showing the operations from the actuation of a main switch to a stand-by mode.

FIG. 4 is a flow chart showing the operations from the actuation of a main switch to a stand-by mode.

With the actuation of the main switch 101, the CPU301 starts. The CPU301 discriminates whether or not the first fixing device 150 is mounted in the image forming apparatus 100 (S101). If the result of the discrimination is affirmative, the CPU301 becomes accessible to the memory 154. If the result of the discrimination at the step (S101) is negative, the operation returns to the step S101. If the first fixing device 150 is mounted in the image forming apparatus 100, the operation proceeds to the step S102.

Figure 6:
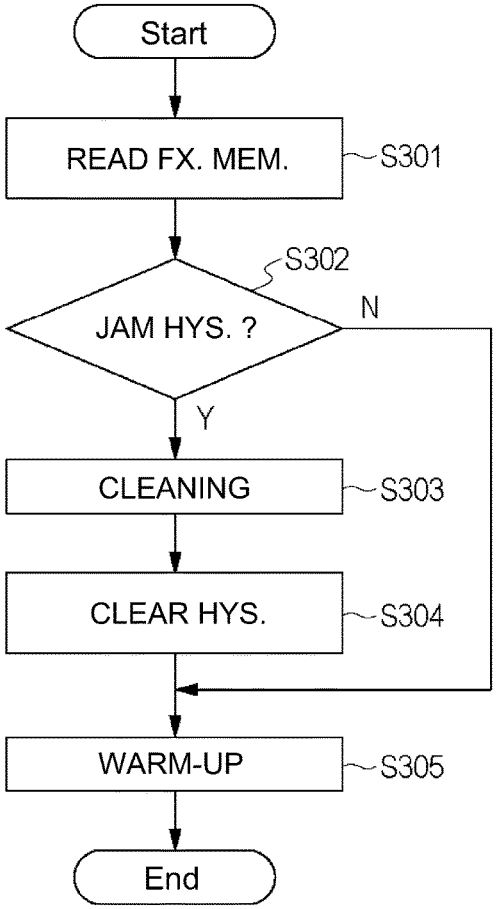
FIG. 6 is a flow chart of the start-up sequential operations.

The CPU301 carries out the stand-up sequence shown in FIG. 6 for the first fixing device 150. The detail of the operation will be described hereinafter.

After the completion of the start-up of the first fixing device 150, the CPU301 displays "printable" on the operating portion 180 to notify the operator that the image forming apparatus 100 can form the image (S103). Then, the operation enters the stand-by mode.

Figure 5:
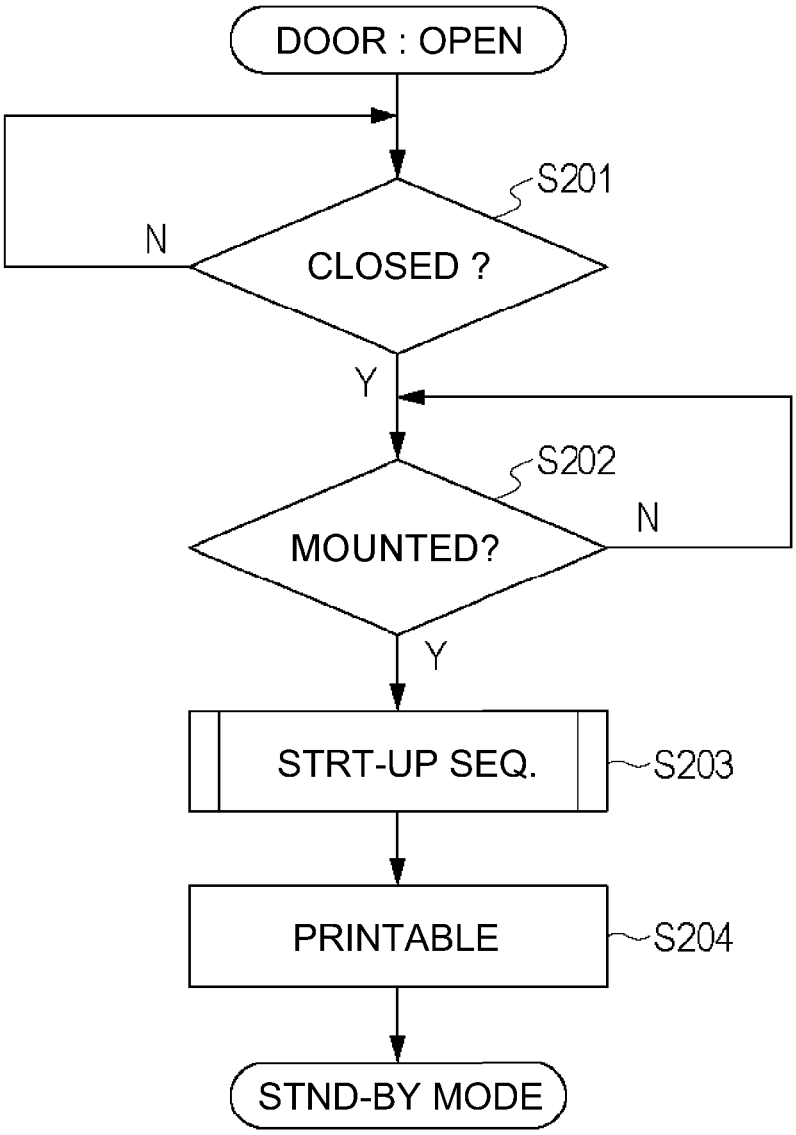
FIG. 5 is a flow chart showing the operations from the state in which a front door is open to the stand-by mode.

FIG. 5 is a flow chart showing the operations from the state in which a front door is open to the stand-by mode.

The opened and closed states of the front door 140 are detected by the CPU301 on the basis of the signal from the opening and closing sensor 305 of the front door 140. When the front door 140 is open, the CPU301 waits for the closing of the front door 140 (S201). When the front door 140 is open, the CPU301 may display information to prompt to close the front door 140. When the CPU301 detects the closing of the front door 140 (S201), the operation proceeds to step S202. Steps S202-S204 are the same as the steps S101-S103 of FIG. 4, and therefore, the description thereof is omitted. After the S204, the operation proceeds to the stand-by mode.

(Start-up Sequence)

FIG. 6 is a flow chart of the start-up sequential operations. The flow chart of FIG. 6 shows details of the steps S102, S203 and a step S410 which will be described hereinafter.

The CPU301 first reads out the data stored in the memory 154 of the first fixing device 150 mounted to the image forming apparatus 100 (S301).

When the jam hysteresis is stored in the memory 154, the operation proceeds to step S303 (S302).

The CPU301 controls the cleaning portion or the like to execute the above-described cleaning process operation (S303).

After the completion of the cleaning process, the CPU301 resets (clear) the jam hysteresis in the memory 154 (S304).

In this step S302, if no jam hysteresis is stored in the memory 154, the operation proceeds to a step S305 without executing the cleaning process operation. When no jam hysteresis is stored in the memory 154, it means that the cleaning process operation has been carried out. By not executing the cleaning process when it is unnecessary, the time from the actuation of the main switch 101 to the state in which the image forming apparatus 100 becomes capable of performing the image can be reduced (by the time (100 sec) required by the cleaning process operation.

The CPU301 controls the first fixing device 150 to carry out the above-described warming-up process (S305).

The timing of clearing of the jam hysteresis stored in the memory 154 in the step S304 is not limited to the above-described timing. For example, the jam hysteresis in the memory 154 may be cleared upon the completion of the warming-up process (S305).

The clearance of the jam hysteresis in the memory 154 in the S304 may be effected upon the detection of the opening of the front door 140 on the basis of the signal from the opening and closing sensor 305, provided that the cleaning process operation has been carried out. Further alternatively, the clearance of the jam hysteresis in the memory 154 in the S304 may be effected upon deactuation of the main switch 101, provided that the cleaning process operation has been carried out. This is because the exchange of the first fixing device 150 requires opening of the front door 140.

(Sequence Upon Jam Occurrence)

Figure 7:
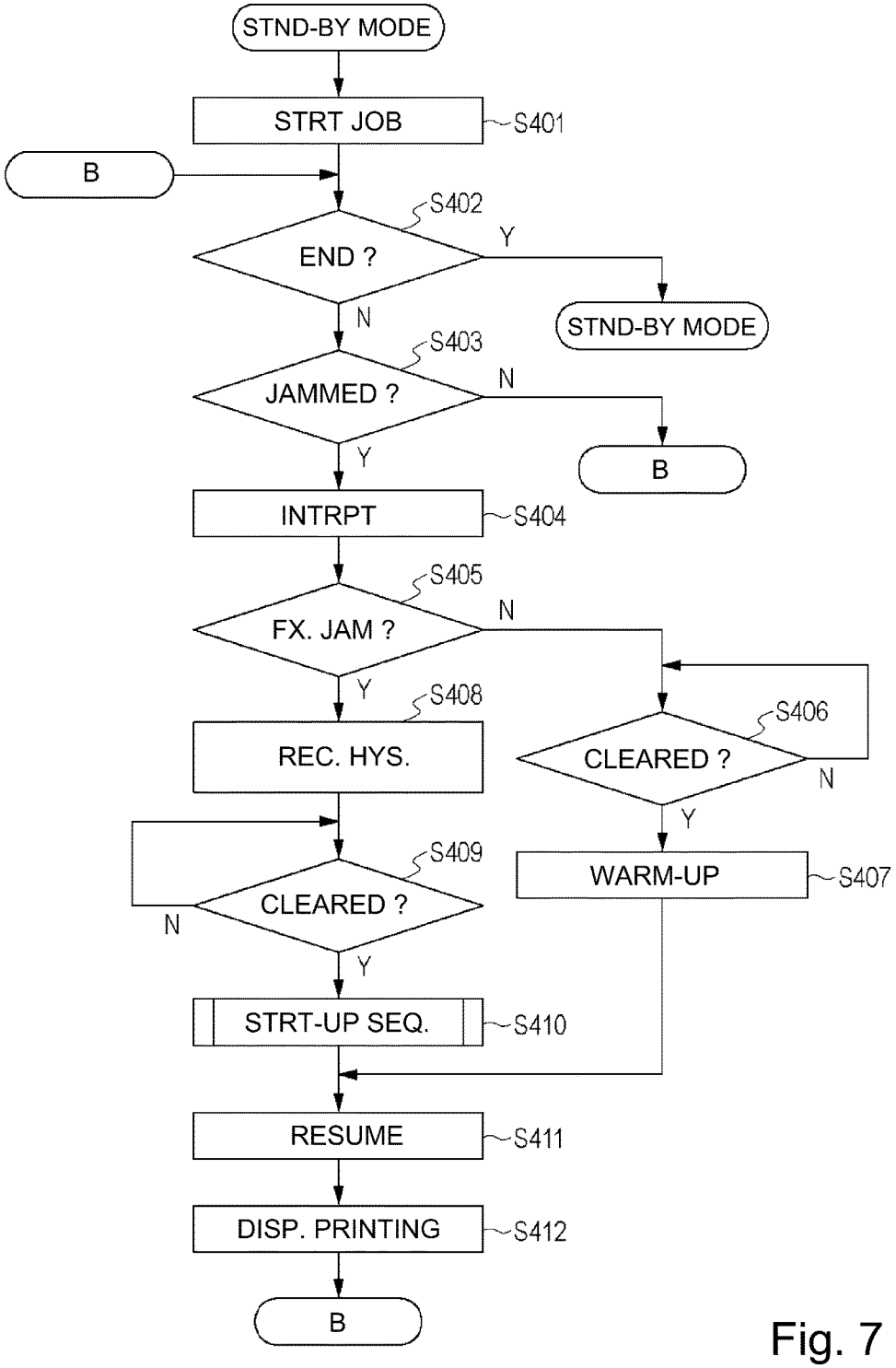
FIG. 7 is a flow chart of the operations at the time when sheet jamming occurs in the fixing device.

FIG. 7 is a flow chart of the operations at the time when sheet jamming occurs in the fixing device. More particularly, it is a flow chart in the printing job execution of the image forming apparatus 100.

In the stand-by mode in which the image forming operation of the image forming apparatus 100 is possible, a printing job is received from the operating portion 180 or an external PC from through an external I/F portion 304. Then, the CPU301 controls various mechanisms of the image forming apparatus 100 including the stations 120-123, the first fixing device 150 and the second fixing device 170, so that the image forming operation of the image forming apparatus 100 is started (S401). At this time, the image forming apparatus 100 provides a selection screen for selecting the kind of the recording material 102 on the display screen of the operating portion 180 or the external PC to receive the operator's instruction.

After the completion of the printing job, the CPU301 places the image forming apparatus 100 in the stand-by mode (S402).

If the CPU301 detects the occurrence of the sheet jamming in the image forming apparatus 100 before the completion of the printing job (S402) (S403), the image forming operation of the image forming apparatus 100 is stopped, that is, the printing job is interrupted (S404). The CPU301 detects the occurrence of the jamming in the image forming apparatus 100 on the basis of the signals from the sensor group 306.

When no jamming in the image forming apparatus 100 is detected, the CPU301 continues the execution of the printing job up to the end of the printing job (S402, S403).

When the position of the stagnation of the recording material 102 as a result of the jamming is outside the first fixing device 150 (second fixing device 170), the CPU301 proceeds to a step S406 (S405). The CPU301 waits for the removal of the stagnating recording material 102 on the basis of the signals from the sensor group 306 (S406). When the CPU301 detects the removal of the stagnating recording material or recording materials 102 on the basis of the signals from the sensor group 306, the CPU301 executes the above-described warming-up process (S407).

On the other hand, if the CPU 301 discriminates that the position of stagnation of the recording material 102 is in the first fixing device 150 (second fixing device 170) (fixing portion jam), the operation proceeds to a step S408 (S405). The CPU301 stores the jam hysteresis in the memory 154 of the first fixing device 150 (S408).

The storing of the jam hysteresis of the first fixing device 150 in the memory 154 by the CPU301 may be carried out upon the opening of the front door 140. Even if the front door 140 is opened, the first fixing device 150 is supplied with electric power as long as it is not dismounted from the main assembly of the image forming apparatus 100, and therefore, the CPU301 is capable of recording the jam hysteresis in the memory 154.

As described hereinbefore, the first fixing device 150 is liable to be replaced in the jam clearance operation. In view of this, after the detection of the jamming in the first fixing device 150, the jam hysteresis is recorded in the memory 154 by the time of removal of the first fixing device 150 for the jam clearance by the operator.

The CPU301 waits for removal of the recording material 102 stagnating in the first fixing device 150, on the basis of the signals from the sensors 153, 155 (S409). When the CPU301 detects the removal of the recording material 102 stagnating in the first fixing device 150, the operation proceeds to a start-up sequence S410 (S409). At this time, the CPU301 detects the closing of the front door 140 on the basis of the signal from the opening and closing sensor 305, and checks presence or absence of the recording material 102 in the first fixing device 150.

The start-up sequence S410 corresponds to the flow shown in FIG. 6. In the start-up sequence S410, the data in the memory 154 of the first fixing device 150 is read out (S301). The jam hysteresis information is read out here, because there is a possibility that the first fixing device 150 is replaced at the timing of opening the front door 140 for the jam clearance.

When the start-up sequence S410 of the first fixing device 150 or the warming-up process S407 is completed, the CPU301 resumes the image forming operation of the image forming apparatus 100, that is, the interruption is stopped (S411).

In addition, the CPU301 displays "printing" or the like on the operating portion 180 to notify the operator of the execution of the printing of the image forming apparatus 100 (S412).

Thereafter, the operation returns to step S402, where the CPU301 continues the execution of the printing job until the end of the job (S402, S403).

As described hereinbefore, the exchange of the first fixing device 150 by the operator requires opening and closing of the front door 140 of the image forming apparatus 100. That is, when the front door 140 of the image forming apparatus 100 is opened by the operator, the first fixing device 150 may be exchanged. In addition, the first fixing device 150 may be exchanged during off period of the main switch 101. Therefore, in response to switching-on of the main switch 101 of the image forming apparatus 100 and the closing of the front door 140, the information is read out of the memory 154 of the first fixing device 150 to acquire the jam hysteresis information of the memory 154. By this, even if the first fixing device 150 not having been subjected to the cleaning process after the jam clearance operation is remounted to the image forming apparatus 100, the cleaning process is executed, and therefore, the deterioration of the image quality can be suppressed.

The description has been made with respect to the first fixing device 150, but the same applies to the second fixing device 170.

[Embodiment 2]

In Embodiment 1, the information indicative of whether or not the cleaning process operation after the jam clearance operation in the fixing portion has been carried out is stored in the memory of the fixing device. On the basis of the information, the CPU301 discriminates whether to execute the cleaning process for the remounted fixing device.

The case that the cleaning process operation to be executed after the jam clearance operation in the fixing portion is interrupted will be described, in Embodiment 2. In the description of this embodiment, the same reference numerals as in Embodiment 1 are assigned to the elements having the corresponding functions in this embodiment, and the detailed description thereof is omitted for simplicity.

The description will be made, taking the first fixing device 150 as an example. The same applies to the second fixing device 170.

When the operator opens the front door 140 during the prosecution of the cleaning process, for example, the CPU301 interrupts the cleaning process. The CPU301 detects the opening of the front door 140 on the basis of the signal from the opening and closing sensor 305.

In Embodiment 1, the jam hysteresis of the memory 154 is cleared after the completion of the cleaning process operation. Therefore, if the operator opens the front door 140 and it takes the first fixing device 150 out of the main assembly of the apparatus during the execution of the cleaning process, the jam hysteresis of the memory 154 is not cleared. When the first fixing device 150 is remounted by the operator, the CPU301 executes in the cleaning process from the beginning.

However, if the cleaning process is already executed up to 80 sec of 100 sec at the time when the cleaning process is interrupted, the contamination of the fixing roller 151 with toner has been removed to a quite large extent. Despite the fact, if the cleaning process is executed for 100 sec, the waiting time of the operator is wastefully long.

Under the circumstances, when the first fixing device 150 for which the cleaning process has been interrupted is remounted, a short cleaning process operation (shorter than the cleaning process of Embodiment 1) is carried out.

The memory 154 of the first fixing device 150 is capable of storing three kinds an information including "cleaned", "interrupted" and "no hysteresis", as for the cleaning process (100 sec in this embodiment) to be executed after the jam clearance operation in the fixing portion. When the information acquired from the memory 154 of the first fixing device 150 is "no hysteresis" (the data of the cleaning hysteresis has been cleared), the CPU301 discriminates that the cleaning process has not been carried out, and therefore, the above-described cleaning process (100 sec) is executed. On the other hand, when the information acquired from the memory 154 of the first fixing device 150 is "interrupted", the CPU301 executes the short cleaning process (50 sec in this embodiment) for the period shorter than that of the above-described cleaning process (100 sec). When the information acquired from the memory 154 of the first fixing device 150 is "executed", the CPU301 does not execute the cleaning process or the short cleaning process.

(Control Flow)

The description will be made in conjunction with FIGS. 9-12. The operations of the flow charts are carried out by the CPU301 functioning as the executing portion (recording portion, writing portion) controlling the related mechanisms of the image forming apparatus 100 in accordance with the control program stored in the ROM 303. The description will be made as to the first fixing device 150, but the same applies to the second fixing device 170.

(Start-up Sequence)

The start-up sequence flow in Embodiment 2 is different from that of Embodiment 1. FIG. 9 is a flow chart of the start-up sequential operations 2. The flow chart of FIG. 9 shows the details of the start-up sequence of step S702 of FIG. 11 and step S803 of FIG. 12.

The CPU301 first reads out the cleaning hysteresis data stored in the memory 154 of the first fixing device 150 mounted to the first mounting portion 141.

When the cleaning hysteresis of the memory 154 is "executed", the operation proceeds to S509, and otherwise, the operation proceeds to S503 (S502).

If the cleaning hysteresis of the memory 154 is other than "executed", and is not "interrupted" (not executed), the operation proceeds to step S504 (S503), and the CPU301 controls the cleaning portion to execute the cleaning process operation (S504).

If the cleaning hysteresis of the memory 154 is other than "executed" and is "interrupted", the operation proceeds to S505 (S503), the CPU301 executes the above-described short cleaning process (S505).

When the cleaning process or the short cleaning process is interrupted during the execution thereof, the operation proceeds to S507 (S506), and the CPU301 writes the cleaning hysteresis "interrupted" in the memory 154 (S507). Even when the front door 140 is opened, the image forming apparatus 100 and the first fixing device 150 are supplied with the electric energy, and therefore, the CPU301 can write the "interrupted" in the memory 154. Here, the raising sequence for the first fixing device 150 is interrupted.

If the cleaning process or short cleaning process is not interrupted, that is, is completed, the operation proceeds to S508 (S506), and the CPU301 writes "executed" in the memory 154 (S508). The CPU301 controls the first fixing device 150 to carry out the above-described warming-up process (S305).

By not executing the cleaning process in the case of unnecessity, the time required from the actuation of the main switch 101 to the capable image forming operation can be saved by 100 sec.

In addition, when the short cleaning process is enough, the short cleaning process is carried out. By this, the time from the actuation of the main switch 101 to the enabled image formation of the image forming apparatus 100 can be reduced (by 50 sec).

The execution time of the short cleaning process may be variable depending on the cleaning time executed until the interruption. In such a case, the executed cleaning time until the interruption of the cleaning process is counted by a timer 307. The CPU301 stores the information indicative of the time period of the execution of the cleaning or short cleaning until the interruption is stored in the memory 154 together with the cleaning hysteresis (S507). The CPU301 reads out the information indicative of the executed cleaning time together with the information of the cleaning hysteresis (S501), and the short cleaning process is executed for the time period determined on the basis of the read-out cleaning time (S505).

At this time, the period of the time of the short cleaning process is not necessarily the difference between the cleaning process time without interruption and the cleaning time up to the interruption. For example, when the cleaning process of 100 sec is interrupted at the timing at less than 50 sec, the short cleaning process may be executed for 80 sec, and when the cleaning process is interrupted more than 50 and less than 100, the short cleaning process may be carried out for 30 sec.

If the executed cleaning process operation is less than a predetermined level, the cleaning process may be fully executed from the beginning, by the CPU301 keeping the cleaning hysteresis cleared in step S507.

When the first fixing device 150 for which the cleaning process has been interrupted is remounted, the operator may determine whether to execute the short cleaning process or not. That is, the apparatus may be constructed in such that the operator is capable of selecting a mode in which the cleaning operation is carried out from the beginning as in Embodiment 1 or a mode in which the short cleaning process is carried out as in Embodiment 2. The operating portion 180 displays these modes on the screen to permit the operator to select one of them. If the selected mode is the former mode, and the cleaning process operation is interrupted, the CPU301 keeps the cleaning hysteresis cleared to execute the cleaning process from the beginning in step S507.

(Sequence Upon Jam Occurrence)

FIG. 10 is a flow chart of the operations at the time when sheet jamming occurs in the fixing device. More particularly, it is a flow chart during the execution of the printing job execution of the image forming apparatus 100.

As to steps S601-S607, they are the same as the steps S401-S407 of FIG. 7, and therefore, the description is omitted.

In step S608, the CPU301 clears the cleaning hysteresis in the memory 154 of the first fixing device 150. By this, the cleaning hysteresis becomes "no hysteresis" which indicates the non-execution of the above-described cleaning process.

A step S609 is the same as the S409 of FIG. 7, and therefore, the description thereof is omitted.

In a step S610, the CPU301 executes the start-up sequence 2 of FIG. 9.

As to steps S611-S612, they are the same as the steps S411-S412 of FIG. 7, and therefore, the description is omitted.

(Sequence Upon Actuation of the Main Switch and Upon Closing the Front Door)

FIG. 11 is a flow chart showing the operations from the actuation of a main switch to a stand-by mode. Steps S701 and S703 are the same as the steps S101 and S103 of FIG. 4, respectively. In a step S702, the CPU301 executes the start-up sequence 2 of FIG. 9.

FIG. 12 is a flow chart showing the operations from the state in which a front door is open to the stand-by mode. Steps S801, S802 and S804 are the same as the steps S201, S202 and S204 of FIG. 5, respectively. In a step S802, the CPU301 executes the start-up sequence 2 of FIG. 9.

[Embodiment 3]

With the fixing device exchangeable system, the operator may replace the fixing device with another fixing device depending on the kind of the recording material 102 used or the preference of the operator. In such a case, there is a possibility that the advantageous effects of the exchangeable fixing device (that is, a high quality print can be produced) is not provided, when the operator does not use the fixing device suitable for the recording material 102. In view of this, in this embodiment, the image forming apparatus 100 notifies the operator of whether the recording material 102 preferred by the operator and the usage of the fixing device meet properly with each other.

The description will be made on the basis of Embodiment 1 (FIGS. 6 and 7) as to the method for the correspondence between the usage of the fixing device and the recording material 102 on which the image is to print. The other structures of this embodiment are the same as those of Embodiment 1, and therefore, the description of the common parts is omitted for the sake of simplicity. The description will be made as to the first fixing device 150, but the same applies to the second fixing device 170.

In the memory 154, identifying information indicative of the kind and/or usage (for envelopes, for example) is stored as the identifying information of the first fixing device 150. On the other hand, the main assembly memory 312 stores information (limitation information) indicative of the kinds of the recording material 102 to limit the kinds of the recording material to be processed by the fixing device, in combination (correlation) with the identifying information.

In step S301 of FIG. 6, the CPU301 reads out the identifying information of the memory 154 of the first fixing device 150 together with reading the data stored in the memory 154 of the first fixing device 150 mounted to the image forming apparatus 100. The CPU301 determines the kinds of the recording material 102 to be limited for the first fixing device 150, on the basis of the identifying information and the kinds of the recording material 102 stored in the main assembly memory 312.

In this step S401 of FIG. 7, when the CPU301 receives the printing job from the operator, the CPU301 makes non-selectable the kinds of the recording material 102 not suitable for the first fixing device 150 on the selection screen.

Thus, the printing operation using improper first fixing device 150 can be prevented, thus assuring high quality prints.

The information corresponding to the kinds of the recording material 102 to be prevented may be stored in the memory 154 of the first fixing device 150 not that of the main assembly memory 312. In such a case, the CPU301 reads the kinds of the recording material 102 to be prevented out of the memory 154 of the first fixing device 150 together with reading the data out of the memory 154 at step S301 (S301). On the basis of the kinds of the recording material 102 to be prevented, the CPU301 acquires the kinds of the recording material 102 to be prevented by the first fixing device 150.

In addition, this embodiment may be incorporated in Embodiment 2, although the description is made with respect to the case in which this embodiment is incorporated in Embodiment 1. The description as to the case in which this embodiment is incorporated in Embodiment 2 is omitted, because the foregoing description applies to such a case.

[Embodiment 4]

In the description heretofore, the information indicative of whether or not the cleaning process to be executed after the jam clearance operation in the fixing portion is executed is stored in the memory 154 of the first fixing device 150 and the memory 174 of the second fixing device 170. In addition, the same information may be stored in the main assembly memory 312 in parallel with the writing of the information in the memories 154, 174, as a back-up.

[Embodiment 5]

In the foregoing, when the cleaning process to be executed after the jam clearance operation in the fixing portion is completed, the warming-up process is executed without executing the cleaning process, but an exceptional process which will be described hereinafter may be executed. When it is said when the cleaning process to be executed after the jam clearance operation in the fixing portion is completed, the warming-up process is executed without executing the cleaning process, it does not exclude the case in which an exceptional process is executed as in this embodiment.

More particularly, the CPU301 may exceptionally execute the cleaning process even when the cleaning process after the jam clearance operation in the fixing portion is already executed.

For example, for the purpose of removing the contaminating toner accumulated in the plurality of fixing operations, the CPU301 executes such an exceptional cleaning process once per 100 start-up sequence operations. In such a case, the CPU301 stores the number of executions of the start-up sequence operations of the first fixing device 150 in the memory 154, and the exceptional process is carried out depending on the accumulated number of executions of the start-up sequence operations.

In addition, when the CPU301 fails to read the information out of the memory 154 for some or unknown reasons, the cleaning process is executed. By this, the deterioration of the image quality of the print can be avoided when the non-readable information indicates that the non-execution of the cleaning process.

However, if the cleaning process is executed when the cleaning process is already completed, it is not possible to reduce the time required from the actuation of the main switch 101 to the image formation capable state of the image forming apparatus 100. Therefore, the above-described the execution is only an exceptional process, and it is preferable that the cleaning process is not executed when the cleaning operation is already completed.

The same applies to the second fixing device 170.

[Embodiment 6]

In the foregoing description, the operating portion 180 is provided with a display screen and a selection key, but the display screen may be a touch panel which also functions as a selector.

[Embodiment 7]

The collection rotatable member may be hollow roller (external heating member) including a heater therein to heat the fixing rollers 151, 171 from the outside of the fixing rollers 151, 171.

In the foregoing description, the cleaning portion is provided in the fixing roller 151 side, but it may be provided in the pressing belt 152 (rotatable member) side, and the toner is transferred from the surface of the fixing roller 151 onto the pressing belt 152, and then it is removed. In such a case, in the cleaning operation, in order to transfer the toner from the surface of the fixing roller 151 onto the pressing belt 152, the fixing roller 151 is contacted to the pressing belt 152. Similar to the foregoing examples, it is preferable that before the cleaning process is started, the pressing belt 152 is warmed to such an extent that the toner is not solidified, and then the cleaning process is carried out. The same applies to the second fixing device 170.

In the foregoing examples, the web cleaner (156-160) is used to effect the cleaning process after the jam clearance in the fixing portion (first fixing device 150, second fixing device 170), but the structure for the cleaning process is not limited to the specific structure. For example, by employing sponge rollers driven by the fixing rollers 151, 171, the cleaning may be effected.

[Embodiment 8]

In the foregoing examples, the cleaning process to be executed for the fixing portion (first fixing device 150, second fixing device 170) after the jam clearance operation is executed using a web cleaner (156-160), but the present invention is not limited to that.

The cleaning may be carried out using the recording material 102.

With this method, the contaminating toner on the fixing roller 151 and/or fixing roller 171 resulting from the occurrence of the jam in the fixing portion can be removed, even if the cleaning mechanism such as the above-described web cleaner is not provided. More particularly, when the cleaning operation is carried out, a plurality of recording materials 102 are forcedly passed through the fixing portion (first fixing device 150, second fixing device 170) to transfer the contaminating toner onto the recording materials 102. Thereafter, the recording materials 102 carrying the toner are discharged to the outside of the image forming apparatus 100.

In this case, when the information stored in the memory 154 indicates the non-execution of the cleaning process, the CPU301 controls the feeding portion 308 to pass the predetermined number of recording materials 102 through the first fixing device 150 (second fixing device 170) and discharged them to the outside of the apparatus. The same applies to the second fixing device 170. The number of the recording materials 102 may be predetermined, and in this embodiment, it is 10.

[Embodiment 9]

In the foregoing embodiments, the image forming apparatus 100 comprises both of the first fixing device 150 and the second fixing device 170 (tandem fixing). However, the present invention is applicable to an image forming apparatus 100 comprising only one fixing device 150.

[Embodiment 10]

In the foregoing embodiments, the image forming apparatus 100 comprises the image forming stations (120-123) for forming yellow, magenta, cyan and black toner images (color image forming apparatus), but the present invention is applicable to a monochromatic image forming apparatus. For example, there is a monochromatic for forming the toner images in black only.

[Embodiment 11]

In the foregoing embodiments, the image forming apparatus 100 comprises an intermediary transfer belt 115 as an intermediary transfer member (intermediary transfer type), but the present invention is applicable to a direct transfer type apparatus as follows.

In such a case, the image forming station 309 includes the image forming stations (120-123) and a transfer feeding belt functioning as a transfer portion. The image forming stations (120-123) can be contacted by the transfer feeding belt. The image forming apparatus 100 feeds the recording material 102 from a recording material accommodating portion 103 to the transfer feeding belt.

The transfer feeding belt electrostatically attracts the recording material 102 and carries it to a position where the recording material 102 is faced to the image forming station, and a transfer roller is provided in the inside of the belt. The transfer roller transfers the toner image formed on the image bearing member onto the recording material 102 carried on the transfer feeding belt. By this, the toner image (unfixed) is formed on the recording material 102.

[Embodiment 12]

(General Arrangement of Image Forming Apparatus)

FIG. 13 is a sectional view of an example of the image forming apparatus according to Embodiments 12-23. In the description of this embodiment, the same reference numerals as in Embodiment 1 are assigned to the elements having the corresponding functions in this embodiment, and the detailed description of the general arrangement of the image forming apparatus 300 is omitted for simplicity.

(Structure of Control System)

FIG. 14 is a block diagram of an example of the control system of Embodiments 12-23. In the description of this embodiment, the same reference numerals as in Embodiment 1 are assigned to the elements having the corresponding functions in this embodiment, and the detailed description thereof is omitted for simplicity.

The image forming apparatus 300 comprises CPU301, RAM 302, ROM 303 and so on for controlling the operation of the image forming apparatus 300.

The CPU301 functioning as a controller carries out a basic control of the image forming apparatus 300 by executing control programs stored in the ROM 303. The operation of the flow chart which will be described hereinafter is carried out by the CPU301 using the control programs stored in the ROM 303. The CPU301 uses the RAM 302 as a work area for executing the processing of the control program.

The CPU301 is electrically connected with the RAM 302 and the ROM 303, and various mechanisms to be controlled.

An external I/F portion 304 is a communication circuit for communication with an external device connected through network (LAN and/or WAN). The external device may include a personal computer PC or a storing device 200 or the like.

Storing device 200 is an example of the external device connected with external I/F through the network. The detailed description will be made as to Embodiment 14.

The CPU301 is connected with an opening and closing sensor 305 to detect whether or not the front door 140 is closed.

The sensor group 306 including sensors 153, 155, 173 and 175 shown in FIG. 1 is disposed along the feeding path, by which the CPU301 detects the presence, absence and passing of the recording material.

The CPU301 is connected with a timer 307. The timer 307 counts the time. It is used to count the time in the jam detection and in the cleaning operation.

The CPU301 is connected with the clock 313.

The CPU301 is connected with an operating portion 180. The CPU301 receives the instructions of switching of the display content on the display screen and other operations, given by the operator at the selection keys of the operating portion 180. The CPU301 displays, on the display screen of the operating portion 180, the status of operation of the image forming apparatus 100, an operation mode selected by the selection key, and so on.

The CPU301 is connected with a feeding portion 308 to control feeding of the recording material 102. The feeding portion 308 includes a supply portion for supplying the recording material 102 from the recording material accommodating portion 103 to the feeding path, and flappers (flappers 131, 132, 133 shown in FIG. 1) for the feeding paths.

The CPU301 is connected with the image forming station 309 which will be described hereinafter to control the image forming station 309.

The CPU301 is connected with a first resistance detecting portion 1310 which will be described hereinafter, and discriminates the first fixing device 150 mounted in the image forming apparatus 300. When the first fixing device 150 is mounted in the image forming apparatus 300, the first resistance detecting portion 1310 is electrically connected with a resistor 1154 of the first fixing device 150.

The CPU301 is connected to a second resistance detecting portion 1311 to discriminate a second fixing device 170 mounted in the image forming apparatus 300. When the second fixing device 170 is mounted in the image forming apparatus 300, the second resistance detecting portion 1311 is electrically connected with the resistor 1174 of the second fixing device 170.

The CPU301 is connected with a main assembly memory 312. The main assembly memory 312 is rewritable non-volatile memory and may be integral with the RAM 302.

The CPU301 is connected with a mechanism group X of the first fixing device 150 mounted in the image forming apparatus 100 to effect a temperature adjustment control and cleaning control for the first fixing device 150. The mechanism group X includes a temperature sensor 320, a heater 321, a moving mechanism 322, a motor 323 and a solenoid 324, a web mounting and demounting mechanism 325.

The temperature sensor 320 includes a plurality of temperature sensors provided in the first fixing device 150, including and a thermister 162 (FIG. 3), and a thermister (unshown) for the pressing belt 152.

The heater 321 includes a plurality of heater provided in the first fixing device 150, including a halogen heater 161 (FIG. 3), a halogen heater (unshown) provided in the heating roller 163.

The CPU301 is connected with a mechanism group X of the second fixing device 170 mounted in the image forming apparatus 100 to effect temperature adjustment control and cleaning control for the second fixing device 170. The mechanism group X for the second fixing device 170 is substantially the same as the mechanism group X of the first fixing device 150, and therefore, the detailed description thereof is omitted by applying the same reference numerals to the corresponding elements. (in the description of the mechanism group X for the first fixing device 150, the first fixing device 150, the pressing belt 152, the heating roller 163 corresponds to the second fixing device 170, the pressing roller 172, the pressing roller 172, respectively).

In this embodiment, the mechanisms are controlled by the CPU301. Alternatively, however, the use can be made with the CPU circuit portions for controlling the respective mechanisms and a main CPU circuit portion connected with the respective CPU circuit portions to effect the overall control.

The image forming apparatus 100 comprises stations 120, 121, 122 and 123 as the image forming station 309 (FIG. 2), an intermediary transfer belt 115 as an intermediary transfer member, and a transfer roller 116 as a transfer portion.

(Fixing Portion)

(Tandem Fixing)

The first fixing device 150 and the second fixing device 170 as the fixing portion fix the toner image transferred onto the recording material 102 by applying heat and pressure to the recording material 102.

The second fixing device 170 is disposed downstream of the first fixing device 150 with respect to the feeding direction of the recording material 102. The second fixing device 170 functions to provide the toner image fixed on the recording material 102 by the first fixing device 150 with desired glossiness, to supplement the heat quantity for a large basis weight recording material (thick sheet, for example) which requires a large amount of heat for the fixing operation.

On the other hand, in the case that the heat by the first fixing device 150 is enough to fix the image, it is unnecessary to use the second fixing device 170, and therefore, the recording material 102 is fed into the feeding path 130 bypassing the second fixing device 170, for the purpose of saving the energy consumption. For example, this occurs in the case that the recording material 102 is plain paper or thin sheet, and high glossiness is not desired. As to whether to feed the recording material 102 into the second fixing device 170 (tandem fixing route) or to feed the recording material 102 bypassing the second fixing device 170 (bypass route), the CPU301 controls by switching the flapper 131.

(Structure of Fixing Device)

The first fixing device 150 and the second fixing device 170 are detachably mountable to the first mounting portion 141 and the second mounting portion 142 (mounting portion) of the image forming apparatus 100, respectively. The first fixing device 150 and a second fixing device 170 can be replaced with the fixing devices having the following structures, respectively.

The first fixing device 150 is provided with the resistor 1154 as a discrimination portion. The second fixing device 170 is provided with the resistor 1174 as a discrimination portion. The details will be described hereinafter.

FIG. 3 is a sectional view of an example of a fixing portion. In the description of this embodiment, the same reference numerals as in Embodiment 1 are assigned to the elements having the corresponding functions in this embodiment, and the detailed description thereof is omitted for simplicity.

(Jam Clearance Operation)

The operation upon the occurrence of sheet jamming in the image forming apparatus 300 will be described.

The jamming in the fixing portion means the state in which the recording material 102 stagnates in the first fixing device 150 and/or the second fixing device 170 as a result of the occurrence of jammed sheet or sheets.

For example, it is the case in which the jamming occurs in the first fixing device 150, or the case in which the recording material 102 stagnates in the first fixing device 150 because of jamming of another sheet in a part of the image forming apparatus 300 other than the first fixing device 150. In addition, for example, it is the case in which the recording material 102 stagnates in the first fixing device 150 because of the operator opening the door (front door 140, for example) of the main assembly of the image forming apparatus 300 during the fixing operation of the first fixing device 150, resulting in the operation stop of the image forming apparatus 300. The same applies to the second fixing device 170.

The description will be made in detail, taking the first fixing device 150 as an example.

The description applies also to the second fixing device 170, and therefore, the description about the second fixing device 170 will be omitted for the sake of simplicity. (the structures of the first fixing device 150 apply to the structures of the second fixing device 170).

When the CPU301 detects the occurrence of the sheet jamming in image forming apparatus 300 on the basis of the signals from the sensor group 306 including sensors 153, 155 in the image forming apparatus 300, it stops the image forming operation of the image forming apparatus 300. If, at this time, the recording material 102 is in the first fixing device 150, the jamming is that in the fixing portion. Thus, the jamming in the fixing portion occurs as a result of the jamming in the part other than the first fixing device 150. Thereafter, the CPU301 displays the position where the recording material 102 stagnates on the operating portion 180 to prompt the operator to remove the jammed sheet. The jamming in the fixing portion of the first fixing device 150 is simply called as the jamming in the first fixing device 150 (or jamming in the fixing device).

The sensors 153, 155 as the jam detecting portion detect presence or absence of the recording material 102 in the first fixing device 150. They are optical sensors, for example. The CPU301 receives the signals from the sensors 153 and/or 155 to detect that a recording material 102 stagnates in the first fixing device 150 (jamming in the fixing portion). For example, the CPU301 discriminates the stagnation of a recording material 102 between the sensors 155 and 153 in the case that the downstream side sensor 153 does not detect the passage of the recording material 102 after elapse of a predetermined time period after the upstream side sensor 155 detects the passage of the recording material 102. The elapse of the time is counted by the timer 307.

When the recording material 102 stagnates in the first fixing device 150, the operator opens the front door 140 and draw the first fixing device 150 out of the image forming apparatus 300, and then remove the recording material 102. After removing the stagnating recording material 102, the operator returns the first fixing device 150 into the image forming apparatus 300 and closes the operator.

The CPU301 detects the closing of the front door 140 on the basis of the signal from the opening and closing sensor 305.

After the CPU301 detects the closing of the front door 140, the CPU301 checks the conduction state between the image forming apparatus 300 and the first fixing device 150, by which the mounting of the first fixing device 150 in the image forming apparatus 300 is checked.

More particularly, the image forming apparatus 300 is provided with an ammeter, an output of which is monitored by the CPU301, thus permitting the current detection. When the first fixing device 150 is mounted in the image forming apparatus 300, the ammeter and the first fixing device 150 are electrically connected. By this, the ammeter can detect the current flowing through the first fixing device 150 when a regular voltage is applied to the first fixing device 150. If the current flows through the ammeter when the regular voltages applied to the first fixing device 150, it means that the image forming apparatus 300 and the first fixing device 150 are electrically connected with each other, and therefore, the CPU301 discriminates that the first fixing device 150 is mounted in the main assembly. On the other hand, if the current does not flow through the ammeter despite the application of the regular voltage to the first fixing device 150, means that the image forming apparatus 300 and the first fixing device 150 are not electrically connected with each other, and therefore, CPU301 discriminates that the first fixing device 150 is not mounted in the main assembly of the apparatus. The measurement of the current by the ammeter may involve the direction of the resistance of the resistor 1154 which will be described hereinafter.

The method for discrimination (confirmation) as to whether or not the first fixing device 150 is mounted in the main assembly is not limited to the above-described method.

For example, a signal output portion (memory or CPU, for example) for outputting a signal in accordance with the input signal from the CPU301 is provided on the first fixing device 150. After the front door 140 is closed, the CPU301 inputs the signal to the signal output portion. The CPU301 may detect the mounting of the first fixing device 150 by detecting the signal outputted in response to the signal input to the signal output portion. If the CPU301 does not detect the signal to be outputted in response to the input of the signal to the signal output portion, it discriminates that the first fixing device 150 is not mounted.

Further alternatively, a sensor outputting a signal when the first fixing device 150 is mounted may be provided in the image forming apparatus 300, and the CPU301 detects the mounting of the first fixing device 150 on the basis of the signal from such a sensor.

Then, the CPU301 checks the presence or absence of the recording material 102 stagnating in the first fixing device 150 on the basis of the signals from the sensors 153, 155. At this time, the CPU301 discriminates that the jam clearance operation has been completed if the recording material 102 does not stagnate in the first fixing device 150.

If the jamming in the first fixing device 150 occurs, that is, a recording material 102 stagnates in the first fixing device 150, the fixing roller 151 is likely to be contaminated with the unfixed toner on the stagnating recording material 102. More particularly, this occurs when the recording material 102 stagnates while being wound around the fixing roller 151, or when the recording material 102 rubs the fixing roller 151 when the operator removes the stagnating recording material 102.

Therefore, the CPU301 executes a cleaning process, which will be described hereinafter, for the first fixing device 150, after confirming the completion of the jam clearance operation for the first fixing device 150.

(Cleaning Process after the Jam Clearance)

The cleaning process for the fixing portion executed by the CPU301 as the executing portion after the removal of the jammed sheet from the fixing portion is the same as that in Embodiment 1, and therefore, the description is omitted.

The counting of the winding time of the web 160 may be made by the CPU301 counting the clock signals of the clock 313.

(Warming-up Process)

After the completion of the cleaning process for the fixing portion, the CPU301 executes the warming-up process in preparation for the start of the fixing process. The warming-up process is executed also when the main switch 101 of the image forming apparatus 300 is actuated, and is not limited to the state after the cleaning process. The details of the warming-up process are the same as that in Embodiment 1, and therefore, the description is omitted.

(Resumption of Job)

After the image forming apparatus 300 is enabled to start the image forming operation after the completion of the warming-up process for the first fixing device 150, the CPU301 resumes the printing operation interrupted due to the occurrence of the jamming. The CPU301 displays "printing" in the operating portion (notifying portion) 180.

If the part or parts other than the first fixing device 150, the image forming stations 309, for example are not completed for the resumption even if the warming-up process operation of the first fixing device 150 has been completed, the CPU301 waits for the completion of the part or parts, and then resumes the printing operation.

The same applies to the second fixing device 170.

(Stand-by Mode)

The stand-by mode means the state in which the image forming apparatus 300 is in the state capable of starting of the image forming operation and waits for the printing instructions (printing job) by the operator. If there is no job to be resumed after the completion of the above-described warming-up process, or after the completion of the printing operation, the apparatus becomes in the stand-by mode.

When the image forming apparatus 300 is enabled to start the image forming operation, the CPU301 displays "printable" on the operating portion (notifying portion) 180.

In this embodiment, in the stand-by mode, the temperature control for the first fixing device 150 and the second fixing device 170 (the fixing roller 151 and pressing belt 152, for example) is continued so that the printing operation can be started as soon as the printing job is received.

If a printing operation is reserved during the warming-up process operation, the reserved printing job is executed without entering the stand-by mode. That is, in such a case, when the state of the image forming apparatus 300 becomes capable of starting the image forming operation after the completion of the warming-up process operations for the first fixing device 150 and the second fixing device 170, the printing job is immediately started without entering the stand-by mode.

If the part or parts other than the first fixing device 150 or the second fixing device 170, the image forming stations 309, for example are not completed for the resumption even if the warming-up process operation of the first fixing device 150 and the second fixing device 170 have been completed, the CPU301 waits for the completion of the part or parts, and then resumes the printing operation.

(Exchange of Fixing Device)

The exchanging system of the fixing device will be described.

The image forming apparatus 300 is capable of printing on various kinds and sizes of the recording material 102. In order to provide high quality prints, in the image forming apparatus 300 of this embodiment, the fixing device can be exchanged depending on the kinds of the recording material 102 or the preference of the operator.

For example, when the recording material 102 is an envelope, the fixing device exclusively for the envelope is used. The envelope is easily creased by the pressure applied during the fixing process. Therefore, it is desirable to use a fixing device adjusted in the pressure between the fixing roller 151 and the pressing belt 152 (nip pressure) particularly for envelopes.

As another example, there is a fixing device particularly for a specific width size. When the same width recording materials 102 continuously pass the nip, the surface of the fixing roller 151 is damaged at the widthwise edge portions of the recording materials 102. If the damage of the fixing roller 151 becomes intolerable level, the glossiness of the image becomes uneven due to the damage when a larger width recording material 102 is processed. In order to prevent this, the same structure fixing devices may be used exclusively for respective sizes of the recording materials 102. (here, the width is the dimension measured in the direction perpendicular to the feeding direction of the recording material 102 (longitudinal direction of the fixing roller 151).

The same applies to the second fixing device 170.

Thus, according to the image forming apparatus 300 of this embodiment, the operator can exchange the fixing device depending on the kinds of the recording materials 102 or preferences of the operator.

When the fixing device is exchanged, the operator opens the front door 140 to take the mounted fixing device out of the image forming apparatus 300. Then, the operator mounts another fixing device into the image forming apparatus 100, and closes the front door 140. In this embodiment, the first fixing device 150 and the second fixing device 170 are exchangeable, respectively.

(Discrimination Portion of Fixing Device and Main Assembly Memory)

Because the fixing device replaceable system is employed in this embodiment, the first fixing device 150 is provided with a resistor 1154 as the discrimination portion, and the second fixing device 170 is provided with a second resistor 1174 as the discrimination portion.

The resistor as the discrimination portion is also provided on the fixing device prepared for the replacement fixing device outside the image forming apparatus 300, not only on the first fixing device 150 and the second fixing device 170 already mounted in the image forming apparatus 300.

The resistors of the first fixing device 150 and the second fixing device 170 and the replacement fixing device have different resistance values for identification.

In the state that the first fixing device 150 is mounted in the image forming apparatus 300, the CPU301 detects the current flowing through the resistor 1154 when the regular voltage is applied to the resistor 1154. More particularly, the image forming apparatus 300 is provided with the ammeter as a first resistance detecting portion 1310, the ammeter being effective to detect the current flowing between the resistor 1154 and the voltage application portion at which the regular voltage is applied to the resistor 1154. The CPU301 monitors the output of the ammeter.

When the regular voltage is applied, the current corresponds to the resistance value one by one because of the Ohm's law. The CPU301 acquires an output of the ammeter predetermined resistance of the resistor 1154. The first fixing device 150 and the replacement fixing device have the resistors having different resistance values, and therefore, the CPU301 is capable of discriminating the fixing device depending on the difference of the output of the ammeter. Thus, the resistance value is the identifying information.

In the following, the discrimination of the first fixing device 150 on the basis of the resistance of the resistor 1154 by the CPU301 is called "discrimination (acquirement) of ID of the first fixing device 150 (fixing device)" in the following description.

The structure of the second resistance detecting portion 1311 is the same as that of the first resistance detecting portion 1310, and therefore, the description thereof is omitted. In addition, the same applies to the second fixing device 170, and therefore, the description is omitted.

The image forming apparatus 300 is provided with a main assembly memory 312 as a storing portion. The main assembly memory 312 is a rewritable non-volatile memory such as an EEPROM, a flash memory or the like. Here, the resistors are provided on the fixing device group including the first fixing device 150 and the second fixing device 170 to solve the problem. The problem arises when fixing device is once taken out of the apparatus without executing the cleaning process after the jam clearance in the fixing portion, and then the fixing device is remounted in the image forming apparatus 100. The following description will be made taking the first fixing device 150 as an example, but the same applies to the second fixing device 170.

More particularly, the following situation may occur. That is, the fixing device to be replaced is the first fixing device 150.

For example, the first fixing device 150 currently mounted in the apparatus is not the one exclusively for the envelopes, and a printing job (on the plain paper sheets, for example) which requires more than one hour to complete starts. It is assumed that 15 minutes after the start of the printing job (initial stage), sheet jamming occurs in the fixing device A. The operator then executes jam clearance operation in accordance with the display of the operating portion 180. However, if an urgent printing job on the envelopes may be required, the operator interrupts the previous printing job by the fixing device A, and may start the printing on the envelopes. The operator may omit the cleaning process and replace the fixing device A with the fixing device B exclusively for the envelopes.

Conventionally, the CPU stores the occurrence of the jam in the fixing portion in the memory provided in the main assembly of the image forming apparatus, so that the cleaning process is carried out after the jam clearance operation. In this case, if the fixing device A is replaced with the fixing device B after the jam clearance operation, the CPU executes the cleaning process operation only for the new fixing device B. Thus, the CPU discriminates the completion of the cleaning process to be executed after the jam clearance operation for the fixing portion.

When the operator prints on the recording material (plain paper sheets, for example) other than the envelopes some days later, the operator remounts the fixing device A. The fixing roller of the fixing device A not having been subjected to the cleaning process remains contaminated with the toner. If the printing operation is carried out in the state, the image quality is significantly deteriorated.

Therefore, in this embodiment, the resistor 1154 is provided on the first fixing device 150. The information indicative of whether or not the cleaning process to be executed after the jam clearance operation for the fixing portion is stored in the main assembly memory 312 in combination with the ID of the fixing device.

In the above-described situation, for example, the fixing device A is provided with a resistor having a resistance value R1, and the fixing device B provided with a resistor having a resistance value R2 which is different from the resistance value R1. As shown in FIG. 19, the main assembly memory 312 in the jam hysteresis information, that is, "hysteresis yes" or "hysteresis no" is stored in combination (correlation) with the ID of the fixing device. More particularly, when the sheet jamming occurs in the first fixing device 150, the jam hysteresis ("hysteresis yesterday") is stored in the main assembly memory 312 in combination with the ID of the fixing device. When the cleaning process is executed after the jam clearance operation for the fixing portion, the CPU301 clears the jam hysteresis for the fixing device correlated with the ID stored in the main assembly memory 312. The jam hysteresis "yes" is indicative that the cleaning process operation has not been executed, and "no" is indicative that the cleaning process operation has been executed.

When the first fixing device 150 is remounted by the operator, thus CPU301 acquires the fixing device ID from the remounted first fixing device 150. The CPU301 then acquires from the main assembly memory 312 the cleaning information indicative of whether or not the cleaning process has been completed, for the fixing device ID acquired from the first fixing device 150. If the information acquired from the main assembly memory 312 indicates that the cleaning process has not yet been executed, the CPU301 executes the cleaning process which should have been executed after the jam clearance operation.

If, on the other hand, the information stored in the main assembly memory 312 indicates otherwise, the CPU301 discriminates "hysteresis no".

The method of writing information in the main assembly memory 312 is not limited to that described above, but "yes" may indicates that the cleaning process has not been executed, and "no" may indicates that the cleaning process has been executed. Further alternatively, the data indicative of non-completion of the cleaning process or the data indicative of completion of the cleaning process may be stored.

The method of writing (recording) of the fixing device ID in the main assembly memory 312 is not limited to that described above. For example, the main assembly memory 312 stores a Table indicating the correspondence between names of the fixing devices and the resistance values of the resistors 1154, and the cleaning information is stored relative to the name of the fixing device (fixing device A, for example).

In addition, the CPU301 may acquire the output of the ammeter, which may be used as the identifying information without determining the resistance value of the resistor 1154. That is, the CPU301 may record the output of the ammeter as the ID of the fixing device.

Furthermore, the main assembly memory 312 may store the information other than the jam hysteresis. For example, the information includes usage or kind of the first fixing device 150 (envelope, A4 size, for example). When the fixing device mountable to the first mounting portion 141 and the fixing device mountable to the second mounting portion 142 are different from each other, the information indicative of mountability to the first mounting portion 141 or the second mounting portion 142 may be stored.

The main assembly memory 312 may store the information for a plurality of fixing devices. FIG. 19 shows the case of two fixing devices.

In this embodiment, the discrimination portion includes a resistor, but the discrimination method is not limited to the above-described examples. For example, DIP switches are usable as the discrimination portion provided on the fixing device (first fixing device 150, second fixing device 170 and replacement fixing device). In such a case, the switches differ depending on whether the fixing devices are in an ON state beforehand (the on-off state and position of the switches are different depending on the fixing devices). The CPU301 is connected with the DIP switch of the fixing device mounted in the image forming apparatus 300, and the switch in the ON state produces a signal to the CPU301 in response to an input signal from the CPU301. The CPU301 detects the signal from the ON state switch (acquires the fixing device ID) to discriminate the fixing device. For example, when the CPU301 supplies signals to the first and second switches, and detects the output signal from the first switch, the CPU301 discriminates it is the fixing device A, and when the CPU301 detects the output signal from the second switch, it is the fixing device B, and when the CPU301 detects the signals from both of the first and second switches, it is the fixing device C.

As another method for discriminating the fixing device from the replacement fixing device, the discrimination portion on the fixing device (first fixing device 150, second fixing device 170, replacement fixing device) may be a memory starring the discrimination name (identifying information) of the fixing device. In such a case, the memory is a rewritable non-volatile memory such as EEPROM, flash memory or the like. The CPU301 is connected with the memory of the fixing device mounted in the image forming apparatus 300, and the CPU301 discriminates the fixing device by reading the discrimination name of the fixing device stored in the memory (by acquiring the fixing device ID).

(Control Flow)

The description will be made in conjunction with the flow charts of FIGS. 15-18. The operations of the flow charts are carried out by the CPU301 functioning as the executing portion (recording portion, writing portion) controlling the related mechanisms of the image forming apparatus 300 in accordance with the control program stored in the ROM 303. The description will be made as to the first fixing device 150, but the same applies to the second fixing device 170.

(Sequence Upon Actuation of the Main Switch and Upon Closing the Front Door)

FIG. 15 is a flow chart showing the operations from the actuation of a main switch to a stand-by mode.

With the actuation of the main switch 101, the CPU301 starts. The CPU301 discriminates whether or not the first fixing device 150 is mounted in the image forming apparatus 300 (S10101). If the first fixing device 150 is mounted, the CPU301 is capable of acquiring the ID of the first fixing device 150. If the result of the discrimination at the step is negative, the operation returns to the step S10101. If the first fixing device 150 is mounted in the image forming apparatus 300, the operation proceeds to the step S10102.

The CPU301 executes the start-up sequence 3 shown in FIG. 17, for the first fixing device 150 (S10102). The detail of the operation will be described hereinafter.

After the completion of the start-up of the first fixing device 150, the CPU301 displays "printable" on the operating portion 180 to notify the operator that the image forming apparatus 300 can form the image (S10103). Then, the operation enters the stand-by mode.

FIG. 16 is a flow chart showing the operations from the state in which a front door is open to the stand-by mode.

The opened and closed states of the front door 140 are detected by the CPU301 on the basis of the signal from the opening and closing sensor 305 of the front door 140. When the front door 140 is open, the CPU301 waits for the closing of the front door 140 (S10201). When the front door 140 is open, the CPU301 may display information to prompt to close the front door 140. When the CPU301 detects the closing of the front door 140 (S10201), the operation proceeds to step S10202. Steps S10202-S10204 are the same as the steps S10101-S10103 of FIG. 15, and therefore, the description thereof is omitted. After the step S10204, the operation proceeds to the stand-by mode.

(Start-up Sequence)

FIG. 17 is a flow chart of the start-up sequential operations. The flow chart of FIG. 17 shows details of the steps S10102, S10203 and a step S10410 which will be described hereinafter.

The CPU301 first acquires the ID of the first fixing device 150 mounted to the image forming apparatus 300 (S10301). The details of the acquiring method for the ID have been described hereinbefore.

Then, the CPU301 acquires the information of the main assembly memory 312 (S10302).

When the main assembly memory 312 stores the information (jam hysteresis information) for the ID of the first fixing device 150 acquired in the step S10301, the CPU301 proceeds to step S10304 (Yes, in S10303). In the case that the jam hysteresis for the ID of the first fixing device 150 has been cleared, the CPU301 discriminates that the main assembly memory 312 stores the jam hysteresis information (no hysteresis) for the ID of the first fixing device 150, and the proceeds to step S10304 (S10303).

When the jam hysteresis for the ID of the first fixing device 150 acquired in the S10301 is "hysteresis yes" in the main assembly memory 312, the operation proceeds to step S10305 (S10304).

The CPU301 controls the cleaning portion or the like to execute the above-described cleaning process operation (S10305).

After the completion of the cleaning process, the CPU301 clears the jam hysteresis for the first fixing device 150 stored in the main assembly memory 312 (S10306).

In the step S10304, if the main assembly memory 312 does not store the jam hysteresis for the ID of the first fixing device 150 acquired in the S10301 (jam hysteresis as being cleared), the operation proceeds to a step S10307 without executing the cleaning process. In the case of no jam hysteresis in the main assembly memory 312, it means that the cleaning process operation has been executed. By not executing the cleaning process when it is unnecessary, the time from the actuation of the main switch 101 to the state in which the image forming apparatus 300 becomes capable of performing the image can be reduced (by the time (100 sec) required by the cleaning process operation.

The CPU301 controls the first fixing device 150 to carry out the above-described warming-up process (S10307).

When it is not possible to acquire from the main assembly memory 312 the information (jam hysteresis information) for the ID of the first fixing device 150 acquired in the step S10301 (No, in S10303), the CPU301 proceeds to a step S10308. If, for example, the information stored in the main assembly memory 312 is only for the fixing device A and the fixing device B, and the ID of the first fixing device 150 acquired in the step S10301 is a fixing device C (resistance value R3) as shown in FIG. 19, the CPU301 proceeds to a step S10308.

In this step S10308, the CPU301 stores the ID of the first fixing device 150 and the jam hysteresis in combination, in the main assembly memory 312. In such a case, the CPU301 proceeds to a step S10305, assuming that the jam hysteresis is "yes".

The reason why the cleaning process is executed in S10305 in the case of "No" of the results of the discrimination in the state S10303 will be described.

In the case that the information of the jam hysteresis acquired in the step S10301 for the ID of the first fixing device 150 is not stored in the main assembly memory 312, it is predicted that the first fixing device 150 is first mounted to the image forming apparatus 300. In the replaceable fixing device system, it is likely that the first fixing device 150 for which the cleaning process to be executed after the jam clearance operation has not been executed is mounted in the main assembly of the image forming apparatus, under the following situation.

The user has two image forming apparatuses 300 (image forming apparatus M and image forming apparatus N) and ordinarily uses the fixing device A which is usable with both of the image forming apparatuses M, N as the first fixing device 150. The fixing device A has never been mounted in the image forming apparatus N, and the main assembly memory of the image forming apparatus N does not store the jam hysteresis information of the fixing device A. It is assumed that the operator takes the fixing device A out of the image forming apparatus M without execution of the cleaning process to be executed after the jam clearance operation in the fixing device A. Some days later, the operator may mount the fixing device A in the image forming apparatus N not the image forming apparatus M.

Even in such a situation, the cleaning process is carried out for the fixing device A mounted in the image forming apparatus N, according to this embodiment.

Therefore, even when the first fixing device 150 is first mounted in the image forming apparatus 300, the deterioration of the image quality of the prints can be reduced.

In this embodiment, if the result of the discrimination in the S10303 is "No", the CPU301 proceeds to the step S10308, but this is not limiting to the present invention. The CPU301 may proceed to a step S10305 to carry out the cleaning process, if the result of discrimination of S10303 is "No". In such a case, the CPU301 records in the main assembly memory 312 the ID of the first fixing device 150 and the jam hysteresis (no hysteresis, no data) in combination, in step S10306.

In this embodiment, in the state S10308, the CPU301 stores the ID of the first fixing device 150 and the jam hysteresis in combination in the main assembly memory 312, but the following structure is usable. In the case that the ID of the first fixing device 150 and the jam hysteresis are stored in the main assembly memory 312 in combination, the previous information stored in the main assembly memory 312 may be deleted (overwriting the previous information).

More particularly, in the step S10306, S10308 or S10408, simultaneously with the writing of the information (cleaning information) indicative of whether or not the cleaning process has been executed, the CPU301 records the current time of the clock 313 in combination with the ID of the fixing device.

The description will be made, taking the case that two areas of the main assembly memory 312 are available, as an example. It is assumed that the main assembly memory 312 already stores the information for the fixing device A (time is 2015-01-01 14:00) and the fixing device B (time is 2012-01-01 7:00). When the ID of the first fixing device 150 acquired in the step S10301 indicates the fixing device C, the CPU301 proceeds from S10303 to S10308. The CPU301 delete the piece of information (older one of the pieces of the information for the two fixing devices), that is, the information for the fixing device B (the ID of the fixing device, the jam hysteresis and the time), and records the information (the ID of the fixing device, the jam hysteresis and the time) in the main assembly memory 312 (S10308).

In this case, if the main assembly memory 312 can afford to stored information for the fixing device C (two areas are available for recording, for example), and the information only for the fixing device A is stored, the information already stored is not deleted.

In this embodiment, the time to be stored is the time at which the cleaning information is written in the main assembly memory 312, but the time may be the following. When the jam hysteresis is recorded in the step S10308 or a step S10408 which will be described hereinafter, the time at which the jam in the fixing portion occurs is stored, and when the jam hysteresis is cleared in the step S10306, the time at which the cleaning process is completed is recorded.

By deleting the oldest information in the main assembly memory 312, the required area of the main assembly memory 312 can be efficiently reduced.

As to the timing of clearing the jam hysteresis from the main assembly memory 312 in the step is not limited to that described above. For example, with the completion of the warming-up process (S10307), the jam hysteresis stored in the main assembly memory 312 may be cleared.

In addition, the jam hysteresis stored in the main assembly memory 312 may be cleared in S10306, with the CPU301 detecting the opening of the front door 140 on the basis of the signal from the opening and closing sensor 305, provided that the cleaning process has been completed. Furthermore, the jam hysteresis may be cleared from the main assembly memory 312 in the step S10306 with the deactuation of the main switch 101, provided that the cleaning process has been executed. This is because the exchange of the first fixing device 150 requires opening of the front door 140.

(Sequence Upon Jam Occurrence)

FIG. 18 is a flow chart of the operations at the time when sheet jamming occurs in the fixing device. More particularly, it is a flow chart in the printing job execution of the image forming apparatus 300.

In the stand-by mode in which the image forming operation of the image forming apparatus 300 is possible, a printing job is received from the operating portion 180 or an external PC through an external I/F portion 304. Then, the CPU301 controls various mechanisms of the image forming apparatus 300 including the stations 120-123, the first fixing device 150 and the second fixing device 170, so that the image forming operation of the image forming apparatus 300 is started (S10401). At this time, the image forming apparatus 300 provides a selection screen for selecting the kind of the recording material 102 on the display screen of the operating portion 180 or the external PC to receive the operator's instruction.

After the completion of the printing job, the CPU301 places the image forming apparatus 300 in the stand-by mode (S10402).

If the CPU301 detects the occurrence of the sheet jamming in the image forming apparatus 300 before the completion of the printing job (S10402) (S10403), the image forming operation of the image forming apparatus 300 is stopped, that is, the printing job is interrupted. The CPU301 detects the occurrence of the jamming in the image forming apparatus 300 on the basis of the signals from the sensor group 306.

When no jamming in the image forming apparatus 300 is detected, the CPU301 continues the execution of the printing job up to the end of the printing job (S10402, S10403).

When the position of the stagnation of the recording material 102 as a result of the jamming is outside the first fixing device 150 (second fixing device 170), the CPU301 proceeds to a step S10406 (S10405). The CPU301 waits for the removal of the stagnating recording material 102 on the basis of the signals from the sensor group 306. When the CPU301 detects the removal of the stagnating recording material or recording materials 102 on the basis of the signals from the sensor group 306, the CPU301 executes the above-described warming-up process.

On the other hand, if the CPU 301 discriminates that the position of stagnation of the recording material 102 is in the first fixing device 150 (second fixing device 170) (fixing portion jam), the operation proceeds to a step S10408 (S10405).

The CPU301 records in the main assembly memory 312 the jam hysteresis in combination with the ID of the first fixing device 150 mounted in the image forming apparatus 300 (S10408). The ID of the first fixing device 150 mounted on the image forming apparatus 300 has been acquired by the CPU301 in the above-described start-up sequence 3 executed with the actuation of the main switch, the closing of the front door 140 or the jam clearance operation (S10301 of FIG. 17).

The recording of the jam hysteresis in the main assembly memory 312 by the CPU301 may be carried out with the opening of the front door 140.

As described hereinbefore, the first fixing device 150 is liable to be replaced in the jam clearance operation. In view of this, after the detection of the jamming in the first fixing device 150, the jam hysteresis is recorded in the main assembly memory 312 by the time of removal of the first fixing device 150 for the jam clearance by the operator.

The CPU301 waits for removal of the recording material 102 stagnating in the first fixing device 150, on the basis of the signals from the sensors 153, 155 (S10409). When the CPU301 detects the removal of the recording material 102 stagnating in the first fixing device 150, the operation proceeds to a start-up sequence S10410 (S10409). At this time, the CPU301 detects the closing of the front door 140 on the basis of the signal from the opening and closing sensor 305, and checks presence or absence of the recording material 102 in the first fixing device 150.

The start-up sequence S10410 corresponds to the flow shown in FIG. 17. In the start-up sequence 3 (S10410), the CPU acquires the ID of the first fixing device 150 (S10301) and the information therefor in the main assembly memory 312 (S10302) to check the jam hysteresis for the ID of the first fixing device 150. The jam hysteresis information is checked because there is a possibility that the first fixing device 150 is exchanged at the timing of the opening of the front door 140 for the jam clearance.

When the start-up sequence S10410 of the first fixing device 150 or the warming-up process S10407 is completed, the CPU301 resumes the image forming operation of the image forming apparatus 300, that is, the interruption is released (S10411).

In addition, the CPU301 displays "printing" or the like on the operating portion 180 to notify the operator of the execution of the printing of the image forming apparatus 300.

Thereafter, the operation retunes to step S10402, where the CPU301 continues the execution of the printing job until the end of the job (S10402, S10403).

As described hereinbefore, the exchange of the first fixing device 150 by the operator requires opening and closing of the front door 140 of the image forming apparatus 300. That is, when the front door 140 of the image forming apparatus 300 is opened by the operator, the first fixing device 150 may be exchanged. In addition, the first fixing device 150 may be exchanged during off period of the main switch 101. Therefore, in response to switching-on of the main switch 101 of the image forming apparatus 100 and the closing of the front door 140, the CPU acquires the ID of the first fixing device 150 and the jam hysteresis information for the ID of the first fixing device 150 from the main assembly memory 312 By this, even if the first fixing device 150 not having been subjected to the cleaning process after the jam clearance operation is remounted to the image forming apparatus 300, the cleaning process is executed, and therefore, the deterioration of the image quality can be suppressed.

The description has been made with respect to the first fixing device 150, but the same applies to the second fixing device 170.

[Embodiment 13]

In Embodiment 12, the main assembly memory 312 stores the information indicative of whether or not the cleaning process which is to be executed after the fixing device jam clearance operation has been executed. On the basis of the information, the CPU301 discriminates whether to execute the cleaning process for the remounted fixing device.

The case that the cleaning process operation to be executed after the jam clearance operation in the fixing portion is interrupted will be described, in Embodiment 12. In the description of this embodiment, the same reference numerals as in Embodiment 1 are assigned to the elements having the corresponding functions in this embodiment, and the detailed description thereof is omitted for simplicity.

The description will be further made, taking the first fixing device 150 as an example. The same applies to the second fixing device 170.

When the operator opens the front door 140 during the prosecution of the cleaning process, for example, the CPU301 interrupts the cleaning process. The CPU301 detects the opening of the front door 140 on the basis of the signal from the opening and closing sensor 305.

In Embodiment 12, the jam hysteresis is clear from the main assembly memory 312 after the completion of the cleaning process. Therefore, when the operator takes the first fixing device 150 out of the main assembly at a certain point of time during the execution of the cleaning process, the jam hysteresis in the main assembly memory 312 is not cleared. When the first fixing device 150 is remounted by the operator, the CPU301 executes in the cleaning process from the beginning.

However, if the cleaning process is already executed up to 80 sec of 100 sec at the time when the cleaning process is interrupted, the contamination of the fixing roller 151 with toner has been removed to a quite large extent. Despite the fact, if the cleaning process is executed for 100 sec, the waiting time of the operator is wastefully long.

Under the circumstances, when the first fixing device 150 for which the cleaning process has been interrupted is remounted, a short cleaning process operation (shorter than the cleaning process of Embodiment 12) is carried out.

The main assembly memory 312 is capable of storing three kinds a information including "cleaned", "interrupted" and "no hysteresis", as for the cleaning process (100 sec in this embodiment) to be executed after the jam clearance operation in the fixing portion. In this case, the CPU301 stores the cleaning information in combination with the ID of the first fixing device 150 mounted in the image forming apparatus 300, in the main assembly memory 312. When the information acquired from the main assembly memory 312 for the first fixing device 150 is "no hysteresis" (the data of the cleaning hysteresis has been cleared), the CPU301 discriminates that the cleaning process has not been carried out, and therefore, the above-described cleaning process (100 sec) is executed. On the other hand, when the information acquired from the main assembly memory 312 for the first fixing device 150 is "interrupted", the CPU301 executes the short cleaning process (50 sec in this embodiment) for the period shorter than that of the above-described cleaning process (100 sec). When the information acquired from the CPU301 for the first fixing device 150 is "executed", the CPU301 does not execute the cleaning process or the short cleaning process.

(Control Flow)

The description will be made in conjunction with FIGS. 20-23. The operations of the flow charts are carried out by the CPU301 functioning as the executing portion (recording portion, writing portion) controlling the related mechanisms of the image forming apparatus 300 in accordance with the control program stored in the ROM 303. The description will be made as to the first fixing device 150, but the same applies to the second fixing device 170.

(Start-up Sequence)

The start-up sequence flow in Embodiment 13 is different from that of Embodiment 12. FIG. 20 is a flow chart of the start-up sequential operations. The flow chart of FIG. 20 shows the details of the start-up sequence of step S10610 of FIG. 21 and step S10702 of FIG. 22 and S10803 of FIG. 23.

First, the CPU301 acquires the ID of the first fixing device 150 mounted in the first mounting portion 141 to discriminate the mounted fixing device (S10501). The specific method has been described.

Then, the CPU301 acquires the information of the main assembly memory 312 (S10502).

If the information (cleaning hysteresis information) for the ID of the first fixing device 150 discriminated in the step S10501 is stored in the main assembly memory 312, the CPU301 proceeds to a step S10504 (Yes, in S10503). Also when the cleaning hysteresis for the ID of the first fixing device 150 has been cleared, the CPU301 deems that the cleaning hysteresis of "no" for the ID of the first fixing device 150 is stored in the main assembly memory 312 and proceeds to S10504 (S10503).

When the cleaning hysteresis for the first fixing device 150 stored in the main assembly memory 312 is "executed", the operation proceeds to S10510, and otherwise, the operation proceeds to S10505 (S10504).

If the cleaning hysteresis stored in the main assembly memory 312 for the first fixing device 150 is other than "executed" and is "interrupted", the operation proceeds to S10506 (S10505), the CPU301 executes the above-described short cleaning process (S10506).

If the cleaning hysteresis stored in the main assembly memory 312 for the first fixing device 150 is other than "executed" and is not "interrupted" (not executed), the operation proceeds to S10507 (S10505). The CPU301 controls the cleaning portion to carry out the above-described cleaning process (S10507).

If the cleaning process or the short cleaning process is interrupted during the execution, the CPU301 proceeds to S10511 (S10508). The CPU301 records the cleaning hysteresis indicative of "interrupted" in the main assembly memory 312 in combination with the ID of the first fixing device mounted in the image forming apparatus 300 (S10511). Here, the raising sequence for the first fixing device 150 is interrupted.

If the cleaning process or the short cleaning process is not interrupted (is completed), the CPU301 proceeds to S10509 (S10508). The CPU301 stores the cleaning hysteresis of "executed" in combination with the ID of the first fixing device in the main assembly memory 312 (S10509). Thereafter, the CPU301 controls the first fixing device 150 to carry out the above-described warming-up process (S10510).

By not executing the cleaning process in the case of unnecessity, the time required from the actuation of the main switch 101 to the capable image forming operation can be saved by 100 sec.

In addition, when the short cleaning process is enough, the short cleaning process is carried out. By this, the time from the actuation of the main switch 101 to the enabled image formation of the image forming apparatus 300 can be reduced (by 50 sec).

In the step S10503, if the information (cleaning hysteresis information) for the ID of the first fixing device 150 discriminated in the step S10501 is not stored in the main assembly memory 312 (No, in S10503), the CPU301 proceeds to a step S10512. If, for example, the information stored in the main assembly memory 312 is only for the fixing device A and the fixing device B, and the ID of the first fixing device 150 acquired in the step S10301 is a fixing device C (resistance value R3) as shown in FIG. 19, the CPU301 proceeds to a step S10308.

In S10512, the CPU301 records the cleaning hysteresis in combination with the ID of the first fixing device 150, in the main assembly memory 312. In this case, the cleaning hysteresis is "hysteresis no" (the cleaning hysteresis cleared), and the CPU301 proceeds to the step S10507.

When the cleaning hysteresis information for the ID of the first fixing device 150 discriminated in the step S10501 is not stored in the main assembly memory 312, it is predicted that the first fixing device 150 is first mounted in the image forming apparatus 300. As has been described in connection with Embodiment 12, in the replaceable fixing device system, there is a liability that the first fixing device 150 has not been subjected to the cleaning process operation to be executed after the jam clearance operation in the fixing portion of another image forming apparatus. Therefore, if the information (cleaning hysteresis information) for the ID of the first fixing device 150 discriminated in the step S10501 is not stored in the main assembly memory 312, the CPU301 executes the cleaning process for the first fixing device 150. By this, when it is the first time that the first fixing device 150 is mounted in the image forming apparatus 300, the deterioration of the image quality of the print can be suppressed.

In this embodiment, if the result of the discrimination in the S10503 is "No", the CPU301 proceeds to the step S10512, but this is not limiting to the present invention. The CPU301 may proceed to a step S10507 to carry out the cleaning process, if the result of discrimination of S10503 is "No". If the cleaning process has not been interrupted (has been completed) in this case, the CPU301 stores the cleaning hysteresis (executed) in combination with the ID of the first fixing device 150, in the main assembly memory 312. If, on the other hand, the cleaning process has been interrupted during the executed in this case, the CPU301 stores the cleaning hysteresis (interrupted) in combination with the ID of the first fixing device 150 in the main assembly memory 312 in a step S10511.

The execution time of the short cleaning process may not be a constant time (50 sec), but may be controlled depending on the executed cleaning time until the interruption of the cleaning process. In such a case, the executed cleaning time until the interruption of the cleaning process is counted by a timer 307. With the cleaning hysteresis, the CPU301 stores in the main assembly memory 312 the information relating to the cleaning time of the cleaning process operation (or short cleaning process operation) before the interruption, in combination with the ID of the first fixing device (S10511). The CPU301 reads the information relating to the cleaning time with the cleaning hysteresis from the main assembly memory 312 (S10502), and the short cleaning process is executed for the period determined on the basis of the stored executed cleaning time (S10506).

At this time, the period of the time of the short cleaning process is not necessarily the difference between the cleaning process time without interruption and the cleaning time up to the interruption. For example, when the cleaning process of 100 sec is interrupted at the timing at less than 50 sec, the short cleaning process may be executed for 80 sec, and when the cleaning process is interrupted more than 50 and less than 100, the short cleaning process may be carried out for 30 sec.

If the executed cleaning process operation is less than a predetermined level, the cleaning process may be fully executed from the beginning, by the CPU301 keeping the cleaning hysteresis cleared in step S10511.

When the first fixing device 150 for which the cleaning process has been interrupted is remounted, the operator may determine whether to execute the short cleaning process or not. That is, the apparatus may be constructed in such that the operator is capable of selecting a mode in which the cleaning operation is carried out from the beginning as in Embodiment 13 or a mode in which the short cleaning process is carried out as in Embodiment 13. The operating portion 180 displays these modes on the screen to permit the operator to select one of them. If the selected mode is the former mode, and the cleaning process operation is interrupted, the CPU301 keeps the cleaning hysteresis cleared to execute the cleaning process from the beginning in step S10511.

(Sequence Upon Jam Occurrence)

FIG. 21 is a flow chart of the operations at the time when sheet jamming occurs in the fixing device. More particularly, it is a flow chart during the execution of the printing job execution of the image forming apparatus 300.

As to steps S10601-S10607, they are the same as the steps S10401-S10407 of FIG. 18, and therefore, the description is omitted.

In S10608, the CPU301 clears the cleaning hysteresis stored in the main assembly memory 312 in combination with the ID of the first fixing device 150 mounted in the image forming apparatus 300. By this, the cleaning hysteresis becomes "no hysteresis" which indicates the non-execution of the above-described cleaning process. The ID of the first fixing device 150 mounted on the image forming apparatus 300 has been acquired by the CPU301 in the above-described start-up sequence 4 executed with the actuation of the main switch, the closing of the front door 140 or the jam clearance operation (S10501 of FIG. 20).

A step S10609 is the same as the S10409 of FIG. 18, and therefore, the description thereof is omitted.

In a step S10610, the CPU301 executes the start-up sequence 4 of FIG. 20.

As to steps S10611-S10612, they are the same as the steps S10411-S10412 of FIG. 18, and therefore, the description is omitted.

(Sequence Upon Actuation of the Main Switch and Upon Closing the Front Door)

FIG. 22 is a flow chart showing the operations from the actuation of a main switch to a stand-by mode. Steps S10701 and S10703 are the same as the steps S10101 and S10103 of FIG. 15, respectively. In a step S10702, the CPU301 executes the start-up sequence 4 of FIG. 20.

FIG. 23 is a flow chart showing the operations from the state in which a front door is open to the stand-by mode. Steps S10801, S10802 and S10804 are the same as the steps S10201, S10202 and S10204 of FIG. 16, respectively. In a step S10803, the CPU301 executes the start-up sequence 4 of FIG. 20.

[Embodiment 14]

In Embodiment 12, the CPU301 stores in the main assembly memory 312 the information (cleaning information) indicative of whether or not the cleaning process to be executed after the jam clearance operation in the fixing portion has been executed.

In this embodiment, the CPU301 stores the information (cleaning information) indicative of whether or not the cleaning process to be executed after the jam clearance operation in the fixing portion has been executed, in a storing device 200.

The storing device 200 shown in FIG. 14 is connected communicatably with the image forming apparatus 300 through a network cable. The storing device 200 is a server-computer comprising a rewritable non-volatile memory, an external I/F portion 304 and a communication circuit connected with the network, and functions as a storing server for storing information of the image forming apparatus 300. The storing device 200 comprises a CPU for controlling the storing device 200 and a ROM for storing control programs to be executed by the CPU. The CPU of the storing device 200 records the information of the image forming apparatus 300 received by the communication circuit through the network, supplying to the image forming apparatus 300 the information of the memory in accordance with the instructions of the image forming apparatus 300 received by the communication circuit through the network.

The communication is described as being made between the storing device 200 and the image forming apparatus 300 through the network cable, but it can be made by wireless communication.

In this embodiment, the CPU301 functions as a recording station (writing portion).

The CPU301 stores the cleaning information in combination with the ID of the first fixing device 150 in the memory of the storing device 200 connected with the external I/F through the network, and acquired is the information stored in the memory of the storing device 200. When the cleaning information for the ID of the first fixing device 150 acquired from the storing device 200 indicates of non-execution of the cleaning process, the CPU301 carries out the cleaning process similarly to Embodiment 12.

The specific operations are the same as those of Embodiment 12, and therefore, the description thereof is omitted. For the description of such operations, the main assembly memory 312 in the above description of Embodiment 12 should read storing device 200. As to the flow charts of FIGS. 15-18, the memory (S10302 of FIG. 17, for example) should read the storing device 200.

With the structure of this embodiment, the cleaning process is executed even if the first fixing device 150 for which the cleaning process to be executed after the jam clearance operation has not been carried out, the cleaning process is carried out, and therefore, the deterioration of the image quality and the recording material 102 can be suppressed.

In addition, the storing device 200 may be connected through the network with a plurality of image forming apparatuses usable with the first fixing device 150. The structures of the image forming apparatuses are the same as those of the image forming apparatus 300, and the description thereof is omitted.

In such a case, when the fixing device for which the cleaning process has been executed in another image forming apparatus is used, the time period required from the actuation of the main switch 101 to the state of the image forming apparatus 300 capable of starting of the image forming operation (waiting period of the operator) can be shortened.

The description will be made as to an example of the particular situation. That is, the fixing device to be replaced is the first fixing device 150.

For example, the user has two image forming apparatuses 300 (image forming apparatus P and image forming apparatus Q). The fixing device A is usable as a first fixing device 150 in either of the image forming apparatuses P, Q. The operator ordinarily uses the fixing device A mounted in the image forming apparatus P, and temporarily uses the first fixing device 150 in the image forming apparatus Q. The operator takes the fixing device A out of the image forming apparatus P, and mounts it in the image forming apparatus Q. At this time, it is assumed that the cleaning process for the fixing device A has been completed in the image forming apparatus P.

In the case that the cleaning information is stored in the main assembly memory 312 as in Embodiment 12, the CPU301 of the image forming apparatus Q execute the cleaning process for the fixing device A if the information for the fixing device A is not stored in the main assembly memory 312 of the image forming apparatus Q. That is, even if the cleaning process for the fixing device A has been completed in the previous image forming apparatus P, the cleaning process is carried out in the image forming apparatus Q.

On the other hand, the image forming apparatuses P, Q are connected with the storing device 200 through the network, and the cleaning information is stored in the storing device 200. The description will be made, utilizing the flowchart of FIG. 17 of Embodiment 12.

The fact that the fixing device A has been subjected to the cleaning process is stored in the memory of the storing device 200 by the image forming apparatus P (S10306, in FIG. 17).

The operator mounts the fixing device A removed from the image forming apparatus P now into the image forming apparatus Q. Thereafter, the operator actuates the main switch 101 of the image forming apparatus Q, the CPU301 of the image forming apparatus Q checks the mounting of the first fixing device 150 (S10101) of FIG. 15), and proceeds to the start-up sequence 3 of FIG. 17 (S10102, in FIG. 15).

The CPU301 of the image forming apparatus Q acquires the information indicative of the completion of the cleaning process for the fixing device A in the step S10302 in FIG. 17, From the storing device 200. Thus, when the fixing device A has already been subjected to the cleaning process in the image forming apparatus P, the operation in the image forming apparatus Q can be proceed to the warming-up process without executing the cleaning process.

In the flow chart of FIG. 17, the CPU301 of the image forming apparatus Q proceeds the operation through "Yes" in S10303 and "No" in Yes, S10304. By doing so, in the image forming apparatus Q, the operator's waiting time can be shortened.

In this embodiment, the description has been made as to the first fixing device 150, but the same applies to the second fixing device 170.

In addition, in this embodiment, the structure of storing the information (cleaning information indicative of whether or not the cleaning process to be executed after the jam clearance operation in the fixing portion has been executed) in the storing device 200 is incorporated in Embodiment 12, but the same structure may be incorporated in Embodiment 13. The specific operations are the same as those of Embodiment 13, and therefore, the description thereof is omitted. For the description of such operations, the main assembly memory 312 in the above description of Embodiment 12 should read storing device 200. As to the flow charts of FIGS. 20-23, the memory (S10502 of FIG. 20, for example) should read the storing device 200.

[Embodiment 15]

In Embodiments 12 and 13, the CPU301 stores the information (cleaning information indicative of whether or not the cleaning process to be executed after the jam clearance operation in the fixing portion) in the main assembly memory 312. In Embodiment 14, the CPU301 stores the information (cleaning information indicative of whether or not the cleaning process to be executed after the jam clearance operation in the fixing portion) in the storing device 200. However, the information may be stored both in the main assembly memory 312 and the storing device 200 as a back-up.

[Embodiment 16]

In the foregoing, when the cleaning process to be executed after the jam clearance operation in the fixing portion is completed, the warming-up process is executed without executing the cleaning process, but an exceptional process which will be described hereinafter may be executed. When it is said when the cleaning process to be executed after the jam clearance operation in the fixing portion is completed, the warming-up process is executed without executing the cleaning process, it does not exclude the case in which an exceptional process is executed as in this embodiment.

More particularly, the CPU301 may exceptionally execute the cleaning process even when the cleaning process after the jam clearance operation in the fixing portion is executed.

For example, for the purpose of removing the contaminating toner accumulated in the plurality of fixing operations, the CPU301 executes such an exceptional cleaning process once per 100 start-up sequence operations. In such a case, the CPU301 stores the number of executions of the start-up sequence operations of the first fixing device 150 in the main assembly memory 312, and the exceptional process is carried out depending on the accumulated number of executions of the start-up sequence operations. The CPU301 may store the accumulated number of the start-up sequence of the first fixing device 150 in the storing device 200.

However, if the cleaning process is executed when the cleaning process is completed, it is not possible to reduce the time required from the actuation of the main switch 101 to the image formation capable state of the image forming apparatus 100. Therefore, the above-described execution is only an exceptional process, and it is preferable that the cleaning process is not executed when the cleaning operation is already completed.

The same applies to the second fixing device 170.

[Embodiment 17]

In the foregoing description, the operating portion 180 is provided with a display screen and a selection key, but the display screen may be a touch panel which also functions as a selector.

[Embodiment 18]

With the fixing device exchangeable system, the operator may replace the fixing device with another fixing device depending on the kind of the recording material 102 used or the preference of the operator. In such a case, there is a possibility that the advantageous effects of the exchangeable fixing device (that is, a high quality print can be produced) is not provided, when the operator does not use the fixing device suitable for the recording material 102. In view of this, the image forming apparatus 300 may notify the operator of whether the recording material 102 preferred by the operator and the usage of the fixing device meet properly with each other or not.

The description will be made on the basis of Embodiment 12 (FIGS. 17 and 18) as to the method for the correspondence between the usage of the fixing device and the recording material 102 on which the image is to print. The other structures of this embodiment are the same as those of Embodiment 12, and therefore, the description of the common parts is omitted for the sake of simplicity. The description will be made as to the first fixing device 150, but the same applies to the second fixing device 170.

The first fixing device 150 is provided with a resistor functioning as a limiting information portion. For the description of this case, the resistor 1154 of FIG. 14 should read the resistor functioning as the limiting information portion. The fixing device prepared outside the image forming apparatus 300 as a replacement fixing device is also provided with a resistor as the limiting information portion. The resistance value is different depending on the kind of the recording material 102 for which the fixing process of the first fixing device 150 is limited, and functions as the information for limiting the kind of the recording material 102 for use in the fixing process of the first fixing device 150. The method for acquiring the limiting information is the same as the method for acquiring the ID of the above-described fixing device, and the description thereof is omitted.

In the main assembly memory 312, the information indicative of the kind of the recording material 102 to be limited in the fixing process corresponding to the resistance value (limiting information) of the memory (limiting information portion) is stored beforehand. For example, when the resistance value is R4, the fixing on envelope is prevented, and when the resistance value is R5, the fixing on thick sheet is prevented.

In a step S10301 of FIG. 17, the CPU301 acquires the resistance value (limiting information) of the resistor (limiting information portion) of the first fixing device 150 together with acquiring the ID of the first fixing device 150 mounted in the image forming apparatus 300. On the basis of the limiting information and the kind of the limited recording material information stored in the main assembly memory 312, the CPU301 determines the kind of the recording material 102 which is to be prevented in the fixing operation of the first fixing device 150.

In this step S10401 of FIG. 18, when the CPU301 receives the printing job from the operator, the CPU301 makes non-selectable the kinds of the recording material 102 not suitable for the first fixing device 150 on the selection screen.

Thus, the printing using improper first fixing device 150 can be prevented, thus assuring high quality prints.

The information corresponding to the kinds of the recording material 102 to be prevented may not be stored in the main assembly memory 312 in combination with the limiting information. For example, the program executed by the CPU301 may prevent the fixing process on the recording material 102 depending on the resistance value of the resistor (limiting information portion). In such a case, the program is stored in the ROM 303.

The foregoing description has been made with respect to the first fixing device 150, but it is applicable to the second fixing device 170, and therefore, the description as to the second fixing device 170 will be omitted.

In this embodiment, a resistor is used as the limiting information portion, but this is not limiting to the present invention and the following is an alternative structure.

For example, the limiting information portion provided on the fixing device (first fixing device 150, second fixing device 170 and replacement fixing device) may be DIP switch including a plurality of switches. In such a case, the switches different depending on the fixing devices are in ON state beforehand as the limiting information, and the CPU301 determines the kind of the recording material 102 to be prevented on the basis of the signal from the ON state switches. The other structures are the same as those of the DIP switch as the discrimination portion described hereinbefore.

The limiting information portion provided on the fixing device (first fixing device 150, second fixing device 170 and replacement fixing device) may indicate the usage, for example, "for envelope", or the kind and/or usage of the fixing device (limitation information). In such a case, the memory is a rewritable non-volatile memory such as EEPROM, flash memory or the like. The CPU301 reads out the limiting information from the memory to determine the kind of the recording material 102 to be prevented. In this case, the information corresponding to the limited recording material 102 may be stored in the memory as the limiting information portion provided on the fixing device not in the main assembly memory 312.

In this embodiment, the limiting information portion and the discrimination portion are separate members on the fixing device, but one resistor or memory may include the limiting information portion and the discrimination portion.

In addition, this embodiment has been described as being incorporated in Embodiment 12, but may be incorporated in Embodiment 13 or 14. The description is omitted because it also applies to the case where Embodiment 13 or Embodiment 14 is modified.

[Embodiment 19]

The collection rotatable member may be a hollow roller (external heating member) including a heater therein to heat the fixing rollers 151, 171 from the outside of the fixing rollers 151, 171.

In the foregoing description, the cleaning portion is provided in the fixing roller 151 side, but it may be provided in the pressing belt 152 (rotatable member) side, and the toner is transferred from the surface of the fixing roller 151 onto the pressing belt 152, and then it is removed. In such a case, in the cleaning operation, in order to transfer the toner from the surface of the fixing roller 151 onto the pressing belt 152, the fixing roller 151 is contacted to the pressing belt 152. Similar to the foregoing examples, it is preferable that before the cleaning process is started, the pressing belt 152 is warmed to such an extent that the toner is not solidified, and then the cleaning process is carried out. The same applies to the second fixing device 170.

In the foregoing examples, the web cleaner (156-160) is used to effect the cleaning process after the jam clearance in the fixing portion (first fixing device 150, second fixing device 170), but the structure for the cleaning process is not limited to this specific structure. For example, by employing sponge rollers driven by the fixing rollers 151, 171, the cleaning may be effected.

[Embodiment 20]

In the foregoing examples, the cleaning process to be executed for the fixing portion (first fixing device 150, second fixing device 170) after the jam clearance operation is executed, by using a web cleaner (156-160), but the present invention is not limited to that.

The cleaning may be carried out using the recording material 102.

With this method, the contaminating toner on the fixing roller 151 and/or fixing roller 171 resulting from the occurrence of the jam in the fixing portion can be removed, even if the cleaning mechanism such as the above-described web cleaner is not provided. More particularly, when the cleaning operation is carried out, a plurality of recording materials 102 are forcedly passed through the fixing portion (first fixing device 150, second fixing device 170) to transfer the contaminating toner onto the recording materials 102. Thereafter, the recording materials 102 carrying the toner are discharged to the outside of the image forming apparatus 100.

When the information stored in the main assembly memory 312 indicates the non-execution of the cleaning process, the CPU301 controls the feeding portion 308 to pass the predetermined number of recording materials 102 through the first fixing device 150 (second fixing device 170) and discharged them to the outside of the apparatus.

In Embodiment 14, when the information stored in the storing device 200 indicates the non-execution of the cleaning process, the CPU301 controls the feeding portion 308 to pass the predetermined number of recording materials 102 through the first fixing device 150 (second fixing device 170) and discharged them to the outside of the apparatus.

The same applies to the second fixing device 170.

The number of the recording materials 102 may be predetermined, and in this embodiment it is 10.

[Embodiment 21]

In the foregoing embodiments, the image forming apparatus 100 comprises both of the first fixing device 150 and the second fixing device 170 (tandem fixing). However, the present invention is applicable to an image forming apparatus 300 comprising only one fixing device 150.

[Embodiment 22]

In the foregoing embodiments, the image forming apparatus 300 comprises the image forming stations (120-123) for forming yellow, magenta, cyan and black toner images (color image forming apparatus), but the present invention is applicable to a monochromatic image forming apparatus. For example, there is a monochromatic for forming the toner images in black only.

[Embodiment 23]

In the foregoing embodiments, the image forming apparatus 300 comprises an intermediary transfer belt 115 as an intermediary transfer member (intermediary transfer type), but the present invention is applicable to a direct transfer type apparatus as follows.

In such a case, the image forming station 309 includes the image forming stations (120-123) and a transfer feeding belt functioning as a transfer portion. The image forming stations (120-123) can be contacted by the transfer feeding belt. The image forming apparatus 300 feeds the recording material 102 from a recording material accommodating portion 103 to the transfer feeding belt.

The transfer feeding belt electrostatically attracts the recording material 102 and carries it to a position where the recording material 102 is faced to the image forming station, and a transfer roller is provided in the inside of the belt. The transfer roller transfers the toner image formed on the image bearing member onto the recording material 102 carried on the transfer feeding belt. By this, the toner image (unfixed) is formed on the recording material 102.

[Embodiment 24]

(General Arrangement of Image Forming Apparatus)

FIG. 24 is a sectional view of an example of the image forming apparatus according to Embodiments 23-38. In the description of this embodiment, the same reference numerals as in Embodiment 1 are assigned to the elements having the corresponding functions in this embodiment, and the detailed description of the general arrangement of the image forming apparatus 400 is omitted for simplicity.

(Structure of Control System)

FIG. 25 is a block diagram of a control system. The same reference numerals as in Embodiment 1 are assigned to the elements having the corresponding functions in this embodiment, and the detailed description thereof is omitted for simplicity.

The image forming apparatus 400 (FIG. 24) is provided with CPU301, RAM 302, ROM 303 for controlling the operation of the image forming apparatus 400.

The CPU301 functioning as a controller carries out a basic control of the image forming apparatus 400 by executing control programs stored in the ROM 303. The operation of the flow chart which will be described hereinafter is carried out by the CPU301 using the control programs stored in the ROM 303.

The CPU301 uses the RAM 302 as a work area for executing the processing of the control program.

The CPU301 is electrically connected with the RAM 302 and the ROM 303, and various mechanisms to be controlled.

An external I/F portion 304 is a communication circuit for communication with an external device connected through network (LAN and/or WAN). The external device may include a PC or another image forming apparatus or the like.

The CPU301 is connected with the opening and closing sensor 305 to detect whether or not the front door 140 is closed.

The sensor group 306 including sensors 153, 155, 173 and 175 shown in FIG. 24 is disposed along the feeding path, by which the CPU301 detects the presence, absence and passing of the recording material.

The CPU301 is connected with a timer 307. The timer 307 counts the time. As will be described hereinafter, this is used for the measurement of the time for detection of jamming or for measuring the cleaning time.

The CPU301 is connected with the clock 313. The clock 313 functions as an output portion for outputting time information. The CPU301 acquires the time information indicated by the clock 313.

The CPU301 is connected with a counter 314. As to the counter 314, the description has been made in conjunction with Embodiment 27, and therefore, is omitted for the sake of simplicity.

The CPU301 is connected with an operating portion 180. The CPU301 receives the instructions of switching of the display content on the display screen and other operations, given by the operator at the selection keys of the operating portion 180. The CPU301 displays, on the display screen of the operating portion 180, the status of operation of the image forming apparatus 400, an operation mode selected by the selection key, and so on.

The CPU301 is connected with a feeding portion 308 to control feeding of the recording material 102. The feeding portion 308 includes a supply portion for supplying the recording material 102 from the recording material accommodating portion 103 to the feeding path, and flappers (flappers 131, 132, 133 shown in FIG. 24) for the feeding paths.

The CPU301 is connected with the image forming station 309 which will be described hereinafter to control the image forming station 309.

The fixing device memory 310 includes the memory 154 provided on the first fixing device 150 mounted in the image forming apparatus 400 and a memory 174 provided on the second fixing device 170 mounted in the image forming apparatus 100. The CPU301 is connected with the memories 154, 174 of the first fixing device 150 and the second fixing device 170 mounted in the image forming apparatus 400 to write in and read out of the memories 154, 174.

The CPU301 is connected with a discrimination member 311. The discrimination member 311 will be described hereinafter.

The CPU301 is connected with a main assembly memory 312. The main assembly memory 312 is rewritable non-volatile memory and may be integral with the RAM 302.

The CPU301 is connected with a mechanism group X of the first fixing device 150 mounted in the image forming apparatus 400 to effect a temperature adjustment control and cleaning control for the first fixing device 150. The mechanism group X includes a temperature sensor 320, a heater 321, a moving mechanism 322, a motor 323, a solenoid 324 and a web mounting and demounting mechanism 325.

The temperature sensor 320 includes a plurality of temperature sensors provided in the first fixing device 150, including a thermister 162 (FIG. 3), and a thermister (unshown) for the pressing belt 152.

The heater 321 includes a plurality of heater provided in the first fixing device 150, including a halogen heater 161 (FIG. 3), a halogen heater (unshown) provided in the heating roller 163.

The CPU301 is connected with a mechanism group X of the second fixing device 170 mounted in the image forming apparatus 400 to effect temperature adjustment control and cleaning control for the second fixing device 170. The mechanism group X for the second fixing device 170 is substantially the same as the mechanism group X of the first fixing device 150, and therefore, the detailed description thereof is omitted by applying the same reference numerals to the corresponding elements. (in the description of the mechanism group X for the first fixing device 150, the first fixing device 150, the pressing belt 152, the heating roller 163 corresponds to the second fixing device 170, the pressing roller 172, the pressing roller 172, respectively).

In this embodiment, the mechanisms are controlled by the CPU301. Alternatively, however, the use can be made with the CPU circuit portions for controlling the respective mechanisms and a main CPU circuit portion connected with the respective CPU circuit portions to effect the overall control.

The image forming apparatus 400 comprises stations 120, 121, 122 and 123 as the image forming station 309 (FIG. 25), an intermediary transfer belt 115 as an intermediary transfer member, and a transfer roller 116 as a transfer portion.

The stations 120, 121, 122, 123 form yellow, magenta, cyan and black toner images, respectively, and transfer the toner images onto the intermediary transfer belt 115.

(Fixing Portion)

(Tandem Fixing)

The first fixing device 150 and the second fixing device 170 as the fixing portion fix the toner image transferred onto the recording material 102 by applying heat and pressure to the recording material 102.

The second fixing device 170 is disposed downstream of the first fixing device 150 with respect to the feeding direction of the recording material 102. The second fixing device 170 functions to provide the toner image fixed on the recording material 102 by the first fixing device 150 with desired glossiness and/or to supplement the heat quantity for a large basis weight recording material (thick sheet, for example) which requires a large amount of heat for the fixing operation.

On the other hand, in the case that the heat by the first fixing device 150 is enough to fix the image, it is unnecessary to use the second fixing device 170, and therefore, the recording material 102 is fed into the feeding path 130 bypassing the second fixing device 170, for the purpose of saving the energy consumption. For example, this occurs in the case that the recording material 102 is plain paper or thin sheet, and high glossiness is not desired. As to whether to feed the recording material 102 into the second fixing device 170 or to feed the recording material 102 bypassing the second fixing device 170 (bypass route), the CPU301 controls it by switching the flapper 131.

(Structure of Fixing Device)

The first fixing device 150 and the second fixing device 170 are detachably mountable to the first mounting portion 141 and the second mounting portion 142 (mounting portion) of the image forming apparatus 400, respectively. The first fixing device 150 and a second fixing device 170 can be replaced with the fixing devices having the following structures, respectively.

The first fixing device 150 is provided with a memory 154 as a storing portion of the fixing device (fixing storing portion). The second fixing device 170 is provided with a memory 174 as a storing portion of the fixing device (fixing storing portion). The details will be described hereinafter.

FIG. 3 is a sectional view of an example of a fixing portion. In the description of this embodiment, the same reference numerals as in Embodiment 1 are assigned to the elements having the corresponding functions in this embodiment, and the detailed description thereof is omitted for simplicity.

(Jam Clearance Operation).

The operation upon the occurrence of sheet jamming in the image forming apparatus 400 will be described.

The jamming in the fixing portion means the state in which the recording material 102 stagnates in the first fixing device 150 and/or the second fixing device 170 as a result of the occurrence of jammed sheet or sheets in the image forming apparatus 400.

For example, it is the case in which the jamming occurs in the first fixing device 150, or the case in which the recording material 102 stagnates in the first fixing device 150 because of jamming of another sheet in a part of the image forming apparatus 400 other than the first fixing device 150. In addition, for example, it is the case in which the recording material 102 stagnates in the first fixing device 150 because of the operator opening the door (front door 140, for example) of the main assembly of the image forming apparatus 400 during the fixing operation of the first fixing device 150, resulting in the operation stop of the image forming apparatus 100. The same applies to the second fixing device 170.

The description will be made in detail, taking the first fixing device 150 as an example.

The description applies also to the second fixing device 170, and therefore, the description about the second fixing device 170 will be omitted for the sake of simplicity. (the structures of the first fixing device 150 apply to the structures of the second fixing device 170).

When the CPU301 detects the occurrence of the sheet jamming in image forming apparatus 100 on the basis of the signals from the sensor group 306 including sensors 153, 155 in the image forming apparatus 400, it stops the image forming operation of the image forming apparatus 100. If, at this time, the recording material 102 is in the first fixing device 150, the jamming is that in the fixing portion. Thus, the jamming in the fixing portion occurs as a result of the jamming in the part other than the first fixing device 150. Thereafter, the CPU301 displays the position where the recording material 102 stagnates on the operating portion 180 to prompt the operator to remove the jammed sheet. The jamming in the fixing portion of the first fixing device 150 is simply called as the jamming in the first fixing device 150.

The sensors 153, 155 as the jam detecting portion detect presence or absence of the recording material 102 in the first fixing device 150. They are optical sensors, for example. The CPU301 receives the signals from the sensors 153 and/or 155 to detect that a recording material 102 stagnates in the first fixing device 150 (jamming in the fixing portion). For example, the CPU301 discriminates the stagnation of a recording material 102 between the sensors 155 and 153 in the case that the downstream side sensor 153 does not detect the passage of the recording material 102 after elapse of a predetermined time period after the upstream side sensor 155 detects the passage of the recording material 102. The elapse of the time is counted by the timer 307.

When the recording material 102 stagnates in the first fixing device 150, the operator opens the front door 140 and draw the first fixing device 150 out of the image forming apparatus 100, and then remove the recording material 102. After removing the stagnating recording material 102, the operator returns the first fixing device 150 into the image forming apparatus 100 and closes the operator.

The CPU301 detects the closing of the front door 140 on the basis of the signal from the opening and closing sensor 305. After the detection of the closing of the front door 140, the CPU301 accesses the memory 154 of the first fixing device 150. By this, it confirms the mounting of the first fixing device 150. If the CPU301 is unable to access the memory 154, it discriminates that the first fixing device 150 is not mounted.

The method for discrimination (confirmation) as to whether or not the first fixing device 150 is mounted in the main assembly is not limited to the above-described method. For example, a signal output portion for outputting a signal in accordance with the input signal from the CPU301 is provided on the first fixing device 150. After the front door 140 is closed, the CPU301 inputs the signal to the signal output portion. The CPU301 may detect the mounting of the first fixing device 150 by detecting the signal outputted in response to the signal input to the signal output portion. If the CPU301 does not detect the signal to be outputted in response to the input of the signal to the signal output portion, it discriminates that the first fixing device 150 is not mounted.

Alternatively, it may be discriminated on the basis of the conduction state or non-conduction state between the image forming apparatus 400 and the first fixing device 150.

Further alternatively, a sensor outputting a signal when the first fixing device 150 is mounted may be provided in the image forming apparatus 400, and the CPU301 detects the mounting of the first fixing device 150 on the basis of the signal from such a sensor.

Then, the CPU301 checks the presence or absence of the recording material 102 stagnating in the first fixing device 150 on the basis of the signals from the sensors 153, 155. At this time, the CPU301 discriminates that the jam clearance operation has been completed if the recording material 102 does not stagnate in the first fixing device 150.

If the jamming in the first fixing device 150 occurs, that is, a recording material 102 stagnates in the first fixing device 150, the fixing roller 151 is likely to be contaminated with the unfixed toner on the stagnating recording material 102. More particularly, this occurs when the recording material 102 stagnates while being wound around the fixing roller 151, or when the recording material 102 rubs the fixing roller 151 when the operator removes the stagnating recording material 102.

Therefore, the CPU301 executes a cleaning process, which will be described hereinafter, for the first fixing device 150, after confirming the completion of the jam clearance operation for the first fixing device 150.

(Cleaning Process after the Jam Clearance)

The cleaning process for the fixing portion executed by the CPU301 as the executing portion after the removal of the jammed sheet from the fixing portion is the same as that in Embodiment 1, and therefore, the description is omitted.

The counting of the winding time of the web 160 may be made by the CPU301 counting the clocks 313.

(Warming-up Process)

After the completion of the cleaning process for the fixing portion, the CPU301 executes the warming-up process in preparation for the start of the fixing process. The warming-up process is executed also when the main switch 101 of the image forming apparatus 100 is actuated, not limited to the state after the cleaning process. The details of the warming-up process are the same as that in Embodiment 1, and therefore, the description is omitted.

(Resumption of Job)

After the image forming apparatus 100 is enabled to start the image forming operation after the completion of the warming-up process for the first fixing device 150, the CPU301 resumes the printing operation interrupted due to the occurrence of the jamming. The CPU301 displays "printing" in the operating portion (notifying portion) 180.

If the part or parts other than the first fixing device 150, the image forming stations 309, for example are not completed for the resumption even if the warming-up process operation of the first fixing device 150 has been completed, the CPU301 waits for the completion of the part or parts, and then resumes the printing operation.

The same applies to the second fixing device 170.

(Stand-by Mode)

The stand-by mode means the state in which the image forming apparatus 400 is in the state capable of starting of the image forming operation and waits for the printing instructions (printing job) by the operator. If there is no job to be resumed after the completion of the above-described warming-up process, or after the completion of the printing operation, the apparatus becomes in the stand-by mode.

When the image forming apparatus 400 is enabled to start the image forming operation, the CPU301 displays "printable" on the operating portion (notifying portion) 180.

In this embodiment, in the stand-by mode, the temperature control for the first fixing device 150 and the second fixing device 170 (the fixing roller 151 and pressing belt 152, for example) is continued so that the printing operation can be started as soon as the printing job is received.

If a printing operation is reserved during the warming-up process operation, the reserved printing job is executed without entering the stand-by mode. That is, in such a case, when the state of the image forming apparatus 100 becomes capable of starting the image forming operation after the completion of the warming-up process operations for the first fixing device 150 and the second fixing device 170, the printing job is immediately started without entering the stand-by mode.

If the part or parts other than the first fixing device 150 or the second fixing device 170, the image forming stations 309, for example are not completed for the resumption even if the warming-up process operation of the first fixing device 150 and the second fixing device 170 have been completed, the CPU301 waits for the completion of the part or parts, and then resumes the printing operation.

(Exchange of Fixing Device)

The exchanging system of the fixing device will be described.

In order to provide high quality prints, in the image forming apparatus 100 of this embodiment, the fixing device can be exchanged depending on the kinds of the recording material 102 or the preference of the operator.

For example, when the recording material 102 is an envelope, the fixing device exclusively for the envelope is used. The envelope is easily creased by the pressure applied during the fixing process. Therefore, it is desirable to use a fixing device adjusted in the pressure between the fixing roller 151 and the pressing belt 152 (nip pressure) particularly for envelopes.

As another example, there is a fixing device particularly for a specific width size. When the same width recording materials 102 continuously pass the nip, the surface of the fixing roller 151 is damaged at the widthwise edge portions of the recording materials 102. If the damage of the fixing roller 151 becomes intolerable level, the glossiness of the image becomes uneven due to the damage when a larger width recording material 102 is processed. In order to prevent this, the same structure fixing devices may be used exclusively for respective sizes of the recording materials 102. (here, the width is the dimension measured in the direction perpendicular to the feeding direction of the recording material 102 (longitudinal direction of the fixing roller 151).

The same applies to the second fixing device 170.

Thus, according to the image forming apparatus 400 of this embodiment, the operator can exchange the fixing device depending on the kinds of the recording materials 102 or preferences of the operator.

When the fixing device is exchanged, the operator opens the front door 140 to take the mounted fixing device out of the image forming apparatus 400. Then, the operator mounts another fixing device into the image forming apparatus 400, and closes the front door 140. In this embodiment, the first fixing device 150 and the second fixing device 170 are exchangeable, respectively.

(Memory of Fixing Device)

In this embodiment, the fixing device is exchangeable, and therefore, the first fixing device 150 is provided with a memory 154 as a storing portion (fixing storing portion) and discrimination portion. Similarly, the second fixing device 170 is provided with a memory 174 as a storing portion (fixing storing portion) discrimination portion. The memories 154, 174 are rewritable non-volatile memory, typically such as an EEPROM, a flash memory or the like. A memory is also provided on a fixing device (not the first fixing device 150 or the second fixing device 170 already mounted in the image forming apparatus 100) kept outside of the image forming apparatus 100.

The memory (memory 154, memory 174 and memory provided on the replacement fixing device) stores identifying information and therefore functions as a discrimination portion. In the following, the identifying information stored in the memory 154 of the first fixing device 150 is called "ID of the first fixing device 150 (fixing device)".

The fixing device group including the first fixing device 150 and the second fixing device 170 is provided with the memory in order to solve the problem described below. The problem arises when fixing device is once taken out of the apparatus without executing the cleaning process after the jam clearance in the fixing portion, and then the fixing device is remounted in the image forming apparatus 100.

This will be described in detail, taking the two situations as examples. The description will be made as to the first fixing device 150, but the description applies also to the second fixing device 170, and therefore, the description as to the second fixing device 170 will be omitted for simplicity.

The first situation (situation 1) will be described. The fixing device to be replaced is the first fixing device 150.

For example, it is assumed that the first fixing device 150 currently mounted in the apparatus is not the one exclusively for the envelope, and a printing job (on the plain paper sheets, for example) which requires more than one hour to complete starts. It is further assumed that 15 minutes after the start of the printing job (initial stage), sheet jamming occurs in the fixing device A. The operator then executes a jam clearance operation in accordance with the display of the operating portion 180. However, if an urgent printing job on the envelopes came across, the operator interrupts the previous printing job by the fixing device A, and may start the new printing on the envelopes. The operator may omit the cleaning process and replace the fixing device A with the fixing device B exclusively for the envelopes.

Conventionally, the CPU stores the occurrence of the jam in the fixing portion in the memory provided in the main assembly of the image forming apparatus, so that the cleaning process is carried out after the jam clearance operation. In this case, if the fixing device A is replaced with the fixing device B after the jam clearance operation, the CPU executes the cleaning process operation only for the new fixing device B. Thus, the CPU discriminates the completion of the cleaning process to be executed after the jam clearance operation for the fixing portion.

When the operator prints on the recording material (plain paper sheets, for example) other than the envelopes some days later, the operator remounts the fixing device A. The fixing roller of the fixing device A not having been subjected to the cleaning process remains contaminated with the toner. If the printing operation is carried out in the state, the image quality is significantly deteriorated.

As a method for solving this problem, in Embodiment 12, the information as to whether or not the cleaning process to be executed after the jam clearance operation in the fixing portion it is stored in the memory provided in the main assembly of the image forming apparatus together with the ID of the fixing device. This method is called method 1.

With method 1, the memory of the main assembly of the image forming apparatus is capable of storing non-execution of the cleaning process with respect to "fixing device A". As a result, the cleaning cross operation can be carried out when the fixing device A is remounted later. Therefore, the deterioration of the image quality can be suppressed in the case that the fixing device is exchangeable.

According to this embodiment, the deterioration of the image quality can be suppressed even on another situation, that is, situation 2. In situation 2, the user has a plurality of image forming apparatuses, and the fixing device having experienced the fixing portion jam in another image forming apparatus and is mounted to the image forming apparatus 400 without executing the cleaning process.

The user has two image forming apparatuses 400 (image forming apparatus P and image forming apparatus Q), for example, and the fixing device A is usable both in the image forming apparatuses P, Q as the first fixing device 150. The fixing device to be replaced is the first fixing device 150.

The fixing device A has been subjected to the cleaning process operation by the image forming apparatus P.

It is assumed that on the next day, the operator dismounts the fixing device A having been subjected to the cleaning process operation from the image forming apparatus P and mounts it into the image forming apparatus Q. The fixing device A is used as the first fixing device 150 of the image forming apparatus Q.

It is assumed that a sheet jamming occurs during the image forming operation of the image forming apparatus Q (fixing portion jam), and the operator takes the fixing device A out of the image forming apparatus Q without executing the cleaning process after the jam clearance operation, similarly to the situation 1. The fixing roller of the fixing device A not having been subjected to the cleaning process remains contaminated with the toner.

It is further assumed that the operator mounts the fixing device A not having been subjected to the cleaning process operation into the image forming apparatus P to use it as the first fixing device 150 of the image forming apparatus P.

By the method 1, the memory of the main assembly of the image forming apparatus P stores the information indicating that the cleaning process operation has been carried out for the very fixing device A. Actually however, at the time when the fixing device A is remounted in the image forming apparatus P, it has not been subjected to the cleaning process operation to be executed after the jam occurrence in the image forming apparatus Q. Therefore, the CPU of the image forming apparatus P carries out the printing operation without executing the cleaning process for the fixing device A on the basis of the information in the memory of the main assembly of the image forming apparatus P, with the result that the image quality is significantly low.

In view of the above-described situations, according to this embodiment, the first fixing device 150 is provided with the memory 154 as the fixing storing portion capable of storing the information. The information indicative of whether or not the cleaning process operation to be executed after the jam clearance operation in the fixing portion is stored both in the memory 154 and the main assembly memory 312 as cleaning information.

The memory 154 of the first fixing device 150 stores the cleaning and the time (date) of the recording of the cleaning information in the memory 154. In addition, the memory 154 stores the ID of the fixing device (fixing device A, for example) as the identifying information of the fixing device, and the memory 154 functions as a discrimination portion.

On the other hand, image forming apparatus 400 is provided with the main assembly memory 312 as the main assembly storing portion capable of storing information. The main assembly memory 312 stores the cleaning information having the same content as that stored in the memory 154, the time (date) of the recording of the cleaning information in the memory 154, in combination with the fixing device ID of the first fixing device 150.

The information of the time is used to discriminate which one of the cleaning information stored in the memory 154 and the cleaning information stored in the main assembly memory 312 is to be used. More particularly, the CPU301 executes the cleaning process on the basis of the later one of the cleaning information stored in the main assembly memory 312 and the memory 154.

The CPU301 checks which one of the time stored in the memory 154 of the first fixing device 150 mounted in the image forming apparatus 400 and the time stored in the main assembly memory 312 is later. The CPU301 executes the cleaning process when the later information indicates the non-execution of the cleaning process.

The cleaning information indicates "hysteresis yes" or "hysteresis no" (jam hysteresis) and is stored both in the main assembly memory 312 and in the memory 154. Upon the occurrence of the jamming in the first fixing device 150, the CPU301 records the jam hysteresis in the main assembly memory 312 and in the memory 154. When the cleaning process is executed after the jam clearance operation, the CPU301 clears the jam hysteresis stored in the main assembly memory 312 and in the memory 154. The jam hysteresis "yes" is indicative that the cleaning process operation has not been executed, and "no" is indicative that the cleaning process operation has been executed.

Part (a) of FIG. 30 shows an example of the information stored in the main assembly memory. Parts (b) and (c) of FIG. 30 show an example of the information stored in the fixing device memory.

When, for example, in the situation 2, the fixing device A having been subjected to the cleaning process operation is taken out of the image forming apparatus P, the main assembly memory 312 of the image forming apparatus P stores the information (1) in part (a) of FIG. 30. On the other hand, the memory 154 of the fixing device A stores the information shown in part (b) of FIG. 30.

As a result of the jam occurrence in the fixing device A mounted in the image forming apparatus Q, the memory 154 of the fixing device A stores the information shown in part (c) of FIG. 30 by the CPU301 of the image forming apparatus Q. The memory 154 of the fixing device A taken out of the image forming apparatus Q without executing the cleaning process to be executed after the jam clearance operation stores the "hysteresis yes" together with the time. On the other hand, the information in the main assembly memory 312 of the image forming apparatus P remains and changed, that is, it is still the information shown in part (a) of FIG. 30.

When the fixing device A not having been subjected to the cleaning process is remounted to the image forming apparatus P, the information stored in the main assembly memory 312 of the image forming apparatus P and the information stored in the memory 154 of the fixing device A are as shown in part (a) of FIG. 30 and part (c) of FIG. 30, respectively. The jam hysteresis of the memory 154 of the fixing device A having the later time indicates "yes" (part (c) of FIG. 30), and therefore, the CPU301 of the image forming apparatus P executes the cleaning process for the fixing device A.

The image forming apparatus 400 of this embodiment can work under the situation 1, too.

Part (a) of FIG. 31 shows an example of the information stored in the main assembly memory, and part (b) of FIG. 31 shows an example of the information stored in the fixing device memory.

Under the situation 1, immediately after removing the fixing device A from the image forming apparatus 400 without executing the cleaning process, the main assembly memory 312 stores the information shown in part (a) of FIG. 31, and the memory 154 stores the information shown in part (b) of FIG. 31. When the fixing device A is remounted in the same image forming apparatus 400, the main assembly memory 312 and the memory 154 store the same information ((1) in part (a) of FIG. 31, and part (b) of FIG. 31).

The CPU301 executes the cleaning process on the basis of either one of the cleaning information in the memory 154 or the cleaning information in the main assembly memory 312.

If the jam hysteresis information has been cleared in the memory 154, the CPU301 discriminates no jam hysteresis.

The method for writing the information in the memory 154 is not limited to the above-described specific example, and, for example, when the cleaning process is not executed, date may be stored, and when the cleaning process has been executed, no data is stored. Further alternatively, the data indicative of non-completion of the cleaning process or the data indicative of completion of the cleaning process may be stored.

In this embodiment, the cleaning information recorded in the memory 154 and the cleaning information recorded in the main assembly memory 312 at the same, the recording methods for the memory 154 and the main assembly memory 312 may be different from each other as long as the stored information is the same. For example, the non-completion of the cleaning process operation may be recorded in the memory 154 as the cleaning information indicative of the non-execution of the cleaning process operation, and "hysteresis no" may be recorded in the main assembly memory 312. The same applies to the time information and/or identifying information.

The main assembly memory 312 may store the information for a plurality of fixing devices. Part (a) of FIG. 30 and part (a) of FIG. 31 shows an example in which the information for two fixing devices is stored.

The memory 154 may store information other than the jam hysteresis. For example, the information includes usage or kind of the first fixing device 150 (envelope, A4 size, for example).

The same applies to the second fixing device 170.

(Control Flow)

The description will be made in conjunction with the flow charts of FIGS. 26-29. The operations of the flow charts are carried out by the CPU301 functioning as the executing portion (recording portion, writing portion) controlling the related mechanisms of the image forming apparatus 400 in accordance with the control program stored in the ROM 303. The description will be made as to the first fixing device 150, but the same applies to the second fixing device 170.

(Sequence Upon Actuation of the Main Switch and Upon Closing the Front Door)

FIG. 26 is a flow chart showing the operations from the actuation of a main switch to a stand-by mode.

With the actuation of the main switch 101, the CPU301 starts. The CPU301 discriminates whether or not the first fixing device 150 is mounted in the image forming apparatus 100 (S20101). If the result of the discrimination is affirmative, the CPU301 becomes accessible to the memory 154 of the first fixing device 150. If the result of the discrimination at the step (S101) is negative, the operation returns to the step S101. If the first fixing device 150 is mounted in the image forming apparatus 400, the operation proceeds to the step S102.

The CPU301 executes the start-up sequence 3 shown in FIG. 28, for the first fixing device 150 (S20102). The detail of the operation will be described hereinafter.

After the completion of the start-up of the first fixing device 150, the CPU301 displays "printable" on the operating portion 180 to notify the operator that the image forming apparatus 100 can form the image (S20103). Then, the operation enters the stand-by mode.

FIG. 27 is a flow chart showing the operations from the state in which a front door is open to the stand-by mode.

The opened and closed states of the front door 140 are detected by the CPU301 on the basis of the signal from the opening and closing sensor 305 of the front door 140. When the front door 140 is open, the CPU301 waits for the closing of the front door 140 (S20201). When the front door 140 is open, the CPU301 may display information to prompt close the front door 140. When the CPU301 detects the closing of the front door 140 (S20201), the operation proceeds to step S20202.

Steps S20202-S20204 are the same as the steps S20101-S20103 of FIG. 26, and therefore, the description thereof is omitted. After the S20204, the operation proceeds to the stand-by mode.

(Start-up Sequence)

FIG. 28 is a flow chart of the start-up sequential operations. The flow chart of FIG. 6 shows details of the steps S20102, S20203 and a step S20410 which will be described hereinafter.

The CPU301 first reads out the data stored in the memory 154 of the first fixing device 150 mounted to the image forming apparatus 400 (S20301).

The CPU301 reads the data stored in the main assembly memory 312 (S20302).

In the step S20303, the CPU301 discriminates whether or not the main assembly memory 312 stores of the information about the ID of the first fixing device 150 read out in the step S20301. More particularly, the CPU301 searches the data for the ID of the first fixing device 150 read out in the step S20301 in the main assembly memory 312.

If any data for the ID of the first fixing device 150 read out in the step S20301 is stored in the main assembly memory 312, the CPU301 proceeds to step S20304 (S20303, Yes). This occurs when the information stored in the main assembly memory 312 is as shown in part (a) of FIG. 30, and the ID of the first fixing device 150 read out in the step S20301 is the "fixing device A" or "fixing device B".

If, on the other hand, the main assembly memory 312 does not store the data for the ID of the first fixing device 150 read out in the step S20301, the CPU301 proceeds to the step S20305 (S20303, No). This occurs when the information stored in the main assembly memory 312 is as shown in part (a) of FIG. 8, and the ID of the first fixing device 150 read out in the step S20301 by the CPU301 is "fixing device C". In this case, the main assembly memory 312 does not store any information about the jam hysteresis of the first fixing device 150 mounted in the image forming apparatus 400.

If the result of discrimination in the step S20303 is Yes, the CPU301 discriminates which one of the jam hysteresis of the memory 154 and the jam hysteresis of the main assembly memory 312 is to be used (S20304). More particularly, the CPU301 checks which one of the recording time of the information stored in the memory 154 and the information stored in the main assembly memory 312 is later.

If the time of the information recording of the memory 154 is later than that of the main assembly memory 312, the CPU301 proceed to the step S20305 (S20304, Yes). This is the case when, for example, the information stored in the main assembly memory 312 is as shown in part (a) of FIG. 30, and the information stored in the memory 154 is as shown in part (c) of FIG. 30. (the time of the information (1) in part (a) of FIG. 30 is later than that in part (c) of FIG. 30.

On the other hand, when the information regarding time of the memory 154 is later than that stored in the main assembly memory 312 corresponding to the ID of the first fixing device 150, the CPU301 proceeds to the step S20306 (S20304, No). When they are the same, the CPU301 proceeds to the steps S20306 (S20304, No). For example, when the information stored in the main assembly memory 312 is as shown in part (a) of FIG. 30, and the information stored in the memory 154 is as shown in part (b) of FIG. 30, the information recording times are the same, and therefore, the CPU301 discriminates "No" in the step S20304.

If the discrimination in the step S20303 is "No", and if the discrimination in the step S20304 is "Yes", the CPU301 makes discrimination on the basis of the jam hysteresis stored in the memory 154 of the first fixing device 150. That is, when the jam hysteresis of the first fixing device 150 is stored in the memory 154, the CPU301 proceeds to the step S20307, and when the jam hysteresis of the first fixing device 150 is not stored in the memory 154, the CPU301 proceeds to the step S20308 (S20305).

If, on the other hand, the result of discrimination in the step S20304 is "No", the CPU301 makes discrimination on the basis of the jam hysteresis stored in the main assembly memory 312. That is, when the jam hysteresis for the ID of the first fixing device 150 is stored in the main assembly memory 312, the CPU301 proceeds to the step S20307 (S20306, Yes).

The reading of the memory 154 in the S20301 and the reading of the main assembly memory 312 in the S20302 may be carried out in multiple steps. For example, the CPU301 reads the memory 154 and/or the main assembly memory 312, for each of the steps S20303, S20304, S20305 and S20306.

If the result of discrimination in the step S20305 is "Yes", and if the result of discrimination in the step S20306, the first fixing device 150 mounted in the image forming apparatus 400 has not been subjected to the above-described cleaning process. The CPU301 controls the cleaning portion or the like to execute the above-described cleaning process operation (S20303).

If the result of discrimination in the step S20305 is "No", and if the result of discrimination in the step S20306 is "No", the first fixing device 150 mounted in the image forming apparatus 400 has been subjected to the above-described cleaning process. In such a case, the operation proceeds to the step S20308 without executing the cleaning process. By not executing the cleaning process when it is unnecessary, the time from the actuation of the main switch 101 to the state in which the image forming apparatus 100 becomes capable of performing the image can be reduced (by the time (100 sec) required by the cleaning process operation.

In step S20308, the CPU301 clears the jam hysteresis of the main assembly memory 312. At this time, the jam hysteresis cleared by the CPU301 is the jam hysteresis for the first fixing device 150 having the ID.

In step S20309, the CPU301 clears the jam hysteresis of the memory 154 of the first fixing device 150. More particularly, the data of the jam hysteresis stored in the main assembly memory 312 in the step S20308 is copied into the memory 154.

In step S20310, the CPU301 records the time both in the memory 154 and the main assembly memory 312. It is recorded in combination with the ID of the first fixing device 150 in the main assembly memory 312. In this embodiment, the recorded time is the time at which the process of the S20309 is completed.

The CPU301 controls the first fixing device 150 to carry out the above-described warming-up process (S20311).

when in the step S20308, the jam hysteresis corresponding to the ID of the first fixing device 150 in the main assembly memory 312 is already cleared (No, in S20306, for example), the CPU301 may not make the change.

when in the step S20308 the main assembly memory 312 does not store any information for the ID of the first fixing device 150 (No, in S20303, for example), the CPU301 records the ID of the first fixing device 150. In step S20308, the CPU301 stores the cleared jam hysteresis for the ID in the main assembly memory 312.

when in step S20309 the jam hysteresis in the memory 154 is already cleared (No, in S20305, for example), the), CPU301 may not make the change.

The time recorded in the step S20310 is not limited to the time at which the process of the step S20309 is completed. It may be the time of the completion of the cleaning process in the step S20307, or the time of the completion of the process in the step S20309.

The flow for storing the jam hysteresis, the time and the ID of the first fixing device 150 in the main assembly memory 312 and for storing the jam hysteresis and the time in the memory 154 it is not limited to that in the order of S20308, S20309 and S20310.

Alternatively, the jam hysteresis in the memory 154 is first cleared, and the time is recorded in the memory 154. Then, the two pieces of information is copied from the memory 154 into the area corresponding to the ID of the first fixing device 150 in the main assembly memory 312.

Further alternatively, the steps S20308 and S20309 may be carried out simultaneously.

The processes of the steps S20308-S20310 may be executed at the timing different from that described in the foregoing. For example, the jam hysteresis in the memory 154 may be cleared upon the completion of the warming-up process (S20311).

The processes of the steps S20308-S20310 may be executed upon the detection of the opening of the front door 140 on the basis of the signal from the opening and closing sensor 305, provided that the cleaning process has been executed.

The processes of the steps S20308-S20310 may be executed upon the deactuation of the main switch 101, although the cleaning process has been carried out.

This is because the exchange of the first fixing device 150 requires opening of the front door 140.

In this embodiment, if the recording time in the memory 154 and the recording time in the main assembly memory 312 for the ID of the first fixing device 150 are the same, the cleaning process is executed on the basis of the jam hysteresis in the main assembly memory 312 (No, in S20304 in FIG. 28). However, when they are the same, the cleaning process may be executed on the basis of the jam hysteresis stored in the memory 154. In such a case, if they are discriminated as being the same in the step S20304, the CPU301 proceeds to the step S20305.

(Sequence Upon Jam Occurrence)

FIG. 29 is a flow chart of the operations at the time when sheet jamming occurs in the fixing device. More particularly, it is a flow chart in the printing job execution of the image forming apparatus 100.

In the stand-by mode in which the image forming operation of the image forming apparatus 400 is possible, a printing job is received from the operating portion 180 or an external PC through an external I/F portion 304. Then, the CPU301 controls various mechanisms of the image forming apparatus 100 including the stations 120-123, the first fixing device 150 and the second fixing device 170, so that the image forming operation of the image forming apparatus 400 is started (S20401). At this time, the image forming apparatus 400 provides a selection screen for selecting the kind of the recording material 102 on the display screen of the operating portion 180 or the external PC to receive the operator's instruction.

After the completion of the printing job, the CPU301 places the image forming apparatus 400 in the stand-by mode (S20402).

If the CPU301 detects the occurrence of the sheet jamming in the image forming apparatus 400 before the completion of the printing job (S20402) (S20403), the image forming operation of the image forming apparatus 400 is stopped, that is, the printing job is interrupted. The CPU301 detects the occurrence of the jamming in the image forming apparatus 400 on the basis of the signals from the sensor group 306.

When no jamming in the image forming apparatus 400 is detected, the CPU301 continues the execution of the printing job up to the end of the printing job (S20402, S20403).

When the position of the stagnation of the recording material 102 as a result of the jamming is outside the first fixing device 150 (second fixing device 170), the CPU301 proceeds to a step S20406 (S20405). The CPU301 waits for the removal of the stagnating recording material 102 on the basis of the signals from the sensor group 306 (S20406). When the CPU301 detects the removal of the stagnating recording material or recording materials 102 on the basis of the signals from the sensor group 306, the CPU301 executes the above-described warming-up process (S20407).

If the CPU 301 discriminates that the position of stagnation of the recording material 102 is in the first fixing device 150 (second fixing device 170) (fixing portion jam), the operation proceeds to a step S20408 (S20405).

In the step S20408, the CPU301 stores the jam hysteresis of the first fixing device 150 in the main assembly memory 312 in combination with the ID of the first fixing device 150. The ID of the first fixing device 150 mounted in the image forming apparatus 400 is already acquired by the CPU301 at the time of the actuation of the main switch, the opening of the front door 140, the above-described start-up sequence 5 (FIG. 28) executed after the jam clearance operation (S20301).

In step S20409, the CPU301 records the jam hysteresis in the memory 154 of the first fixing device 150. More particularly, the data of the jam hysteresis stored in the main assembly memory 312 in the step S20408 is copied into the memory 154.

In step S20410, the CPU301 records the time both in the memory 154 and the main assembly memory 312. It is recorded in combination with the ID of the first fixing device 150 in the main assembly memory 312. In this embodiment, the recorded time is the time at which the process of the S20409 is completed.

The recorded time is not limited to the time at which the process of the S20409 is completed. For example, it may be the time at which the fixing portion jam is detected in the step S20405, or the time and which the process of the step S20409 starts.

The order of storing the jam hysteresis in the main assembly memory 312 in combination with the time and the ID of the first fixing device 150, and the order of storing the jam hysteresis and the time in the memory 154 are not limited to the order of S20408, S20409 and S20410. Alternatively, for example, the jam hysteresis is first recorded in the memory 154, and the time is recorded in the memory 154. These two pieces of the information is copied from the memory 154 into the area of the main assembly memory 312 corresponding to the ID of the first fixing device 150.

In addition, the recording of the jam hysteresis and the time in the memory 154 in the steps S20409 and S20410 may be carried out upon the opening of the front door 140. Even if the front door 140 is opened, the first fixing device 150 is supplied with electric power as long as it is not dismounted from the main assembly of the image forming apparatus 100, and therefore, the CPU301 is capable of recording the jam hysteresis in the memory 154.

As described hereinbefore, the first fixing device 150 is liable to be replaced in the jam clearance operation. In view of this, after the detection of the jamming in the first fixing device 150, the jam hysteresis is recorded in the memory 154 by the time of removal of the first fixing device 150 for the jam clearance by the operator.

The CPU301 waits for removal of the recording material 102 stagnating in the first fixing device 150, on the basis of the signals from the sensors 153, 155 (S20411). When the CPU301 detects the removal of the recording material 102 stagnating in the first fixing device 150, the operation proceeds to a start-up sequence 5 of step S20410 (S20411). At this time, the CPU301 detects the closing of the front door 140 on the basis of the signal from the opening and closing sensor 305, and checks presence or absence of the recording material 102 in the first fixing device 150.

The start-up sequence 5 of the step S20412 corresponds to the flow of FIG. 28. In the start-up sequence 5, the data in the memory 154 of the first fixing device 150 is read out (S20301). The information is read out of the memory 154 to check the jam hysteresis information of the first fixing device 150 here, because there is a possibility that the first fixing device 150 is replaced at the timing of opening the front door 140 for the jam clearance operation.

When the start-up sequence S20410 of the first fixing device 150 or the warming-up process S20407 is completed, the CPU301 resumes the image forming operation of the image forming apparatus 400, that is, the interruption is stopped (S20411).

In addition, the CPU301 displays "printing" or the like on the operating portion 180 to notify the operator of the execution of the printing of the image forming apparatus 400 (S20414).

Thereafter, the operation returns to step S20402, where the CPU301 continues the execution of the printing job until the end of the job (S20402, S20403).

As described hereinbefore, the exchange of the first fixing device 150 by the operator requires opening and closing of the front door 140 of the image forming apparatus 400. That is, when the front door 140 of the image forming apparatus 400 is opened by the operator, the first fixing device 150 may be exchanged. In addition, the first fixing device 150 may be exchanged during off period of the main switch 101. Therefore, in response to switching-on of the main switch 101 of the image forming apparatus 400 and the closing of the front door 140, the information is read out of the memory 154 of the first fixing device 150 and the main assembly memory 312 to acquire the jam hysteresis information of the first fixing device 150. By this, even if the first fixing device 150 not having been subjected to the cleaning process after the jam clearance operation is remounted to the image forming apparatus 400, the cleaning process is executed, and therefore, the deterioration of the image quality can be suppressed.

In addition, the main assembly memory 312 and the memory 154 store the time information together with the jam hysteresis (cleaning information), so that the cleaning process can be executed on the basis of the later cleaning information. By this, even when, for example, the first fixing device 150 for which the cleaning process to be executed after the jam clearance operation has not been executed in another image forming apparatus (having the same structure as the image forming apparatus 400) is mounted in the image forming apparatus 400, the deterioration of the image quality on the outputted recording material 102 can be suppressed.

The description has been made with respect to the first fixing device 150, but the same applies to the second fixing device 170.

[Embodiment 25]

In Embodiment 24, the information indicative of whether or not the cleaning process to be executed after the jam clearance operation in the fixing portion has been carried out is stored in the memory of the fixing device and in the main assembly memory of the image forming apparatus. On the basis of the information, the CPU301 discriminates whether to execute the cleaning process for the remounted fixing device.

The case that the cleaning process operation to be executed after the jam clearance operation in the fixing portion is interrupted will be described, in Embodiment 25. In Embodiments 25, when the first fixing device 150 for which the cleaning process is interrupted is remounted in the image forming apparatus, a short cleaning process which is shorter than the cleaning process of Embodiment 24.

In the description of this embodiment, the same reference numerals as in Embodiment 1 are assigned to the elements having the corresponding functions in this embodiment, and the detailed description thereof is omitted for simplicity.

The description will be further made, taking the first fixing device 150 as an example. The same applies to the second fixing device 170.

When the operator opens the front door 140 during the prosecution of the cleaning process, for example, the CPU301 interrupts the cleaning process. The CPU301 detects the opening of the front door 140 on the basis of the signal from the opening and closing sensor 305.

In Embodiment 24, the jam hysteresis information is cleared from the memory 154 and the main assembly memory 312 after the completion of the cleaning process. Therefore, if the operator opens the front door 140 and takes the first fixing device 150 out of the image forming apparatus during the execution of the cleaning process, the jam hysteresis information stored in the memory 154 and that in the main assembly memory 312 are not cleared. When the first fixing device 150 is remounted by the operator, the CPU301 executes in the cleaning process from the beginning.

However, if the cleaning process is already executed up to 80 sec of 100 sec at the time when the cleaning process is interrupted, the contamination of the fixing roller 151 with toner has been removed to a quite large extent. Despite the fact, if the cleaning process is executed for 100 sec, the waiting time of the operator is wastefully long.

Under the circumstances, when the first fixing device 150 for which the cleaning process has been interrupted is remounted, a short cleaning process operation (shorter than the cleaning process of Embodiment 1) is carried out.

More particularly, the cleaning hysteresis as the cleaning information is stored in the memory 154 of the first fixing device 150 and in the main assembly memory 312. The cleaning hysteresis includes "executed", "interrupted" and "no hysteresis" (three kinds) as to the cleaning process (100 sec in this embodiment) to be executed after the jam clearance operation for the fixing portion. If the latest one of the cleaning hysteresis stored in the memory 154 and the cleaning hysteresis stored in the main assembly memory 312 indicates "no hysteresis" (data cleared), it is discriminated that the cleaning process has not being executed, and the cleaning process operation is executed for 100 sec. On the other hand, if the latest one of the cleaning hysteresis stored in the memory 154 and the cleaning hysteresis stored in the main assembly memory 312 indicates "interrupted", the short cleaning process (50 sec) which is shorter than the above-described cleaning process (100 sec) is carried out. If the latest one of the cleaning hysteresis stored in the memory 154 and the cleaning hysteresis stored in the main assembly memory 312 indicates "executed", the cleaning process or the short cleaning process is executed.

(Control Flow)

The description will be made in conjunction with FIGS. 32-37. The operations of the flow charts are carried out by the CPU301 functioning as the executing portion (recording portion, writing portion) controlling the related mechanisms of the image forming apparatus 400 in accordance with the control program stored in the ROM 303. The description will be made as to the first fixing device 150, but the same applies to the second fixing device 170.

(Start-up Sequence)

The start-up sequence flow in Embodiment 25 is different from that of Embodiment 24. FIG. 32 is a flow chart of the start-up sequential operations. The flow chart of FIG. 32 shows the details of the start-up sequence 6 in steps S20812, S20902 and S201003 which will be described hereinafter.

First, the CPU301 reads out the data stored in the memory 154 of the first fixing device 150 mounted in the first mounting portion 141 (S20501).

The CPU301 reads the data stored in the main assembly memory 312 (S20502).

In the step S20503, the CPU301 discriminates whether or not the main assembly memory 312 stores of the information about the ID of the first fixing device 150 read out in the step S20501. More particularly, the CPU301 searches the data for the ID of the first fixing device 150 read out in the step S20501, in the main assembly memory 312.

When the main assembly memory 312 stores the ID of the first fixing device 150 read out in the step S20501, the CPU301 proceeds to a step S20504 (S20503, Yes).

If, on the other hand, the main assembly memory 312 does not store the data for the ID of the first fixing device 150 read out in the step S20501, the CPU301 proceeds to a step S20505 (S20503, No). In this case, the main assembly memory 312 does not store the information relating to the cleaning hysteresis of the first fixing device 150 mounted in the image forming apparatus 400.

If the result of discrimination in the step S20503 is Yes, the CPU301 determines which of the cleaning information stored in the memory 154 and the cleaning hysteresis stored in the main assembly memory 312 is to be used (S20504). More particularly, the CPU301 checks which one of the recording time of the information stored in the memory 154 and the information stored in the main assembly memory 312 is later.

If the time of the information recording of the memory 154 is later than that of the main assembly memory 312, the CPU301 proceed to the step S20505 (S20504, Yes).

On the other hand, when the information regarding time of the memory 154 is later than that stored in the main assembly memory 312 corresponding to the ID of the first fixing device 150, the CPU301 proceeds to the step S20506 (S20504, No). When they are the same, the CPU301 proceeds to the steps S20506 (S20504, No).

The step S20505 includes the sequence shown in FIG. 33, and the CPU301 makes discrimination on the basis of the cleaning hysteresis of the memory 154 of the first fixing device 150. The detail of the operation will be described hereinafter.

The step S20506 includes the sequence shown in FIG. 34, and the CPU301 makes discrimination on the basis of the cleaning hysteresis of the main assembly memory. The detail of the operation will be described hereinafter.

(Sequence Based on Information on Memory of Fixing Device)

FIG. 33 is there flow chart showing the sequence based on the memory information of the fixing device and corresponds to the step S20505 in FIG. 32.

If in the step S20601, the cleaning hysteresis of the memory 154 is "executed", the CPU301 proceeds to a step S20602 (S20601, Yes).

In step S20602, the CPU301 records the cleaning hysteresis of "executed" of the first fixing device 150 in the main assembly memory 312 together with the ID of the first fixing device 150 and the current time. More particularly, the CPU copies the cleaning hysteresis in the memory 154 and the time stored in the memory 154 (the time at which the cleaning hysteresis of the memory 154 it written in the memory 154) into the main assembly memory 312.

In step S20603, the CPU301 executes the above-described warming-up process.

If the cleaning hysteresis of the memory 154 is "executed", the CPU301 completes the sequence based on the fixing device memory information shown in S20505 of FIG. 32, without executing the cleaning process.

On the other hand, the cleaning hysteresis of the memory 154 is other than "executed" in the step S20601, the CPU301 proceeds to step S20604 (S20601, No).

If the cleaning hysteresis of the memory 154 is other than "executed", and is not "interrupted" (that is, "no hysteresis" (not executed)), the CPU301 proceed to S20605 (S20604). The CPU301 controls the cleaning portion to carry out the above-described cleaning process (S20605).

If the cleaning hysteresis of the memory 154 is other than "executed" and is "interrupted", the operation proceeds to S20606 (S20604), the CPU301 executes the above-described short cleaning process (S20606).

If the cleaning operation is not interrupted during the cleaning process or the short cleaning process (the process is completed), the CPU301 proceeds to the step S20608 (S20607).

In step S20608, the CPU301 records the cleaning hysteresis of "executed" in the main assembly memory 312. The cleaning hysteresis recorded by the CPU301 at this time, is the cleaning hysteresis for the ID of the first fixing device 150.

In step S20609, the CPU301 records the cleaning hysteresis of "executed" in the memory 154 of the first fixing device 150. More particularly, the CPU copies the date of the cleaning hysteresis recorded in the main assembly memory 312 in the step S20608 Into the memory 154.

In step S20610, the CPU301 records the time both in the memory 154 and the main assembly memory 312. It is recorded in combination with the ID of the first fixing device 150 in the main assembly memory 312. In this embodiment, the recorded time is the time at which the process of the S20609 is completed.

The CPU301 controls the first fixing device 150 to carry out the above-described warming-up process (S20611). Here, the sequence based on the fixing device memory information shown in the step S20505 of FIG. 32 is completed.

On the other hand, if the cleaning process or the short cleaning process is interrupted during the execution, the CPU301 records the cleaning hysteresis "interrupted" in the main assembly memory 312 and the memory 154, and the sequence based on the information of the fixing device memory in the step S20505 in FIG. 32.

If the cleaning process or the short cleaning process is interrupted during the execution, the CPU301 proceeds to S20612 (S20607).

In step S20612, the CPU301 records the cleaning hysteresis of "interrupted" in the main assembly memory 312. The cleaning hysteresis recorded by the CPU301 at this time, is the cleaning hysteresis for the ID of the first fixing device 150.

In step S20613, the CPU301 records the cleaning hysteresis of "interrupted" in the memory 154 of the first fixing device 150. More particularly, the CPU copies the date of the cleaning hysteresis recorded in the main assembly memory 312 in the step S20608 Into the memory 154. Even when the front door 140 is opened, the image forming apparatus 100 and the first fixing device 150 are supplied with the electric energy, and therefore, the CPU301 can write the "interrupted" in the memory 154.

In step S20614, the CPU301 records the time both in the memory 154 and the main assembly memory 312. It is recorded in combination with the ID of the first fixing device 150 in the main assembly memory 312. In this embodiment, the time is the time at which the process of the step S20613 is completed.

In the steps S20602, S20608 and S20612, if the cleaning hysteresis corresponding to the ID of the first fixing device 150 in the main assembly memory 312 is the same as the cleaning hysteresis to be recorded, the cleaning hysteresis may not be changed. In this case, in the step S20602, the CPU301 rewrites only the time.

In the steps S20602, S20608 and S20612, if the main assembly memory 312 does not contain any information about the ID of the first fixing device 150, the CPU301 records the cleaning hysteresis and the ID of the first fixing device 150 in combination. The ID of the first fixing device 150 is acquired by the CPU301 in the step S20501 in FIG. 32.

(Sequence Based on Information in the Main Assembly Memory)

FIG. 34 is a flow chart showing the sequence based on the information in the main assembly memory and corresponds to the step S20506 in FIG. 32.

If the cleaning hysteresis of the main assembly memory 312 is "executed", the CPU301 proceeds to step S20707, and the cleaning hysteresis is other than "executed", the CPU301 proceeds to step S20702 (S20701).

If the cleaning hysteresis of the main assembly memory 312 is other than "executed" and is not "interrupted" (that is, "no hysteresis" (non-executed)), the CPU301 proceeds to step S20703 (S20702, No).

In step S20703, the CPU301 executes the above-described cleaning process.

If the cleaning hysteresis of the main assembly memory 312 is other than "executed", and is "interrupted", the CPU301 proceeds to step S20704 (S20702, Yes).

In step S20704, the CPU301 executes the above-described short cleaning process.

If the cleaning operation is not interrupted during the cleaning process or the short cleaning process (the process is completed), the CPU301 proceeds to the step S20706 (S20705).

The steps S20706, S20707, S20708 and S20709 are the same as the steps S20608, S20609, S20610 and S20611, respectively, and therefore, the description thereof is omitted.

By the execution of the step S20709, the sequence based on the information of the main assembly memory shown in S20506 in FIG. 32 is completed.

On the other hand, if the cleaning process or the short cleaning process is interrupted during the execution, the CPU301 records the cleaning hysteresis "interrupted" in the main assembly memory 312 and the memory 154, and the sequence based on the information of the main assembly memory shown in S20506 in FIG. 32 is interrupted.

If the cleaning process or the short cleaning process is interrupted during the execution, the CPU301 proceeds to S20710 (S20705).

The steps S20710, S20711 and S20712 are the same as the steps S20612, S20613 and S20614, respectively, and therefore, the description thereof is omitted.

In the steps S20707, S20711, if the cleaning hysteresis stored in the memory 154 is the same as the cleaning hysteresis to be recorded, the cleaning hysteresis may not be changed.

As described, the start-up sequence 6 (FIG. 32) including that the sequence (FIG. 33) based on the information in the memory of the fixing device and the sequence (FIG. 34) based on a main assembly memory, and therefore, the following advantageous are provided.

By not executing the cleaning process in the case of unnecessity, the time required from the actuation of the main switch 101 to the capable image forming operation can be saved by 100 sec.

In addition, when the short cleaning process is enough, the short cleaning process is carried out. By this, the time from the actuation of the main switch 101 to the enabled image formation of the image forming apparatus 100 can be reduced (by 50 sec).

The execution time of the short cleaning process may be variable depending on the cleaning time executed until the interruption. In such a case, the executed cleaning time until the interruption of the cleaning process is counted by a timer 307. The CPU301 records the information indicative of the cleaning time (or execution time period of the short cleaning process) by the interruption of the cleaning process in combination with the cleaning hysteresis (S20612, S20613 in FIG. 33, S20710, S20711 in FIG. 34). In addition, the CPU301 reads the information indicative of the cleaning time period together with the cleaning hysteresis out of the memory 154 (S20501 in FIG. 32). The CPU301 executes the short cleaning process for a period determined on the basis of the read time period (S20606 in FIG. 33, S20704 in FIG. 34).

At this time, the period of the time of the short cleaning process is not necessarily the difference between the cleaning process time without interruption and the cleaning time up to the interruption. For example, when the cleaning process of 100 sec is interrupted at the timing at less than 50 sec, the short cleaning process may be executed for 80 sec, and when the cleaning process is interrupted more than 50 and less than 100, the short cleaning process may be carried out for 30 sec.

If the executed cleaning process operation is less than a predetermined level, the cleaning process may be fully executed from the beginning, by the CPU301 keeping the cleaning hysteresis cleared in steps S20612, S20613, S20710 and S20711.

When the first fixing device 150 for which the cleaning process has been interrupted is remounted, the operator may determine whether to execute the short cleaning process or not. That is, the apparatus may be constructed in such that the operator is capable of selecting a mode in which the cleaning operation is carried out from the beginning as in Embodiment 1 or a mode in which the short cleaning process is carried out as in Embodiment 2. The operating portion 180 displays these modes on the screen to permit the operator to select one of them. If the selected mode is the former mode, and the cleaning process operation is interrupted, the CPU301 keeps the cleaning hysteresis cleared to execute the cleaning process from the beginning in step S20612, S20613, S20710 and S20711.

(Sequence Upon Jam Occurrence)

FIG. 35 is a flow chart of the operations at the time when sheet jamming occurs in the fixing device. More particularly, it is a flow chart during the execution of the printing job execution of the image forming apparatus 400.

As to steps S20801-S20807, they are the same as the steps S20401-S20407 of FIG. 29, and therefore, the description is omitted.

In step S20808, the CPU301 clears the cleaning hysteresis corresponding to the ID of the first fixing device 150 mounted in the image forming apparatus 400 from the main assembly memory 312. By this, the cleaning hysteresis becomes "no hysteresis" which indicates the non-execution of the above-described cleaning process. The ID of the first fixing device 150 mounted in the image forming apparatus 400 is already acquired by the CPU301 at the time of the actuation of the main switch, the opening of the front door 140, the above-described start-up sequence 5 (FIG. 28) executed after the jam clearance operation (S20501).

In step S20809, the CPU301 clears the cleaning hysteresis in the memory 154 of the first fixing device 150. More particularly, the data (cleared state) of the cleaning hysteresis stored in the main assembly memory 312 in the step S20808 is copied into the memory 154.

In step S20810, the CPU301 records the time both in the memory 154 and the main assembly memory 312. It is recorded in combination with the ID of the first fixing device 150 in the main assembly memory 312. In this embodiment, the time is the time at which the process of the step S20809 is completed.

A step S20811 is the same as the S20411 of FIG. 29, and therefore, the description thereof is omitted.

In a step S20812, the CPU301 executes the start-up sequence 6 of FIG. 32.

As to steps S20813-S20814, they are the same as the steps S20413-S20414 of FIG. 29, and therefore, the description is omitted.

(Sequence Upon Actuation of the Main Switch and Upon Closing the Front Door)

FIG. 36 is a flow chart showing the operations from the actuation of a main switch to a stand-by mode. Steps S20901 and S20903 are the same as the steps S20101 and S20103 of FIG. 26, respectively. In a step S20902, the CPU301 executes the start-up sequence 6 of FIG. 32.

FIG. 37 is a flow chart showing the operations from the state in which a front door is open to the stand-by mode. Steps S201001, S201002 and S201004 are the same as the steps S20201, S20202 and S20204 of FIG. 27, respectively. In a step S201003, the CPU301 executes the start-up sequence 6 of FIG. 32.

[Embodiment 26]

In Embodiment 24 and Embodiment 25, as the information for determining whether to use the cleaning information of the memory 154 or the cleaning information of the main assembly memory 312, the CPU301 stores the time information in the memory 154 and the main assembly memory 312 The same applies to the second fixing device 170.

In this embodiment, information indicative of a number of recordings in the memory 154 is stored in place of the time information.

The description will be made about the difference from the Embodiment 24. Yeah the structures in this embodiment are the same as those of the Embodiment 24, and therefore, the detailed description thereof is omitted.

The description will be made as to the first fixing device 150, but the same applies to the second fixing device 170.

In this embodiment, the memory 154 of the first fixing device 150 as the fixing storing portion stores the cleaning information and the cumulative number (number information) of the recordings of the cleaning information in the memory 154. In addition, the memory 154 stores the ID of the fixing device (fixing device A, for example) as the identifying information of the fixing device, and the memory 154 functions as a discrimination portion.

On the other hand, the main assembly memory 312 of the main assembly storing portion stores the same number as the number (number information) recorded in the memory 154, the cleaning information, fixing device ID of the first fixing device 150 in combination.

The cleaning information includes "hysteresis yes" and "hysteresis no" as the jam hysteresis stored in the main assembly memory 312 and a memory 154, similarly to Embodiment 24.

The number information is stored to be used in the determination as to whether cleaning the information stored in the memory 154 or the cleaning information stored in the main assembly memory 312 is to be used. The CPU301 renews the number information stored in the memory 154 for each recording of the cleaning information in the memory 154.

More particularly, the CPU301 executes the cleaning process on the basis of the later one of the cleaning information stored in the main assembly memory 312 and the memory 154.

More particularly, the CPU301 compares the number information stored in the memory 154 of the first fixing device 150 mounted in the image forming apparatus 400 and the number information stored in the main assembly memory 312, and selects the one having the larger cumulative number. When the cleaning information corresponding to the larger number information is indicative of the non-execution of the cleaning process to be executed after the jam clearance operation in the fixing portion, the CPU301 executes the cleaning process operation.

In this embodiment, the cumulated value is the number of the recordings of the cleaning information in the memory 154, but the cumulative number may be counted including the number of recordings of other than the cleaning information in the memory 154. In such a case, if, for example, the information is recorded in the order of (1) writing of the information other than the cleaning information, (2) writing of the cleaning information, (3) writing of the cleaning information, then the cumulative number is three.

(Control Flow)

The description will be made in conjunction with FIGS. 38-41. The operations of the flow charts are carried out by the CPU301 functioning as the executing portion (recording portion, writing portion) controlling the related mechanisms of the image forming apparatus 400 in accordance with the control program stored in the ROM 303. The description will be made as to the first fixing device 150, but the same applies to the second fixing device 170.

(Sequence Upon Actuation of the Main Switch and Upon Closing the Front Door)

FIG. 38 is a flow chart showing the operations from the actuation of a main switch to a stand-by mode. Steps S201101 and S201103 are the same as the steps S20101 and S20103 of FIG. 26, respectively. In a step S201102, the CPU301 executes the start-up sequence seven of FIG. 40.

FIG. 39 is a flow chart showing the operations from the state in which a front door is open to the stand-by mode. Steps S201201, S201202 and S201204 are the same as the steps S20201, S20202 and S20204 of FIG. 27, respectively. In a step S201203, the CPU301 executes the start-up sequence seven of FIG. 40.

(Start-up Sequence)

FIG. 40 is a flow chart of the start-up sequential operations. The flow chart of FIG. 40 shows details of the steps S201102 and S201203 and a step S201412 which will be described hereinafter.

Steps S201301 and S201302 are the same as steps S20301, S20302 of FIG. 28, and therefore, the detailed description is omitted.

In the step S201303, the CPU301 discriminates whether or not the main assembly memory 312 stores of the information about the ID of the first fixing device 150 read out in the step S201301. If any data for the ID of the first fixing device 150 read out in the step S201301 is stored in the main assembly memory 312, the CPU301 proceeds to step S201304 (S201303, Yes). If, on the other hand, the main assembly memory 312 does not store the data for the ID of the first fixing device 150 read out in the step S201301, the CPU301 proceeds to the step S201305 (S201303, No).

If the result of discrimination in the step S201303 is Yes, the CPU301 discriminates which one of the jam hysteresis of the memory 154 and the jam hysteresis of the main assembly memory 312 is to be used (S201304). More specifically, the CPU301 checks whether or not the number of the number information stored in the memory 154 is larger than the number of the number information stored in the main assembly memory 312 for the ID of the first fixing device 150.

If the result of the checking is affirmative, the CPU301 proceeds to step S201305 (S201304, Yes).

If the result of the checking is negative, the CPU301 proceeds to step S201306 (S201304, No). If the numbers are the same, the CPU301 proceeds to step S201306 (S201304, No).

If the discrimination in the step S201303 is "No", and if the discrimination in the step S201304 is "Yes", the CPU301 makes discrimination on the basis of the jam hysteresis stored in the memory 154 of the first fixing device 150. That is, when the jam hysteresis of the first fixing device 150 is stored in the memory 154, the CPU301 proceeds to the step S201307, and when the jam hysteresis of the first fixing device 150 is not stored in the memory 154, the CPU301 proceeds to the step S201308 (S201305).

If, on the other hand, the result of discrimination in the step S201304 is "No", the CPU301 makes discrimination on the basis of the jam hysteresis stored in the main assembly memory 312. That is, when the jam hysteresis for the ID of the first fixing device 150 is stored in the main assembly memory 312, the CPU301 proceeds to the step S20307 (S20306, Yes).

The steps S201307-S201309 are the same as the steps S20307-S20309 in FIG. 28.

In step S201310, the CPU301 records the number information in the memory 154 and the main assembly memory 312. It is recorded in combination with the ID of the first fixing device 150 in the main assembly memory 312. Of the numbers compared in the step (the number stored in the memory 154 and the number stored in the main assembly memory 312 for the ID of the first fixing device 150), the larger number is N, and the number N+1 is recorded in step S201310. Here, N is an integer not less than zero. When the numbers compared in the step S201304 (the number stored in the memory 154 and the number stored in the main assembly memory 312 for the ID of the first fixing device 150 are the same (N), the number N+1 is recorded as the number information in step S201310.

The step S201311 is the same as the step S20311 in FIG. 28, and therefore, the description is omitted.

In this embodiment, if the number stored in the memory 154 is the same as the number stored in the main assembly memory 312 for the ID of the first fixing device 150, the cleaning process is executed on the basis of the jam hysteresis in the main assembly memory 312 (S201304, No in FIG. 40). When, however, they are the same, the cleaning process may be executed on the basis of the jam hysteresis in the memory 154. In such a case, if the result of the comparison in the step S201304 shows that the number of stored in the memory 154 is the same as the number stored in the main assembly memory 312 for the ID of the first fixing device 150, the CPU301 proceeds to the step S201305.

(Sequence Upon Jam Occurrence)

FIG. 41 is a flow chart of the operations at the time when sheet jamming occurs in the fixing device. More particularly, it is a flow chart in the printing job execution of the image forming apparatus 400.

The steps S201401-S201409 are the same as the steps S20401-S20409 in FIG. 29, and therefore, the description are omitted.

In step S201410, the CPU301 records the number information in the memory 154 and the main assembly memory 312. Assuming that the number of the number information recorded in the memory 154 and the main assembly memory 312 is M, the number M+1 is recorded. It is recorded in combination with the ID of the first fixing device 150 in the main assembly memory 312.

The number information stored in the memory 154 at the actuation of the main switch, at opening of the front door 140, and at the execution of the above-described start-up sequence 7 (FIG. 40) in S201310 is the same as the number information stored in the main assembly memory 312.

As described hereinbefore, the first fixing device 150 is liable to be replaced in the jam clearance operation. In view of this, after the detection of the jamming in the first fixing device 150, the jam hysteresis is recorded in the memory 154 by the time of removal of the first fixing device 150 for the jam clearance by the operator.

The step S201411 is the same as the step S20411 in FIG. 29, and therefore, the description is omitted.

The start-up sequence 5 of the step S201412 corresponds to the flow of FIG. 40. In the start-up sequence 7, the data in the memory 154 of the first fixing device 150 is read out (S201301). The information is read out of the memory 154 to check the jam hysteresis information of the first fixing device 150 here, because there is a possibility that the first fixing device 150 is replaced at the timing of opening the front door 140 for the jam clearance operation.

The steps S201413 and S201414 are the same as in the steps S20413 and S20414 in FIG. 29, and therefore, the description is omitted for simplicity.

Thereafter, the operation returns to step S201402, where the CPU301 continues the execution of the printing job until the end of the job (S201402 and S201403).

As described hereinbefore, the exchange of the first fixing device 150 by the operator requires opening and closing of the front door 140 of the image forming apparatus 100. That is, when the front door 140 of the image forming apparatus 100 is opened by the operator, the first fixing device 150 may be exchanged. In addition, the first fixing device 150 may be exchanged during off period of the main switch 101. Therefore, in response to switching-on of the main switch 101 of the image forming apparatus 400 and the closing of the front door 140, the information is read out of the memory 154 of the first fixing device 150 and the main assembly memory 312 to acquire the jam hysteresis information of the first fixing device 150. By this, even if the first fixing device 150 not having been subjected to the cleaning process after the jam clearance operation is remounted to the image forming apparatus 100, the cleaning process is executed, and therefore, the deterioration of the image quality can be suppressed.

By recording the number information in addition to the jam hysteresis (cleaning information) in the main assembly memory 312 and the memory 154, the cleaning process can be executed on the basis of the later cleaning information. By this, even when, for example, the first fixing device 150 for which the cleaning process to be executed after the jam clearance operation has not been executed in another image forming apparatus (having the same structure as the image forming apparatus 400) is mounted in the image forming apparatus 400, the deterioration of the image quality on the outputted recording material 102 can be suppressed.

In this embodiment, the number information is an integer not less than 0, and the number information is incremented by 1 by each recording of the information in the memory 154, but the recording method of the number information is not limited to this example.

In an alternative example, of the numbers compared in the step S201304 (the number information stored in the memory 154 and the number information stored in the main assembly memory 312 for the ID of the first fixing device 150), the large number is X. In the step S201310, the CPU301 records X+Y as the number information. In the step S201410, when the number of the number information already recorded in the memory 154 and the main assembly memory 312 is Z, the CPU301 records Z+Y as the number information in the memory 154 and the main assembly memory 312.

At this time, for example, the number Y may be set to be 0.1 (Y=0.1), and the number information may be incremented by 0.1 by each recording of the information in the memory 154. In such a case, the numbers (X, Y, X+Y, Z+Y) includes non-integer numbers.

At this time, for example, the number Y is set to be 2 (Y=2), the number information is incremented by 2 by each recording of the information in the memory 154.

At this time, for example, the number Y may be set to be −1 (Y=−1), and the number information may be decremented by 1 by each recording of information in the memory 154. In this case, the numbers (X, Y, X+Y, Z+Y) of the number information includes negative numbers. In this case, however, when the number of the number information in the memory 154 is smaller than the number of the number information stored in the main assembly memory 312 for the ID of the first fixing device 150, the CPU301 proceeds to the step S201305 (S201304, Yes). This is the case when, for example the number stored in the memory 154 is −4, and the number stored in the main assembly memory 312 is −2. On the other hand, if the number of the number information of the memory 154 is not smaller than the number of the number information of the main assembly memory 312 for the ID of the first fixing device 150, the CPU301 proceeds to the step S201306 (S201304, No).

In the foregoing description, the points different from Embodiment 24 have been described, but the recording of the number of the recordings in the memory 154 in place of the time information may be stored in Embodiment 25. The description of such a modification is omitted, because it is readily understood from the foregoing description by one skilled in the art.

[Embodiment 27]

In Embodiment 26, the information on which the CPU301 selects one of the cleaning information in the memory 154 and the cleaning information in the main assembly memory 312 is the number of the recordings in the memory 154 is stored in the memory 154 and the main assembly memory 312. The same applies to the second fixing device 170.

In this embodiment, a cumulative count of the recording materials 102 processed by the first fixing device 150 as the information on which the CPU301 selects one of the cleaning information in the memory 154 and the cleaning information in the main assembly memory 312.

The description will be made about the difference from the Embodiment 26. In the description of this embodiment, the same reference numerals as in Embodiments 24 and 26 are assigned to the elements having the corresponding functions in this embodiment, and the detailed description thereof is omitted for simplicity.

The description will be made as to the first fixing device 150, but the same applies to the second fixing device 170.

In this embodiment, the memory 154 of the first fixing device 150 as a fixing storing portion stores the cleaning information and the information (sheet number information) indicative of the cumulative count of the sheets (recording materials 102) fixed by the first fixing device 150. In addition, the memory 154 stores the ID of the fixing device (fixing device A, for example) as the identifying information of the fixing device, and the memory 154 functions as a discrimination portion.

On the other hand, the main assembly memory 312 as a main assembly storing portion stores the cleaning, the count and the fixing device ID of the first fixing device 150 in combination.

The cleaning information includes "hysteresis yes" and "hysteresis no" as the jam hysteresis stored in the main assembly memory 312 and a memory 154, similarly to Embodiment 24.

The sheet number information is stored as a basis for selecting one of the cleaning information stored in the memory 154 and the cleaning information stored in the main assembly memory 312.

The counter 314 shown in FIG. 25 counts the recording materials 102 fed into the first fixing device 150 to be subjected to the fixing process of the first fixing device 150. More particularly, with the feeding of the recording material 102 into the first fixing device 150, a sensor 155 detects passage of the recording material 102. The CPU301 increments the counter 314 for each detection of the recording material 102 by the sensor 155.

When the CPU301 records the cleaning information in the memory 154 and the main assembly memory 312, the CPU301 renews the sheet number information in memory 154 and the main assembly memory 312 on the basis of the count of the counter 314.

More particularly, the CPU301 executes the cleaning process on the basis of the later one of the cleaning information stored in the main assembly memory 312 and the memory 154.

More particularly, the CPU301 compares the sheet number information stored in the memory 154 of the first fixing device 150 mounted in the image forming apparatus 400 and the sheet number information stored in the main assembly memory 312, and determines which cumulative number is larger. When the cleaning information corresponding to the line number of sheet number information is indicative of non-execution of the cleaning process to be executed after the jam clearance operation in the fixing portion, the CPU301 executes the cleaning process.

As described hereinbefore, the exchange of the first fixing device 150 by the operator requires opening and closing of the front door 140 of the image forming apparatus 100. That is, when the front door 140 of the image forming apparatus 100 is opened by the operator, the first fixing device 150 may be exchanged. In addition, the first fixing device 150 may be exchanged during off period of the main switch 101. Therefore, in response to switching-on of the main switch 101 of the image forming apparatus 400 and the closing of the front door 140, the information is read out of the memory 154 of the first fixing device 150 and the main assembly memory 312 to acquire the jam hysteresis information of the first fixing device 150. By this, even if the first fixing device 150 not having been subjected to the cleaning process after the jam clearance operation is remounted to the image forming apparatus 400, the cleaning process is executed, and therefore, the deterioration of the image quality can be suppressed.

By the recording in the sheet number information together with the jam hysteresis (cleaning information) in the main assembly memory 312 and the memory 154, the cleaning process can be executed on the basis of the later cleaning information. By this, even when, for example, the first fixing device 150 for which the cleaning process to be executed after the jam clearance operation has not been executed in another image forming apparatus (having the same structure as the image forming apparatus 400) is mounted in the image forming apparatus 400, the deterioration of the image quality on the outputted recording material 102 can be suppressed.

(Control Flow)

Referring to the flow charts of FIGS. 38-40 (Embodiment 26) and FIG. 42, the description will be made. The other structures of this embodiment are the same as those of Embodiment 26, and therefore, the description of the common parts is omitted for the sake of simplicity. For the description of this embodiment, in S201304 and S201310 in FIG. 40, the number should read sheet number.

The sequence (FIGS. 38, 39) upon the closing of the front door and upon the actuation of the main switch, the description is similar to that of Embodiment 26, and therefore, the description is omitted.

As for the description of the start-up sequence 7 of FIG. 40 and the steps S201301-S201303 a similar to Embodiment 26, and therefore, the description is omitted.

If the discrimination in S201303 (FIG. 40) is Yes, the CPU301 determines as to which of the jam hysteresis in the memory 154 and the jam hysteresis in the main assembly memory 312 is to be used (S201304). More particularly, the CPU301 determines whether or not the value of the sheet number information stored in the memory 154 is larger than the value of the sheet number information stored in the main assembly memory 312 for the ID of the first fixing device 150.

If the result of the determination is affirmative, the CPU301 proceeds to a step S201305 (S201304, Yes).

On the other hand, if the result of the determination is negative, the CPU301 proceeds to a step S201306 ((S201304, No). If the numbers are the same, the CPU301 proceeds also to the step S201306 (S201304, No).

The steps S201305-S201309 are the same as those of Embodiment 26, and therefore, the description thereof is omitted.

In step S201310, the CPU301 records the sheet number information in the memory 154 and the main assembly memory 312. It is recorded in combination with the ID of the first fixing device 150 in the main assembly memory 312. The larger one of the compared numbers in the step S201304 is L, which is recorded as the sheet number information in step S201310. Here, L is an integer not less than zero. When the numbers compared in the step S201304 are the same, the number is not changed. The CPU301 said count of the counter 314 to 0.

The steps S201311-S201309 are the same as those of Embodiment 26, and therefore, the description thereof is omitted.

FIG. 42 is a flow chart of the operation to be executed upon the occurrence of the jamming in the fixing portion.

In the stand-by mode in which the image forming operation of the image forming apparatus 400 is possible, a printing job is received from the operating portion 180 or an external PC through an external I/F portion 304. Then, the CPU301 controls various mechanisms of the image forming apparatus 400 including the stations 120-123, the first fixing device 150 and the second fixing device 170, so that the image forming operation of the image forming apparatus 100 is started (S201501). When the printing job starts, the counter 314 starts to count. The counter 314 increments by one for each feeding of the recording material 102 into the first fixing device 150 for being subjected to the image fixing process.

After the completion of the printing job, the CPU301 proceeds to step S201515 (S201502). In step S201515, the CPU301 records the sheet number information in the memory 154 and the main assembly memory 312. The sheet number information is recorded such that the sheet number information is S20+T, where S20 is the number of the sheet number information recorded in the memory 154 and the main assembly memory 312, and T is the count of the counter 314. Here, S20 and T are integers not less than 0. It is recorded in combination with the ID of the first fixing device 150 in the main assembly memory 312. After the recording of the sheet number information on the memory 154 and the main assembly memory 312, the CPU301 sets the count of the counter 314 to 0.

By recording the latest sheet number information in the memory 154, the cleaning information stored in the memory 154 is the latest information, even when the first fixing device 150 is taken out of the image forming apparatus 400 after the completion of the printing job, and then mounted to another image forming apparatus.

If the CPU301 detects the occurrence of the sheet jamming in the image forming apparatus 400 before the completion of the printing job (S201502) (S201503), the image forming operation of the image forming apparatus 100 is stopped, that is, the printing job is interrupted (S201504). The CPU301 detects the occurrence of the jamming in the image forming apparatus 400 on the basis of the signals from the sensor group 306.

When no jamming in the image forming apparatus 400 is detected, the CPU301 continues the execution of the printing job up to the end of the printing job (S201502, S201503).

The steps S201505-S201509 are similar to the steps S201401-S201409 in FIG. 41, and therefore, the description thereof is omitted for simplicity.

In step S201510, the CPU301 records the sheet number information in the memory 154 and the main assembly memory 312. The sheet number information is recorded such that the sheet number information is S20+T, where S20 is the number of the sheet number information recorded in the memory 154 and the main assembly memory 312, and T is the count of the counter 314. Here, S20 and T are integers not less than 0. It is recorded in combination with the ID of the first fixing device 150 in the main assembly memory 312. After the recording of the sheet number information on the memory 154 and the main assembly memory 312, the CPU301 sets the count of the counter 314 to 0.

The sheet number information stored in the memory 154 at the actuation of the main switch, at the opening of the front door 140, and at the execution of the above-described start-up sequence 7 (FIG. 40) in S201310 the same as the sheet number information stored in the main assembly memory 312.

The steps S201511-S201514 are similar to the steps S201411-S201414, and therefore, the detailed description thereof is omitted.

In this embodiment, the sheet number information is stored in the main assembly memory 312 and the memory 154, but this may be replaced with the following. That is, the CPU301 may renew and record the sheet number information of the main assembly memory 312 and the memory 154 for each fixing process operation for the recording material 102 by the first fixing device 150. That is, the sheet number information of the main assembly memory 312 and the memory 154 is incremented by 1 for each one fixing operation of the recording material by the first fixing device 150.

In addition, in this embodiment, in the steps S201310, S201510 and S201515, the value of the counter 314 is set to 0, but the value of the counter 314 may be set to the sheet number information for the first fixing device 150. That is, when the sheet number information stored in the memory 154 and the sheet number information recorded in the main assembly memory 312 for the ID of the first fixing device 150 are different from each other, and the counter 314 is set to the larger number. When the sheet number information of the memory 154 and the sheet number information of the main assembly memory 312 are the same, the number is set in the counter 314. In this case, the sheet number information recorded in the memory 154 and the main assembly memory 312 by the CPU301 in the steps S201510 and S201515 is the count T of the counter 314.

In the foregoing description, the points different from the Embodiment 24 have been described, similarly to Embodiment 26, but Embodiment 25 may be modified by using the information Indicative of the cumulative count of the sheet number subjected to the fixing process of the first fixing device 150 in place of the time information. The description of such a modification is omitted, because it is readily understood from the foregoing description by one skilled in the art.

[Embodiment 28]

In the foregoing embodiments, the fixing device ID as the identifying information is stored in the memories 154, 174, and the memories 154, 174 function also as the discrimination portion, but the discrimination method of the fixing device is not limited to such an example.

For example, resistors as the discrimination portions are provided on the first fixing device 150, the second fixing device 170 and the replacement fixing device prepared outside the image forming apparatus 400, respectively.

These resistors (the resistors for the first fixing device 150, the second fixing device 170 and the replacement fixing device) have different resistance values to provide identifying information.

In the state that the first fixing device 150 is mounted in the image forming apparatus 400, the CPU301 detects a current flowing through the resistor upon the application of a predetermined voltage across the resistor of the first fixing device 150.

More particularly, the image forming apparatus 400 comprises a voltage application portion for applying the predetermined voltage to the resistor and an ammeter for measuring the current flowing through the resistor as the means for discriminating the first fixing device 150. The CPU301 monitors the output of the ammeter.

When the regular voltage is applied, the current corresponds to the resistance value one by one because of the Ohm's law. The CPU301 acquires an output of the ammeter predetermined the resistance of the resistor 1154. The first fixing device 150 and the replacement fixing device have the resistors having different resistance values, and therefore, the CPU301 is capable of discriminating the fixing device depending on the difference of the output of the ammeter. Thus, the resistance value is the identifying information.

The CPU301 stores the cleaning information and the time in the main assembly memory 312 in combination with the resistance value as the fixing device ID acquired from the resistor of the first fixing device 150 mounted in the main assembly of the apparatus.

In this case, the CPU301 acquires the resistance value of the resistor of the first fixing device 150 in the above-described manner, with the reading of the information from the memory 154 of the first fixing device 150 in the step S20301 of FIG. 28 (Embodiment 24), the step S20501 of FIG. 32 (Embodiment 25) or the step S201301 of FIG. 40.

The method of writing (recording) of the fixing device ID in the main assembly memory 312 is not limited to that described above. For example, the main assembly memory 312 stores a Table indicating the correspondence between names of the fixing devices and the resistance values of the resistors, and the cleaning information is stored relative to the name of the fixing device (fixing device A, for example).

In addition, the CPU301 may acquire the output of the ammeter, which may be used as the identifying information without determining the resistance value of the resistor. That is, the CPU301 may record the output of the ammeter as the ID of the fixing device.

The same applies to means for discriminating the second fixing device 170.

In this case, the discrimination member 311 shown in FIG. 25 includes the voltage application portion and the ammeter as the means for discriminating the first fixing device 150, and the voltage application portion and the ammeter as the means for discriminating the second fixing device 170. The CPU301 is connected with the discrimination member 311 and discriminates the first fixing device 150 and the second fixing device 170 when they are mounted in the image forming apparatus 400. When the first fixing device 150 is mounted in the image forming apparatus 400, the discrimination member 311 becomes capable of electrically connected with the resistor of the first fixing device 150. In addition, when second fixing device 170 is mounted in image forming apparatus 400, the discrimination member 311 becomes capable of electrically connecting with the resistor of the second fixing device 170.

[Embodiment 29]

As another method for discriminating the fixing device, a DIP switch including a plurality of switches may be provided on the fixing device (first fixing device 150, second fixing device 170, replacement fixing device) as a discrimination portion, for example.

More particularly, different switch or switches of the DIP switch is in the ON state depending on the fixing devices as the identifying information (combinations of the ON and OFF of the switches are different depending on the fixing devices). The CPU301 is connected with the DIP switch of the fixing device mounted in the image forming apparatus 200, and the switch in ON state produces a signal to the CPU301 in response to an input signal from the CPU301. The CPU301 detects the signal from the ON state switch (acquires the fixing device ID) to discriminate the fixing device.

It is assumed, for example, that the CPU301 supplies signals to both of the first and second switches. If the CPU301 detects the output signal from the first switch, the CPU301 identifies the fixing device as fixing device A, and if the CPU301 detects the output from the second switch, the CPU301 identifies the fixing device as fixing device B, and if the CPU301 detects the outputs from both of the first and second switches, the CPU301 identifies the fixing device as fixing device C.

In this case, the discrimination member 311 shown in FIG. 25 includes the DIP switch for discriminating the first fixing device 150 and the DIP switch for discriminating the second fixing device 170. The CPU301 is connected with the DIP switches (discrimination members 311) of the mounted first fixing device 150 and/or the second fixing device 170 and discriminates the first fixing device 150 and/or second fixing device 170 mounted in the image forming apparatus 400.

[Embodiment 30]

In the foregoing, when the cleaning process to be executed after the jam clearance operation in the fixing portion is completed, the warming-up process is executed without executing the cleaning process, but an exceptional process which will be described hereinafter may be executed. When it is said when the cleaning process to be executed after the jam clearance operation in the fixing portion is completed, the warming-up process is executed without executing the cleaning process, it does not exclude the case in which an exceptional process is executed as in this embodiment.

More particularly, the CPU301 may exceptionally execute the cleaning process even when the cleaning process after the jam clearance operation in the fixing portion is already executed.

For example, for the purpose of removing the contaminating toner accumulated in the plurality of fixing operations, the CPU301 executes such an exceptional cleaning process once per 100 start-up sequence operations. In such a case, the CPU301 stores the number of executions of the start-up sequence operations of the first fixing device 150 in the main assembly memory 312, and the exceptional process is carried out depending on the accumulated number of executions of the start-up sequence operations.

However, if the cleaning process is executed when the cleaning process is already completed, it is not possible to reduce the time required from the actuation of the main switch 101 to the image formation capable state of the image forming apparatus 400. Therefore, in this embodiment, it is preferable that when the cleaning process is already executed, the cleaning process is not executed, but the cleaning operation is only exceptionally executed.

The same applies to the second fixing device 170.

[Embodiment 31]

A plurality of image forming apparatuses 400 according to this embodiment may be combined to constitute an image forming system.

[Embodiment 32]

In the foregoing embodiments, the operating portion 180 is provided with a display screen and a selection key, the display screen may be touch panel which also functions as a selector.

[Embodiment 33]

With the fixing device exchangeable system, the operator may replace the fixing device with another fixing device depending on the kind of the recording material 102 used or the preference of the operator. In such a case, there is a possibility that the advantageous effects of the exchangeable fixing device (that is, a high quality print can be produced) is not provided, when the operator does not use the fixing device suitable for the recording material 102. In view of this, the image forming apparatus 400 may notify the operator of whether the recording material 102 preferred by the operator and the usage of the fixing device meet properly with each other or not.

The description will be made on the basis of Embodiment 24 (FIGS. 28 and 29) as to the method for the correspondence between the usage of the fixing device and the recording material 102 on which the image is to print. The other structures of this embodiment are the same as those of Embodiment 1, and therefore, the description of the common parts is omitted for the sake of simplicity. The description will be made as to the first fixing device 150, but the same applies to the second fixing device 170.

The memory 154 of the first fixing device 150 stores limiting the information indicative of the kinds of the recording material 102 which is not suitable with the first fixing device 150, and therefore, it functions as a limiting information portion.

In the step S20301 of FIG. 28, the CPU301 acquires and the limiting the information together with acquiring the information in the memory 154 of the first fixing device 150 mounted in the image forming apparatus 400 The CPU301 discriminates the kind of the recording material 102 to be prevented on the basis of the limiting information.

In this step S20401 of FIG. 29, when the CPU301 receives the printing job from the operator, the CPU301 makes non-selectable the kinds of the recording material 102 not suitable for the first fixing device 150 on the selection screen.

Thus, the printing operation using improper first fixing device 150 can be prevented, thus assuring high quality prints.

In this embodiment, the limiting information portion includes the memories 154, 174, but the following structure is usable alternatively.

For example, a resistor is used. the first fixing device 150 is provided with a resistor functioning as a limiting information portion. The fixing device prepared outside the image forming apparatus 400 as a replacement fixing device is also provided with a resistor as the limiting information portion. The resistance value is different depending on the kind of the recording material 102 for which the fixing process of the first fixing device 150 is limited, and functions as the information for limiting the kind of the recording material 102 for use in the fixing process of the first fixing device 150. The method for the CPU301 to acquire the limiting information it similar to the method for acquiring the ID resistor of the fixing device in the foregoing embodiments, and therefore, the description is omitted.

In the main assembly memory 312, the information indicative of the kind of the recording material 102 to be limited in the fixing process corresponding to the resistance value (limiting information) of the memory (limiting information portion) is stored beforehand. For example, when the resistance value is R4, the fixing on envelope is prevented, and when the resistance value is R5, the fixing on thick sheet is prevented.

The information corresponding to the kinds of the recording material 102 to be prevented may not be stored in the main assembly memory 312 in combination with the limiting information. For example, the program executed by the CPU301 may prevent the fixing process on the recording material 102 depending on the resistance value of the resistor (limiting information portion). In such a case, the program is stored in the ROM 303.

For example, the limiting information portion provided on the fixing device (first fixing device 150, second fixing device 170 and replacement fixing device) may be DIP switch including a plurality of switches. In such a case, the switches different depending on the fixing devices are in ON state beforehand as the limiting information, and the CPU301 determines the kind of the recording material 102 to be prevented on the basis of the signal from the ON state switches. The other structures are the same as those of the DIP switch as the discrimination portion described hereinbefore.

In this embodiment, the limiting information portion and the discrimination portion are separate members on the fixing device, but one resistor or memory may include the limiting information portion and the discrimination portion.

This embodiment has been described in conjunction with Embodiment 24, but is usable with Embodiments 25-27. The description in the case is used with Embodiments 25-27 is omitted, because the description of the present invention applies to such cases.

[Embodiment 34]

The collection rotatable member may be a hollow roller (external heating member) including a heater therein to heat the fixing rollers 151, 171 from the outside of the fixing rollers 151, 171.

In the foregoing description, the cleaning portion is provided in the fixing roller (151) side, but it may be provided in the pressing belt (152) (rotatable member) side, and the toner is transferred from the surface of the fixing roller 151 onto the pressing belt 152, and then it is removed. In such a case, in the cleaning operation, in order to transfer the toner from the surface of the fixing roller 151 onto the pressing belt 152, the fixing roller 151 is contacted to the pressing belt 152. Similar to the foregoing examples, it is preferable that before the cleaning process is started, the pressing belt 152 is warmed to such an extent that the toner is not solidified, and then the cleaning process is carried out. The same applies to the second fixing device 170.

In the foregoing examples, the web cleaner (156-160) is used to effect the cleaning process after the jam clearance in the fixing portion (first fixing device 150, second fixing device 170), but the structure for the cleaning process is not limited to the specific structure. For example, by employing sponge rollers driven by the fixing rollers 151, 171, the cleaning may be effected.

[Embodiment 35]

In the foregoing examples, the cleaning process to be executed for the fixing portion (first fixing device 150, second fixing device 170) after the jam clearance operation is executed using a web cleaner (156-160), but the present invention is not limited to that.

The cleaning may be carried out using the recording material 102.

With this method, the contaminating toner on the fixing roller 151 and/or fixing roller 171 resulting from the occurrence of the jam in the fixing portion can be removed, even if the cleaning mechanism such as the above-described web cleaner is not provided. More particularly, when the cleaning operation is carried out, a plurality of recording materials 102 are forcedly passed through the fixing portion (first fixing device 150, second fixing device 170) to transfer the contaminating toner onto the recording materials 102. Thereafter, the recording materials 102 carrying the toner are discharged to the outside of the image forming apparatus 100.

When the information stored in the memory 154 indicates the non-execution of the cleaning process, the CPU301 controls the feeding portion 308 to pass the predetermined number of recording materials 102 through the first fixing device 150 (second fixing device 170) and discharged them to the outside of the apparatus.

The same applies to the second fixing device 170.

The number of the recording materials 102 may be predetermined, and in this embodiment, it is 10.

[Embodiments 36]

However, the present invention is applicable to an image forming apparatus 400 comprising only one fixing device 150.

[Embodiment 37]

In the foregoing embodiments, the image forming apparatus 400 comprises the image forming stations (120-123) for forming yellow, magenta, cyan and black toner images (color image forming apparatus), but the present invention is applicable to a monochromatic image forming apparatus. For example, there is a monochromatic for forming the toner images in black only.

[Embodiment 38]

In the foregoing embodiments, the image forming apparatus 400 comprises an intermediary transfer belt 115 as an intermediary transfer member (intermediary transfer type), but the present invention is applicable to a direct transfer type apparatus as follows.

In such a case, the image forming station 309 includes the image forming stations (120-123) and a transfer feeding belt functioning as a transfer portion. The image forming stations (120-123) can be contacted by the transfer feeding belt. The image forming apparatus 400 feeds the recording material 102 from a recording material accommodating portion 103 to the transfer feeding belt. The transfer feeding belt electrostatically attracts the recording material 102 and carries it to a position where the recording material 102 is faced to the image forming station, and a transfer roller is provided in the inside of the belt. The transfer roller transfers the toner image formed on the image bearing member onto the recording material 102 carried on the transfer feeding belt. By this, the toner image (unfixed) is formed on the recording material 102.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-132170 filed on Jun. 30, 2015, 2015-132171 filed on Jun. 30, 2015 and 2015-132173 filed on Jun. 30, 2015, which are hereby incorporated by reference herein in their entirety.

What is claimed is:

1. An image forming apparatus comprising:

a main assembly;

an image forming station configured to form an unfixed toner image on a recording material;

a fixing portion detachably mountable to said main assembly, said fixing portion including a first rotatable member for being contacted by such a surface of the recording material which carries the unfixed toner image formed by said image forming station to fix the unfixed toner image on the recording material;

a jam detecting portion configured to detect jamming in said fixing portion;

an executing portion configured to execute a cleaning process for cleaning said first rotatable member after clearance of the jamming detected by said jam detecting portion;

a storing portion provided on said fixing portion and configured to store information indicative of whether or not the cleaning process is executed by said executing portion; and a notifying portion configured to notify an operator of a state of capability of an image forming operation on the recording material, of said image forming apparatus, wherein, when the information stored in said storing portion of said fixing portion mounted in said main assembly indicates non-execution of the cleaning process, said executing portion executes the cleaning process before said notifying portion executes the notification.

2. An apparatus according to claim 1, wherein, when the information stored in said storing portion of said fixing portion mounted in said main assembly indicates the cleaning process is already executed, said executing portion causes said notifying portion to notify the state of capability of image forming operation, on the recording material, of said image forming apparatus, without executing the cleaning process.

3. An image forming system comprising an image forming apparatus including:

a main assembly;

an image forming station configured to form an unfixed toner image on a recording material;

a fixing portion exchangeable with another fixing portion, said fixing portion including a rotatable member contactable to a surface of the recording material which carries the unfixed toner image, and a discrimination portion configured to provide identifying information for discriminating from said other fixing portion;

a jam detecting portion configured to detect a jam in said fixing portion;

an executing portion configured to execute a cleaning process for cleaning said rotatable member after clearance of the jam detected by said jam detecting portion; and a notifying portion configured to notify an operator of a state of capability of an image forming operation on the recording material, of said image forming apparatus; and a storing device configured to communicate and connect with said image forming apparatus, and configured to store cleaning information indicative of whether or not the cleaning process is executed by said executing portion in correlation with the identifying information of said fixing portion mounted in said main assembly of said main assembly of the image forming apparatus, wherein, when the cleaning information stored in said storing device in correlation with the identifying information, indicated by said discriminating portion of said fixing portion mounted in said image forming apparatus, indicates non-execution of the cleaning process, said executing portion executes the cleaning process before said notifying portion executes the notification.

4. A system according to claim 3, wherein, when the cleaning information stored in said storing device in correlation with the identifying information, indicated by said discrimination portion of said fixing portion mounted in said image forming apparatus, indicates the cleaning process is already executed, said executing portion causes said notifying portion to notify the state of capability of image forming operation, on the recording material, of said image forming apparatus, without executing the cleaning process.

5. An image forming apparatus comprising:

a main assembly;

an image forming station configured to form an unfixed toner image on a recording material;

a fixing portion exchangeable with another fixing portion, said fixing portion including a first rotatable member contactable to a surface of the recording material which carries the unfixed toner image, a fixing storing portion configured to store cleaning information, and a discrimination portion configured to provide identifying information for discriminating from said another fixing portion;

a jam detecting portion configured to detect a jam in said fixing portion;

an executing portion configured to execute a cleaning process for cleaning said first rotatable member after clearance of the jamming detected by said jam detecting portion;

a main assembly storing portion capable of storing information;

a writing portion configured to write cleaning information indicative of whether or not the cleaning process is already executed by said executing portion in said fixing storing portion, and to write the cleaning information in said main assembly storing portion in correlation with the identifying information; and a notifying portion configured to notify an operator of a state of capability of image forming operation, on the recording material, of said image forming apparatus, wherein, when the cleaning information acquired from said fixing storing portion and the information acquired for said main assembly storing portion indicate non-execution of the cleaning process for said fixing portion mounted in said image forming apparatus, said executing portion executes the cleaning process before said notifying portion executes the notification.

6. An apparatus according to claim 5, further comprising an output portion configured to output information indicative of time, wherein said writing portion writes the cleaning information in said main assembly storing portion in correlation with the identifying information and with the time information provided by said output portion, and writes the cleaning information in said fixing storing portion in correlation with the time information, and wherein, when one of the cleaning information stored in said fixing storing portion and the cleaning information stored in main assembly storing portion, correlating to later time information, indicates non-execution of the cleaning process, said executing portion executes the cleaning process before said notifying portion executes the notification.

7. A fixing device detachably mountable to an image forming apparatus, said fixing device comprising:

a rotatable member for being contacted by a surface of a recording material which carries an unfixed toner image formed by an image forming station to fix the unfixed toner image on the recording material;

a cleaning portion configured to clean said rotatable member; and a storing portion configured to store information indicative of whether or not a cleaning process of said cleaning portion is executed upon a clearance operation for a jam in said fixing device.

8. An image forming apparatus comprising: an image forming portion configured to form an unfixed toner image on a recording material;

a mounting portion;

a fixing portion mounted in said mounting portion, said fixing portion being replaceable with another fixing portion that is mountable to said mounting portion, said mounted fixing portion including:

a storing portion for storing information, and a rotatable member contactable to a surface of the recording material, which carries the unfixed toner image, during a fixing operation;

a jam detecting portion configured to detect an occurrence of a jam in said mounted fixing portion;

a writing portion configured to write cleaning information, indicating whether a cleaning process for cleaning said rotatable member of said mounted fixing portion after clearance of the jam is already executed, into said storing portion of said mounted fixing portion, said writing portion writing, as the cleaning information, (i) information indicating non-execution of the cleaning process into said storing portion of said mounted fixing portion when said jam detecting portion detects the occurrence of the jam in said mounted fixing portion, and (ii) information indicating the cleaning process is already executed into said storing portion of said mounted fixing portion at least in response to execution of the cleaning process;

a notifying portion configured to notify an operator of a state of capability of said image forming apparatus to perform an image forming operation on the recording material; and an executing portion configured to execute the cleaning process, before said notifying portion notifies the operator, when the cleaning information acquired from said storing portion of said mounted fixing portion indicates non-execution of the cleaning process.

9. An apparatus according to claim 8, wherein, in a case in which, after the occurrence of the jam is detected by said jam detecting portion, said mounted fixing portion, which is a first fixing portion, is removed from said mounting portion and replaced with a second fixing portion, which is said other fixing portion, and subsequently, said second fixing portion is removed from said mounting portion and said first fixing portion is remounted in said mounting portion, said executing portion acquires the cleaning information stored in said storing portion of said first fixing portion remounted in said mounting portion, and when the acquired cleaning information indicates non-execution of the cleaning process, said executing portion executes the cleaning process for said first fixing portion before the notification by said notifying portion.

10. An apparatus according to claim 8, wherein, when the cleaning information acquired from said storing portion of said mounted fixing portion indicates execution of the cleaning process, said executing portion causes said notifying portion to notify the state of capability of said image forming apparatus to perform the image forming operation on the recording material, without executing the cleaning process.

11. An apparatus according to claim 8, wherein, when the cleaning process is interrupted, said writing portion writes the cleaning information indicating non-execution of the cleaning process into said storing portion of said mounted fixing portion.

12. An apparatus according to claim 8, wherein, when the cleaning process is interrupted, said writing portion writes information indicating interruption of the cleaning process into said storing portion of said mounted fixing portion, and, when the cleaning information acquired from said storing portion of said mounted fixing portion indicates that the cleaning process has been interrupted, said executing portion executes a short cleaning process, a time period of execution of the short cleaning process being less than a time period of execution of the cleaning process executed when the cleaning information acquired from said storing portion of said mounted fixing portion indicates non-execution of the cleaning process, before the notification by said notifying portion.

13. An apparatus according to claim 8, wherein said mounted fixing portion further includes:

a heating portion configured to heat said rotatable member; and a temperature detecting portion for detecting a temperature of said rotatable member, and wherein, when the information acquired from said storing portion of said mounted fixing portion indicates non-execution of the cleaning process, said executing portion starts the cleaning process when the temperature detected by said temperature detecting portion reaches a predetermined temperature.

14. An apparatus according to claim 8, wherein said mounted fixing portion further includes:

a second rotatable member cooperative with said rotatable member, which is a first rotatable member, to form a nip for fixing the unfixed toner image on the recording material; and a cleaning portion for cleaning said first rotatable member, said cleaning portion including:

a collection rotatable member configured to collect toner from said first rotatable member while being rotated by said first rotatable member;

a web contacted to a surface of said collection rotatable member to remove the toner from said collection rotatable member;

a roller on which said web is wound; and a winding-up roller configured to wind said web, and wherein the cleaning process is executed while intermittently rotating said winding-up roller.

15. An apparatus according to claim 8, further comprising a cleaning portion configured to clean said rotatable member of said mounted fixing portion, wherein said cleaning portion includes:

a web configured to remove toner from said rotatable member while being rotated by said rotatable member;

a roller on which said web is wound; and a winding-up roller configured to wind said web, and wherein the cleaning process is executed while intermittently rotating said winding-up roller.

16. An apparatus according to claim 8, wherein said mounted fixing portion is operable to fix the unfixed toner image on a predetermined type of recording material, including a recording material having a predetermined width, and said mounted fixing portion is replaceable with said other fixing portion, which is operable to fix the unfixed toner image on another predetermined type of recording material, not including the recording material having the predetermined width, said other fixing portion including a storing portion for storing cleaning information, wherein said executing portion determines whether the cleaning process is to be executed on the basis of the cleaning information stored in said storing portion of said mounted fixing portion, and wherein, when said other fixing portion is mounted in said mounting portion, said executing portion determines whether the cleaning process is to be executed on the basis of the cleaning information stored in said storing portion of said other fixing portion.

17. An apparatus according to claim 8, wherein said mounted fixing portion is operable to fix the unfixed toner image on a predetermined type of recording material, including a predetermined envelope, and said mounted fixing portion is replaceable with said other fixing portion, which is operable to fix the unfixed toner image on another predetermined type of recording material, which does not include the predetermined envelope, said other fixing portion including a storing portion for storing cleaning information, wherein said executing portion determines whether the cleaning process is to be executed on the basis of the cleaning information stored in said storing portion of said mounted fixing portion, and wherein, when said other fixing portion is mounted in said mounting portion, said executing portion determines whether the cleaning process is to be executed on the basis of the cleaning information stored in said storing portion of said other fixing portion.

18. An image forming apparatus according to claim 8, further comprising a cleaning portion for cleaning said rotatable member of said mounted fixing portion in the cleaning process, wherein said executing portion executes, before the notification by said notifying portion, a warming-up process for bringing said mounted fixing portion into a state capable of starting the fixing operation, the warming-up process including a cleaning process to be executed by said cleaning portion irrespective of the cleaning information acquired from said storing portion of said mounted fixing portion.

19. An image forming apparatus comprising:

a main assembly including:

an image forming portion configured to form an unfixed toner image on a recording material;

a mounting portion; and a storing device configured to store information;

a fixing portion mounted in said mounting portion, said fixing portion being replaceable with another fixing portion which is mountable to said mounting portion, and configured to execute a fixing operation, said fixing portion including:

a rotatable member contactable to a surface of the recording material, which carries the unfixed toner image formed by said image forming portion, and a discriminating portion configured to indicate identifying information of said fixing portion for discriminating said fixing portion from said other fixing portion;

a jam detecting portion configured to detect an occurrence of a jam in said mounted fixing portion;

a writing portion configured to write cleaning information, indicating whether a cleaning process for cleaning said rotatable member of said mounted fixing portion after clearance of the jam is already executed, in correlation with the identifying information of said mounted fixing portion, into said storing device, said writing portion writing, as the cleaning information in correlation with the identifying information of said mounted fixing portion, (i) information indicating non-execution of the cleaning process when said jam detecting portion detects the occurrence of the jam in said mounted fixing portion, and (ii) information indicating the cleaning process is already executed at least in response to execution of the cleaning process;

a notifying portion configured to notify an operator of a state of capability of said image forming apparatus to perform an image forming operation; and an executing portion configured to execute the cleaning process, before said notifying portion notifies the operator, when the cleaning information stored in said storing device in correlation with the identifying information indicated by said discriminating portion of said mounted fixing portion indicates non-execution of the cleaning process.

20. An apparatus according to claim 19, wherein, when said mounted fixing portion, which is a first fixing portion in which the occurrence of the jam is detected by said jam detecting portion, is removed from said mounting portion and replaced with a second fixing portion, and subsequently, said second fixing portion is removed from said mounting portion and said first fixing portion is remounted in said mounting portion, said executing portion acquires the identifying information from said discriminating portion of said first fixing portion remounted in said mounting portion, and, when the cleaning information stored in said storing device in correlation with the acquired identifying information indicates non-execution of the cleaning process, said executing portion executes the cleaning process for said first fixing portion, before the notification by said notifying portion.

21. An apparatus according to claim 19, wherein, when the cleaning information stored in said storing device in correlation with the identifying information indicated by said discriminating portion of said mounted fixing portion indicates execution of the cleaning process, said executing portion causes said notifying portion to notify the state of capability of said image forming apparatus to perform the image forming operation on the recording material, without executing the cleaning process.

22. An apparatus according to claim 19, wherein, when the cleaning process is interrupted, said writing portion writes the cleaning information, indicating non-execution of the cleaning process in correlation with the identifying information of said mounted fixing portion, into said storing device.

23. An apparatus according to claim 19, wherein, when the cleaning process is interrupted, said writing portion writes information indicating interruption of the cleaning process in said storing device, and, when the cleaning information stored in said storing device in correlation with the identifying information indicated by said discriminating portion of said mounted fixing portion indicates that the cleaning process has been interrupted, said executing portion executes a short cleaning process, a time period of execution of the short cleaning process being less than a time period of execution of the cleaning process executed when the cleaning information stored in said storing portion in correlation with the identifying information indicated by said discriminating portion of said mounted fixing portion indicates non-execution of the cleaning process, before the notification by said notifying portion.

24. An apparatus according to claim 19, wherein said fixing portion further includes:

a heating portion configured to heat said rotatable member; and a temperature detecting portion for detecting a temperature of said rotatable member, and wherein, when the cleaning information stored in said storing device in correlation with the identifying information indicated by said discriminating portion of said mounted fixing portion indicates non-execution of the cleaning process, said executing portion starts the cleaning process when the temperature detected by said temperature detecting portion reaches a predetermined temperature.

25. An apparatus according to claim 19, wherein said fixing portion further includes:

a second rotatable member cooperative with said rotatable member, which is a first rotatable member, to form a nip for fixing the unfixed toner image on the recording material; and a cleaning portion for cleaning said first rotatable member, said cleaning portion including:

a collection rotatable member configured to collect toner from said first rotatable member while being rotated by said first rotatable member;

a web contacted to a surface of said collection rotatable member to remove the toner from said collection rotatable member;

a roller on which said web is wound; and a winding-up roller configured to wind said web, and wherein the cleaning process is executed while intermittently rotating said winding-up roller.

26. An apparatus according to claim 19, wherein said fixing portion further includes a cleaning portion configured to clean said rotatable member, said cleaning portion including:

a web configured to remove toner from said rotatable member while being rotated by said rotatable member;

a roller on which said web is wound; and a winding-up roller configured to wind said web, and wherein the cleaning process is executed while intermittently rotating said winding-up roller.

27. An apparatus according to claim 19, further comprising a cleaning portion for cleaning said rotatable member of said mounted fixing portion in the cleaning process, wherein said executing the portion executes, before the notification by said notifying portion, a warming-up process for bringing said mounted fixing portion into a state capable of starting the fixing operation, the warming-up process including a cleaning process by said cleaning portion to be executed irrespective of the cleaning information acquired from said storing portion of said mounted fixing portion.

28. An image forming system comprising:

an image forming apparatus; and a storing device communicable with said image forming apparatus and configured to store information;

wherein said image forming apparatus includes:

an image forming portion configured to form an unfixed toner image on a recording material;

a mounting portion;

a fixing portion mounted in said mounting portion, said fixing portion being replaceable with another fixing portion which is mountable to said mounting portion, said fixing portion including:

a rotatable member contactable to a surface of the recording material, which carries the unfixed toner image formed by said image forming portion, and a discriminating portion configured to indicate identifying information of said fixing portion for discriminating said fixing portion from said other fixing portion;

a jam detecting portion configured to detect an occurrence of a jam in said mounted fixing portion;

a writing portion configured to write cleaning information, indicating whether or not a cleaning process for cleaning said rotatable member of said mounted fixing portion after clearance of the jam is already executed, in correlation with the identifying information of said mounted fixing portion, into said storing device, said writing portion writing, as the cleaning information in correlation with the identifying information of said mounted fixing portion, (i) information indicating non-execution of the cleaning process when said jam detecting portion detects the occurrence of the jam in said mounted fixing portion, and (ii) information indicating the cleaning process is already executed at least in response to executing the cleaning process;

a notifying portion configured to notify an operator of a state of capability of said image forming apparatus to perform an image forming operation; and an executing portion configured to execute the cleaning process, before said notifying portion notifies the operator, when the cleaning information stored in said storing device in correlation with the identifying information indicated by said discriminating portion of said mounted fixing portion indicates non-execution of the cleaning process.

29. A system according to claim 28, wherein, when said mounted fixing portion, which is a first fixing portion in which the occurrence of the jam is detected by said jam detecting portion, is removed from said mounting portion and replaced with a second fixing portion, and subsequently, said second fixing portion is removed from said mounting portion and said first fixing portion is remounted in said mounting portion, said executing portion acquires the identifying information from said discriminating portion of said first fixing portion remounted in said mounting portion, and, when the cleaning information stored in said storing device in correlation with the acquired identifying information indicates non-execution of the cleaning process, said executing portion executes the cleaning process for said first fixing portion, before the notification by said notifying portion.

30. A system according to claim 28, wherein, when the cleaning information stored in said storing device in correlation with the identifying information indicated by said discriminating portion of said mounted fixing portion indicates the cleaning process is already executed, said executing portion causes said notifying portion to notify the state of capability of said image forming apparatus to perform the image forming operation on the recording material, without executing the cleaning process.

31. A system according to claim 28, wherein when the cleaning process is interrupted, said writing portion writes the cleaning information, indicating non-execution of the cleaning process in correlation with the identifying information of said mounted fixing portion, into said storing device.

32. A system according to claim 28, wherein, when the cleaning process is interrupted, said writing portion writes information indicating interruption of the cleaning process in said storing device, and, when the cleaning information stored in said storing device in correlation with the identifying information indicated by said discriminating portion of said mounted fixing portion indicates that the cleaning process has been interrupted, said executing portion executes a short cleaning process, a time period of execution of the short cleaning process being less than a time period of execution of the cleaning process executed when the cleaning information stored in said storing portion in correlation with the identifying information indicated by said discriminating portion of said mounted fixing portion indicates non-execution of the cleaning process, before the notification by said notifying portion.

33. A system according to claim 28, wherein said fixing portion further includes:

a heating portion configured to heat said rotatable member; and a temperature detecting portion for detecting a temperature of said rotatable member, and wherein, when the cleaning information stored in said storing device in correlation with the identifying information indicated by said discriminating portion of said mounted fixing portion indicates non-execution of the cleaning process, said executing portion starts the cleaning process when the temperature detected by said temperature detecting portion reaches a predetermined temperature.

34. A system according to claim 28, wherein said fixing portion further includes:

a second rotatable member cooperative with said rotatable member, which is a first rotatable member, to form a nip for fixing the unfixed toner image on the recording material; and a cleaning portion for cleaning said first rotatable member, said cleaning portion including:

a collection rotatable member configured to collect toner from said first rotatable member while being rotated by said first rotatable member;

a web contacted to a surface of said collection rotatable member to remove the toner from said collection rotatable member;

a roller on which said web is wound; and a winding-up roller configured to wind said web, and wherein the cleaning process is executed while intermittently rotating said winding-up roller.

35. A system according to claim 28, wherein said fixing portion further includes a cleaning portion configured to clean said rotatable member, wherein said cleaning portion includes:

a web configured to remove toner from said rotatable member while being rotated by said rotatable member;

a roller on which said web is wound; and a winding-up roller configured to wind said web, and wherein the cleaning process is executed while intermittently rotating said winding-up roller.

36. A system according to claim 28, further comprising a second image forming apparatus, wherein said storing device is communicable with said second image forming apparatus, and wherein said second image forming apparatus includes:

a second image forming portion configured to form an unfixed toner image on a recording material;

a second mounting portion configured to detachably mount said fixing portion;

a second jam detecting portion configured to detect a jam in said fixing portion mounted in said second mounting portion;

a second writing portion configured to write cleaning information, indicating whether a cleaning process for cleaning said rotatable member after clearance of the jam is already executed, in correlation with the identifying information of said fixing portion, into said storing device, when said fixing portion is mounted in said second mounting portion, said second writing portion writing, as the cleaning information in correlation with the identifying information of said mounted fixing portion, (i) information indicating non-execution of the cleaning process into said storing device when said second jam detecting portion detects the occurrence of the jam in said mounted fixing portion, and (ii) information indicating the cleaning process is already executed at least in response to executing the cleaning process;

a second notifying portion configured to notify an operator of a state of capability of said second image forming apparatus to perform an image forming operation on the recording material; and a second executing portion configured to execute the cleaning process, before said second notifying portion notifies the operator, when the cleaning information stored in said storing device in correlation with the identifying information indicated by said discriminating portion of said mounted fixing portion indicates non-execution of the cleaning process.

37. An image forming apparatus comprising:

an image forming portion configured to form an unfixed toner image on a recording material;

a mounting portion;

a fixing portion mounted in said mounting portion, said fixing portion being replaceable with another fixing portion which is mountable to said mounting portion, said fixing portion including:

a rotatable member contactable to a surface of the recording material, which carries the unfixed toner image formed by said image forming portion, to fix the unfixed toner image on the recording material, a discriminating portion configured to indicate identifying information of said fixing portion for discriminating said fixing portion from said another fixing portion, and a fixing storing portion configured to store information;

a jam detecting portion configured to detect an occurrence of a jam in said mounted fixing portion;

a main assembly storing portion configured to store information;

a writing portion configured to write cleaning information, indicating whether a cleaning process for cleaning said rotatable member after clearance of the jam detected by said jam detecting portion is already executed, into said fixing storing portion, and to write the cleaning information in correlation with the identifying information into said main assembly storing portion, said writing portion writing, as the cleaning information, (i) information indicating non-execution of the cleaning process into said main assembly storing portion and into said fixing storing portion when said jam detecting portion detects the occurrence of the jam, and (ii) information indicating the cleaning process is already executed into said main assembly storing portion and into said fixing storing portion at least in response to executing the cleaning process;

a notifying portion configured to notify an operator of a state of capability of said image forming apparatus to perform an image forming operation on the recording material; and an executing portion configured to execute the cleaning process, before said notifying portion notifies the operator, when non-execution of the cleaning process for said mounted fixing portion is discriminated, depending on the information acquired from said main assembly storing portion and the information acquired from said fixing storing portion of said mounted fixing portion.

38. An apparatus according to claim 37, further comprising an output portion configured to output information indicative of time, wherein said writing portion writes the cleaning information in said main assembly storing portion in correlation with the identifying information and with the time information provided by said output portion, and writes the cleaning information in said fixing storing portion in correlation with the time information, and wherein, when one of the cleaning information stored in said fixing storing portion and the cleaning information stored in said main assembly storing portion, correlating to later time information, indicates non-execution of the cleaning process, said executing portion executes the cleaning process before said notifying portion executes the notification.

39. An apparatus according to claim 38, wherein when one of the cleaning information stored in said fixing storing portion and the cleaning information stored in said main assembly storing portion, correlating to later time information, indicates that the cleaning process is already executed, said executing portion causes said notifying portion to notify the state of capability of said image forming apparatus to perform the image forming operation on the recording material, without executing the cleaning process.

40. An apparatus according to claim 37, wherein when said main assembly storing portion does not store the cleaning information correlating to the identifying information, and the cleaning information acquired from said fixing storing portion indicates non-execution of the cleaning process, said executing portion executes the cleaning process before said notifying portion executes the notification.

41. An apparatus according to claim 37, wherein, when the cleaning process is interrupted, said writing portion writes information indicating non-execution of the cleaning process as the cleaning information into said main assembly storing portion and into said fixing storing portion.

42. An apparatus according to claim 37, wherein, when the cleaning information indicates that the cleaning process is interrupted for said mounted fixing portion, depending on the information acquired from said fixing storing portion and the information acquired from said main assembly storing portion, said executing portion executes a short cleaning process, a time period of execution of the short cleaning process being less than a time period of execution of the cleaning process executed when the cleaning information indicates non-execution of the cleaning process for the mounted fixing portion, before said notifying portion executes the notification.

43. An apparatus according to claim 37, wherein said fixing portion further includes:

a heating portion configured to heat said rotatable member; and a temperature detecting portion for detecting a temperature of said rotatable member, and wherein, when the cleaning information indicates non-execution of the cleaning process for said mounted fixing portion, depending on the information acquired from said main assembly storing portion and the information acquired from said fixing storing portion of said mounted fixing portion, said executing portion starts the cleaning process when the temperature detected by said temperature detecting portion reaches a predetermined temperature.

44. An apparatus according to claim 37, wherein said fixing storing portion stores number information indicative of a number of times of writing by said writing portion, and said writing portion writes the cleaning information into said fixing storing portion and renews number information stored in said fixing storing portion, and writes the cleaning information, the number information renewed in said fixing storing portion, and the identifying information, in correlation with each other, into said main assembly storing portion, and wherein, when the cleaning information correlating to the larger one of the number information acquired from said fixing storing portion and the number information acquired from said main assembly storing portion indicates non-execution of the cleaning process, said executing portion executes the cleaning process before said notifying portion executes the notification.

45. An apparatus according to claim 37, wherein said fixing portion includes:

a second rotatable member cooperative with said rotatable member, which is a first rotatable member, to form a nip for fixing the unfixed toner image on the recording material; and a cleaning portion for cleaning said first rotatable member, said cleaning portion including:

a collection rotatable member configured to collect toner from said first rotatable member while being rotated by said first rotatable member;

a web contacted to a surface of said collection rotatable member to remove the toner from said collection rotatable member, a roller on which said web is wound, and a winding-up roller configured to wind said web, and wherein the cleaning process is executed while intermittently rotating said winding-up roller.

46. An apparatus according to claim 37, wherein said fixing portion further includes a cleaning portion configured to clean said rotatable member, said cleaning portion including:

a web configured to remove toner from said rotatable member while being rotated by said rotatable member, a roller on which said web is wound, and a winding-up roller configured to wind said web, and wherein the cleaning process is executed while intermittently rotating said winding-up roller.

47. An apparatus according to claim 37, wherein said fixing storing portion stores the identifying information as the identifying portion.

* * * * *